US008857865B2

(12) United States Patent
Im et al.

(10) Patent No.: US 8,857,865 B2
(45) Date of Patent: Oct. 14, 2014

(54) LATCH AND REFRIGERATOR HAVING THE SAME

(75) Inventors: Jihyun Im, Seoul (KR); Moongyo Jung, Seoul (KR); Jindong Kim, Seoul (KR); Gyeongjin Jang, Seoul (KR); Myoungju Kang, Seoul (KR)

(73) Assignee: LG Electronics, Inc., Seoul (KR)

( * ) Notice: Subject to any disclaimer, the term of this patent is extended or adjusted under 35 U.S.C. 154(b) by 14 days.

(21) Appl. No.: 13/473,686

(22) Filed: May 17, 2012

(65) Prior Publication Data

US 2013/0168975 A1 Jul. 4, 2013

(30) Foreign Application Priority Data

| | | |
|---|---|---|
| Jan. 3, 2012 | (KR) | 10-2012-0000457 |
| Jan. 27, 2012 | (KR) | 10-2012-0008600 |
| Jan. 27, 2012 | (KR) | 10-2012-0008601 |
| Jan. 27, 2012 | (KR) | 10-2012-0008602 |
| Jan. 27, 2012 | (KR) | 10-2012-0008603 |
| Jan. 27, 2012 | (KR) | 10-2012-0008604 |
| Jan. 27, 2012 | (KR) | 10-2012-0008605 |
| Jan. 27, 2012 | (KR) | 10-2012-0008606 |
| Jan. 27, 2012 | (KR) | 10-2012-0008607 |
| Jan. 27, 2012 | (KR) | 10-2012-0008608 |

(51) Int. Cl.
*E05C 3/02* (2006.01)

(52) U.S. Cl.
USPC ..... 292/194

(58) Field of Classification Search
USPC ..... 292/95, 96, 101, 121, 122, 128, 198, 292/216, 219, 220, 228, DIG. 11, DIG. 37, 292/DIG. 69, DIG. 71; 312/222, 405, 405.1
See application file for complete search history.

(56) References Cited

U.S. PATENT DOCUMENTS

| | | | | |
|---|---|---|---|---|
| 954,915 | A | 4/1910 | Bennett | 292/200 |
| 1,209,544 | A | 12/1916 | Bolger | |

(Continued)

FOREIGN PATENT DOCUMENTS

| | | | |
|---|---|---|---|
| DE | 198 02 765 | A1 | 7/1999 |
| GB | 537 114 | A | 6/1941 |

(Continued)

OTHER PUBLICATIONS

European Search Report dated Oct. 28, 2013 for corresponding Application No. 12170443.1.

(Continued)

*Primary Examiner* — Kristina Fulton
*Assistant Examiner* — Christine M Mills
(74) *Attorney, Agent, or Firm* — Ked & Associates, LLP

(57) ABSTRACT

A refrigerator including a storage container that may be selectively coupled to a refrigerator body or to a door by a storage container support device is provided. The refrigerator may include a refrigerator body having a storage compartment formed therein, a rotatable door to open or close the storage compartment, a gasket provided between the door and the refrigerator body, a storage container that may be selectively coupled to the door or to the refrigerator body, a storage container support device provided at the door, the refrigerator body or the storage container to allow the storage container to be selectively coupled to and supported by the refrigerator body or the door, and a control device provided in the door to selectively control operation of the storage container support device from an exterior of the door.

15 Claims, 54 Drawing Sheets

(56) References Cited

U.S. PATENT DOCUMENTS

| | | | | | |
|---|---|---|---|---|---|
| 1,927,398 | A | | 9/1933 | Glasser | |
| 1,984,977 | A | | 12/1934 | Mize | |
| 2,021,096 | A | | 11/1935 | Canton | |
| 2,046,909 | A | | 7/1936 | Terry et al. | |
| 2,051,132 | A | | 8/1936 | Dart | |
| 2,122,680 | A | | 7/1938 | Dart | |
| 2,129,923 | A | | 9/1938 | Frankel | |
| 2,130,617 | A | | 9/1938 | Dockharn | |
| 2,131,680 | A | | 9/1938 | Zahodiakin | |
| 2,135,878 | A | | 11/1938 | Sekyra, Sr. | |
| 2,150,064 | A | | 3/1939 | John et al. | |
| 2,276,937 | A | | 3/1942 | Cordova | |
| 2,741,100 | A | | 4/1956 | Young | |
| 2,777,722 | A | * | 1/1957 | Burke | 292/332 |
| 2,812,205 | A | | 11/1957 | Jakeway | |
| 2,840,410 | A | | 6/1958 | Jakeway | |
| 2,942,438 | A | | 6/1960 | Schmeling | |
| 2,999,712 | A | | 9/1961 | Jakeway | |
| 3,086,830 | A | | 4/1963 | Malia | |
| 3,140,134 | A | | 7/1964 | Nairn | |
| 3,722,237 | A | * | 3/1973 | Taylor | 70/107 |
| 4,302,907 | A | * | 12/1981 | Canals et al. | 49/65 |
| 4,635,977 | A | | 1/1987 | Yamada | |
| 5,064,255 | A | | 11/1991 | Inui et al. | |
| 7,104,621 | B2 | | 9/2006 | Choi | |
| 7,654,107 | B2 | | 2/2010 | Okuda et al. | |
| 2006/0006668 | A1 | * | 1/2006 | Hidding et al. | 292/216 |
| 2010/0307188 | A1 | | 12/2010 | Kwon et al. | |
| 2010/0308705 | A1 | | 12/2010 | Kwon et al. | |

FOREIGN PATENT DOCUMENTS

| | | | |
|---|---|---|---|
| JP | S 50-84862 | | 7/1975 |
| JP | S 57-85184 | | 11/1980 |
| JP | S 60-23688 | | 2/1985 |
| JP | 63-142682 | | 9/1988 |
| JP | 11-108542 | | 4/1999 |
| JP | 2000-065459 | | 3/2000 |
| JP | 2000-249462 | | 9/2000 |
| JP | 2001-108357 | | 4/2001 |
| JP | 2001-227858 | | 8/2001 |
| JP | 2004-211977 | | 7/2004 |
| JP | 2005-147650 | | 6/2005 |
| JP | 2006-038437 | | 2/2006 |
| JP | 2009-052788 | | 3/2009 |
| JP | 2011-069612 | | 4/2011 |
| WO | WO 2004/059228 | A1 | 7/2004 |

OTHER PUBLICATIONS

European Search Report dated Oct. 29, 2013 for corresponding Application No. 12168066.4.

Office Action dated Dec. 4, 2013 for co-pending U.S. Appl. No. 13/473,668.

Office Action dated Jan. 15, 2014 for co-pending U.S. Appl. No. 13/473,726.

U.S. Notice of Allowance issued in U.S. Appl. No. 13/473,672, dated May 27, 2014.

* cited by examiner

LATCH AND REFRIGERATOR HAVING THE SAME

CROSS-REFERENCE TO RELATED APPLICATION(S)

This application claims priority under 35 U.S.C. §119 to Korean Application Nos. 10-2012-0008600, 10-2012-0008601, 10-2012-0008602, 10-2012-0008603, 10-2012-0008604, 10-2012-0008605, 10-2012-0008606, 10-2012-0008607 and 10-2012-0008608, all filed in Korea on Jan. 27, 2012, and to Korean Application No. 10-2012-0000457, filed in Korea on Jan. 3, 2012, whose entire disclosures are hereby incorporated by reference.

BACKGROUND

1. Field

This relates to a latch, and a refrigerator having such a latch.

2. Background

In general, a refrigerator keeps items frozen or at a temperature slightly above freezing by lowering the interior temperature of the refrigerator using cold air generated by a refrigeration cycle including a compressor, a condenser, an expansion valve, and an evaporator. Such a refrigerator may include a freezing compartment in which items are stored in a frozen state, and a refrigerating compartment in which items are stored at a low temperature. As the interior of the refrigerator is normally kept at a lower temperature than the outside, it may be advantageous to structure access doors of the freezing compartment and the refrigerating compartment to minimize the loss of cold air.

BRIEF DESCRIPTION OF THE DRAWINGS

The embodiments will be described in detail with reference to the following drawings in which like reference numerals refer to like elements wherein.

DETAILED DESCRIPTION

A refrigerator may include, for example, a freezing compartment and refrigerating compartment defined in a cabinet, and may be selectively opened or closed by a freezing compartment door and a refrigerating compartment door, respectively. The freezing compartment door and the refrigerating compartment door may be rotatably coupled to open front sides the freezing compartment and the refrigerating compartment. Each of the doors may include a gasket to seal the interior of the corresponding storage compartment. The freezing compartment door and/or the refrigerating compartment door may each be provided with a storage container configured to store small storage items.

To minimize loss of cold air due to frequent opening/closing of the door, a freezing compartment door and/or a refrigerating compartment door may include an auxiliary opening that provides access to the storage container and an auxiliary door that is rotatably mounted to the door to selectively open and close the auxiliary opening.

The auxiliary door may allow a user to put items into or remove items from a receiving space without opening the refrigerating compartment door or the freezing compartment door.

That is, the freezing compartment door and/or the refrigerating compartment door may be rotatably connected to the refrigerator body by, for example, a hinge and, in turn, the auxiliary door may be rotatably mounted to the freezing compartment door and/or the refrigerating compartment door.

A gasket to seal the freezing compartment or the refrigerating compartment may be installed along an edge portion of an inner surface of the freezing compartment door and/or the refrigerating compartment door that comes into contact with a front surface of the refrigerator body. A gasket may also be installed along an edge of an inner surface of the auxiliary door that comes into contact with the freezing compartment door and/or the refrigerating compartment door, so as to seal the receiving space inside the auxiliary door.

However, providing a gasket at the auxiliary door, in addition to the freezing compartment door and/or the refrigerating compartment door, may increase loss of cold air when compared to the case in which no auxiliary door is provided.

In addition, condensation may accumulate at a gasket contact region, i.e. the front surface of the refrigerator body and a front surface of the freezing compartment door and/or the refrigerating compartment door due to a temperature difference between the interior and the exterior. This may be prevented by heating these two regions, but the use of two heaters to prevent condensation in these areas may increase power consumption.

Figure 1:
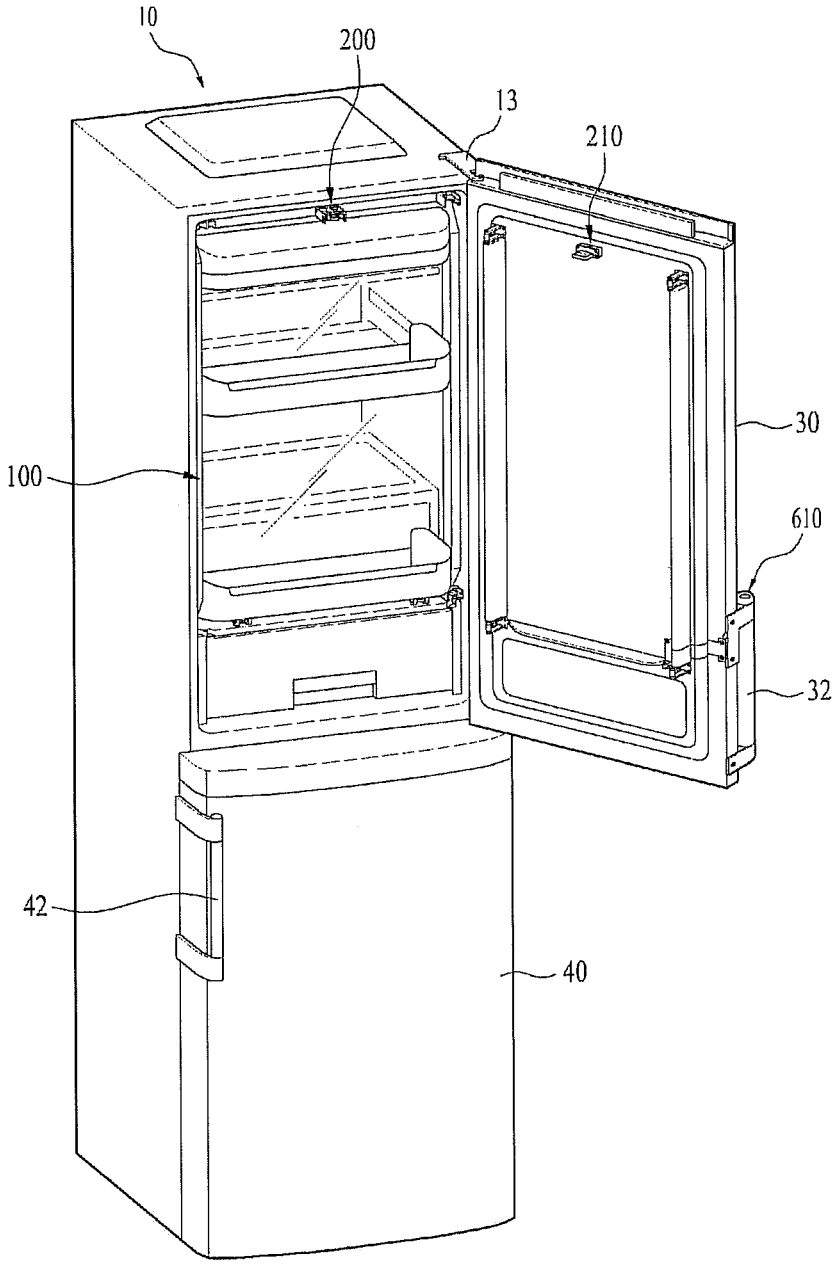
FIGS. 1 and 2 are perspective views of a refrigerator as embodied and broadly described herein.
Figure 2:
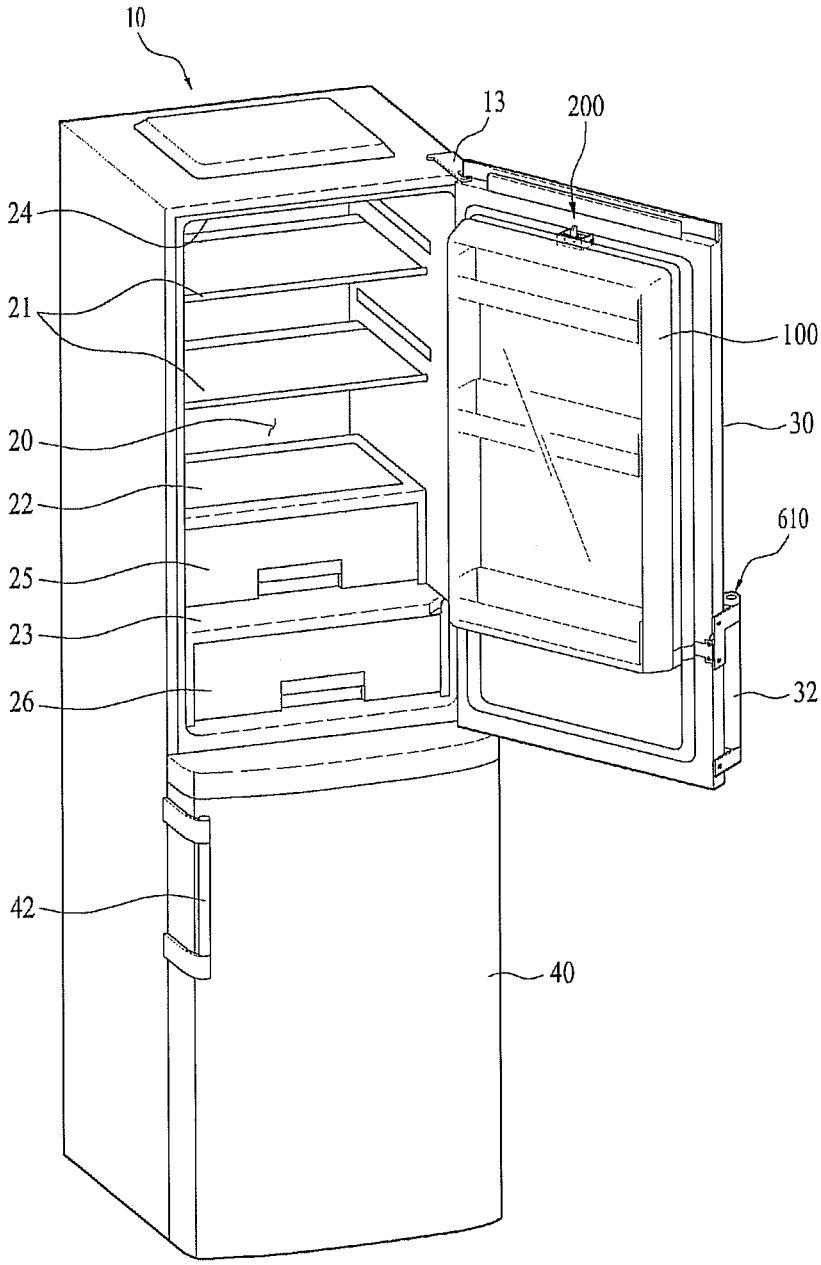

As shown in FIGS. 1 and 2, a refrigerator as embodied and broadly described herein may include a refrigerator body 10 in which a storage compartment 20 is defined, the compartment 20 being partitioned into refrigerating and freezing compartments, doors 30 and 40 configured to selectively open and close a front opening of the refrigerator body 10, a storage container 100 detachably coupled to and supported by the refrigerator body 10 or one of the doors 30 and 40, and a connection support device 200 provided between the storage container 100 and the one of the doors 30 and 40 so that the storage container 100 may be selectively supported by the one of the doors 30 and 40.

Although the exemplary embodiment shown in FIGS. 1 and 2 includes an upper refrigerating compartment (i.e. the storage compartment 20) and a lower freezing compartment, embodiments as broadly described herein may be applied to a refrigerator in which the positions of the refrigerating compartment and the freezing compartment are reversed, or in which the refrigerating compartment and the freezing compartment are located side by side, at left and right sides.

As shown in the exemplary embodiment of FIGS. 1 and 2, a fixing device 210 may be provided at an interior/rear surface of the door 30, at a position corresponding to the connection support device 200, such that the connection support device 200 may be selectively engaged by the fixing device 210. In alternative embodiments, such a fixing device 210 may be provided at a rear/interior surface of the door 40. Simply for ease of discussion, in this exemplary embodiment, the storage container 100 is coupled to the refrigerating compartment door 30. Other arrangements may also be appropriate.

The connection support device 200 may be selectively connected to and released from the fixing device 210 according to whether or not the connection support device 200 comes into contact with an entrance rim of the storage compartment 20 defined in the refrigerator body 10.

Doors 30 and 40 of the refrigerator may be rotatably connected to one side of the refrigerator body 10 via hinges 13, so as to open or close front openings of the refrigerating compartment and the freezing compartment, respectively.

Figure 4:
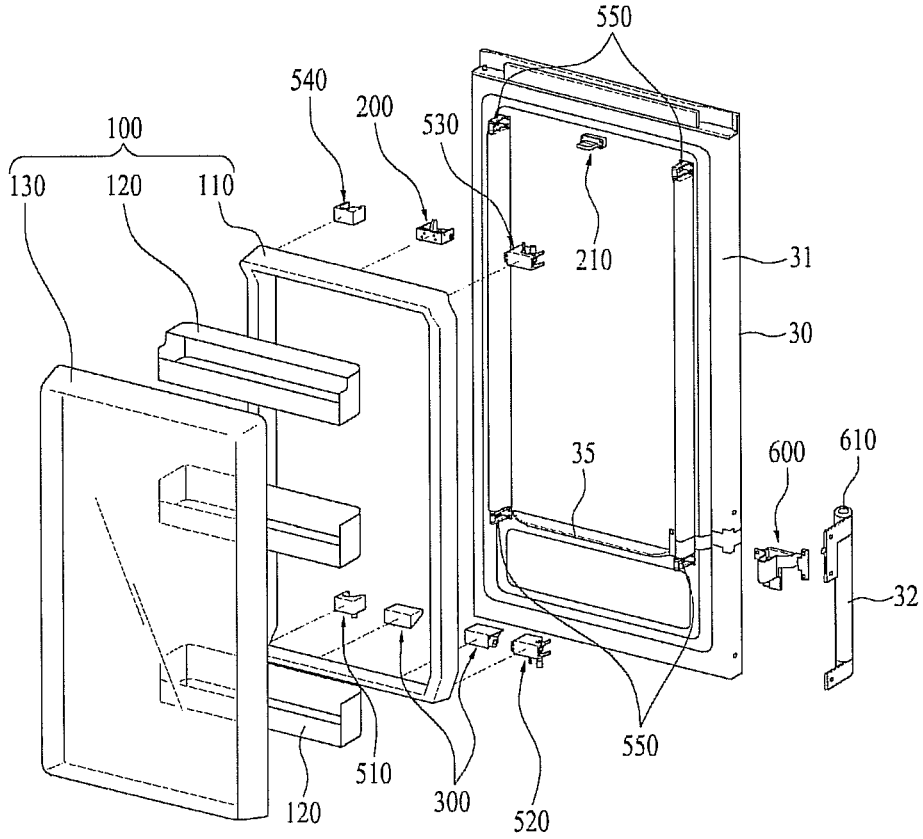
FIG. 4 is an exploded perspective view of the storage container and refrigerator door of the refrigerator shown in FIGS. 1 and 2.

As shown in FIG. 4, a gasket 31 may be attached to an edge of an inner surface of the door 30 that comes into contact with a front surface of the refrigerator body 10, so as to seal the storage compartment 20. Alternatively, the gasket may be provided on the front surface of the body 10.

The doors 30 and 40 may respectively include handles 32 and 42. In particular, in the case of the door 30 to which the storage container 100 is mounted, the handle 32 may be provided at, for example, a left lower corner of the door 30 when viewed from the front side of the refrigerator. Other arrangements may also be appropriate.

Figure 3A:
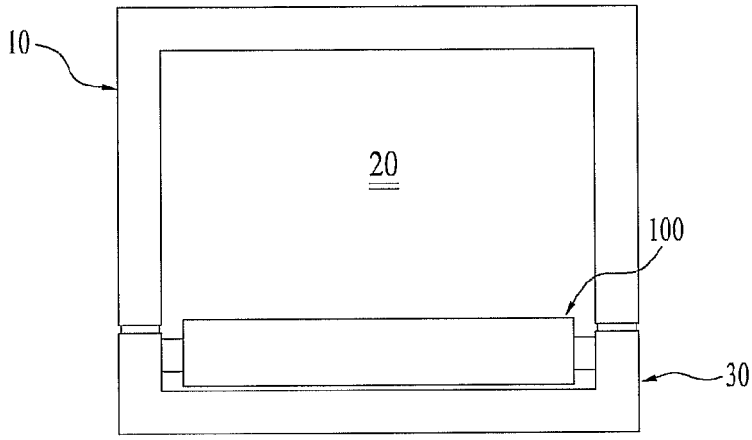
FIGS. 3A-3C are plan sectional views of various positions of a storage container of the refrigerator shown in FIGS. 1 and 2.
Figure 3B:
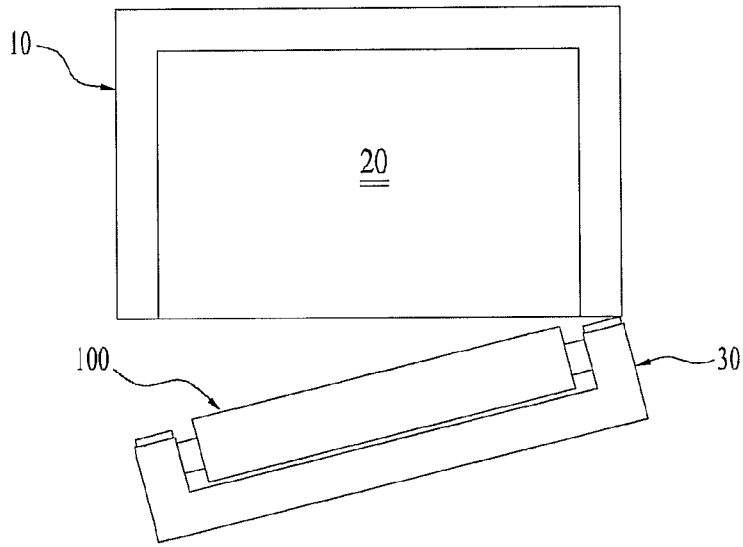
Figure 3C:
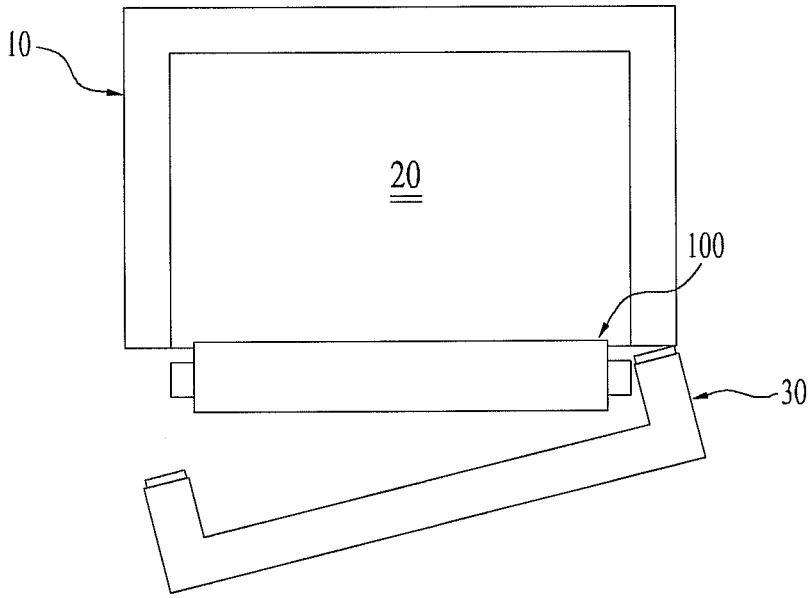

The storage container 100, as illustrated in the exemplary embodiment shown in FIGS. 1 and 2, may be selectively detachably supported by the refrigerator body 10 and the door 30, with the storage container 100 directly coupled either to the door 30, as shown in FIG. 3B, or to the refrigerator body 10, as shown in FIG. 3C, without being connected to the hinge 13. Thus, the storage container 100 may rotate along with the door 30 without assistance of the hinge 13 when the storage container 100 is mounted to the door 30.

To this end, additional devices may provide for connection or disconnection between the storage container 100 and the door 30, and between the storage container 100 and the refrigerator body 10. These devices may include, for example, the connection support device 200, a first latch device 520 (see FIGS. 24 and 31) and a second latch device 530 (see FIGS. 27 and 31), a first guide support device 510 (see FIG. 38), a second guide support device 540 (see FIG. 39), stopper recesses 111 and 121 (see FIGS. 31 and 32) and holding guide recesses 112 and 122 (see FIGS. 31 and 32) into which portions of the first and second latch devices 520 and 530 may be selectively inserted. The aforementioned devices may be generically referred to as a storage container support device.

In FIG. 1 the storage container 100 is positioned in the refrigerator body 10 to allow a user to put storage items into or remove storage items from the storage container 100. Thus, when the user opens the door 30, a front surface of the storage container 100 is exposed to the outside, but cold air within the storage compartment 20 is kept in the storage compartment 20 due to the position of the storage container 100.

In FIG. 2, the storage container 100 is coupled to the door 30. Thus, when the user opens the door 30, a front surface of the storage compartment 20 is exposed to allow the user to put storage items into or remove the storage items from the storage compartment 20.

A button 610 may be provided at an upper end of the handle 32 of the door 30. The button 610 may change a coupling position of the storage container 100 from the refrigerator body 10 to the door 30. In certain embodiments, a controller 600 may selectively control operation of some/all of the components of a particular storage container support device, and may be provided, for example, at the door 30 so that the user may operate the controller 600 from the outside of the door 30. Such a controller 600 may include the button 610 and a plurality of components connected to the button 610.

If the user opens the door 30 while pushing the button 610, as illustrated in FIG. 1, the storage container 100 may be separated from the door 30 and coupled to the storage compartment 20. As such, the front surface of the storage container 100 (serving as an auxiliary storage compartment) is exposed.

As previously noted, the storage container 100 may be supported by each of the refrigerator body 10 and the refrigerating compartment door 30, and may be fixed to maintain the supported position thereof. To this end, as shown in FIG. 4, a refrigerator as embodied and broadly described herein may include first and second latch devices 520 and 530 provided at the storage container 100, to allow the storage container 100 to be selectively supported by and fixed to the door 30 or the storage compartment 20.

In this case, a lower portion of the connection support device 200 may be covered by the storage container 100 and not seen from the outside. Only a portion of the connection support device 200 that comes into contact with an entrance rim 24 of the storage compartment 20 of the refrigerator body 10 may protrude upward and be exposed.

In FIG. 3A the door 30 is positioned so as to close the storage compartment 20 of the refrigerator body 10. In this case, the storage container 100 may be connected to the refrigerator body 10 so as to cover the front opening of the storage compartment 20, or may be connected to the door 30 so as to cover the front opening of the storage compartment 20.

Operations of various devices which may constitute the storage container support device to perform the first operation to couple the storage container 100 to the door 30 will be described hereinafter.

If the storage container support device connects the door 30 and the storage container 100 to each other and the door 30 is rotated, the storage container 100 rotates together with the door 30, and the front opening of the storage compartment 20 may be opened or closed depending on a position of the door 30. Accordingly, the user may remove storage items from or put storage items into the storage compartment 20.

As illustrated in FIG. 3C, the storage container support device may perform a second operation to connect the refrigerator body 10 and the storage container 100 to each other. Operations of various devices which may constitute the storage container support device to perform the second operation will be described hereinafter.

If the storage container support device connects the refrigerator body 10 and the storage container 100 to each other, the storage container 100 may be connected to an entrance of the storage compartment 20 and be fixed at the connected position. In this state, if the user rotates the door 30, the front surface of the storage container 100 is opened or closed because the storage container 100 is kept at the fixed position without movement. Since the storage container 100 has an open front surface, if the door 30 is opened, the user may remove storage items from the storage container 100 or put storage items into the storage container 100, without exposing the interior of the storage compartment 20 to the outside.

As illustrated in FIG. 4, the storage container 100 may include a frame 110 forming a rim of the storage container 100, one or more receiving racks 120 mounted to the frame 110, and a cover 130 coupled to the frame 110 at the rear of the frame 110 so as to define a receiving space that is separated from the storage compartment 20 of the refrigerator body 10.

In certain embodiments, the frame 110 may form a rectangular rim and may be formed of a metallic material.

The one or more receiving racks 120 may be detachably mounted within the frame 110. Since in this particular embodiment the storage container 100 generally defines a vertically elongated rectangular receiving space, the receiving racks 120 may divide the interior receiving space of the storage container 100 into a plurality of receiving spaces, in order to enhance space utilization. To this end, in certain embodiments, two or more receiving racks 120 may be vertically spaced apart from each other by a predetermined distance.

The cover 130 may be attached to the frame 110 at the rear of the frame 110 so as to surround an outer circumferential surface of the frame 110, with the receiving racks 120 mounted to the frame 110, and may be positioned to face the refrigerating compartment 20. In certain embodiments, the cover 130 may be formed of a transparent material so that, if the door 30 is opened in a state in which the storage container 100 is coupled to the refrigerator body 10, the interior of the storage compartment 20 of the refrigerator body 10 may be visible through the transparent cover 130. Similarly, if the door 30 is opened in a state in which the storage container 100 is coupled to the door 30, the interior receiving space of the storage container 100 may be visible through the transparent cover 130.

In alternative embodiments, the storage container 100 may include only the receiving racks 120. In this case, appropriate portions of the storage container support device may be provided on the receiving racks 120. In this case, interior of the storage compartment 20 may be visible through gaps between adjacent receiving racks 120.

The connection support device 200 may be provided, for example, at the center of an upper surface of the frame 110, and the fixing device 210 may be provided at the rear surface of the door 30, at a position corresponding to the connection support device 20 so as to be selectively connected to the connection support device 200. Other positions and arrangements may also be appropriate.

In the exemplary embodiment shown in FIG. 4, when viewed from the front side, the handle 32 is mounted at the lower left corner of the door 30, the first and second latch devices 520 and 530 are respectively mounted at a lower left corner and an upper left corner of the storage container 100, and first and second guide support devices 510 and 540 are respectively mounted at a lower right corner and an upper right corner of the storage container 100.

In this embodiment, the controller 600 that selectively controls operation of the storage container support device is embodied as a latch switch device 600 provided at a portion of the door 30 where the handle 32 is installed. The latch switch device 600 may operate, for example, the latch device 520 by applying pressure to the latch device 520.

The latch switch device 600 is linked to the button 610 so as to apply force rearward of the door 30. As the latch device 520 is operated via operation of the latch switch device 600, coupling between the door 30 and the storage container 100 may be released. Specifically, the door 30 and the storage container 100 may remain continuously coupled to each other so long as the user does not push the button 610. However, if the button 610 is pushed, coupling between the door 30 and the storage container 100 may be released and the storage container 100 may be coupled to the refrigerator body 10.

The handle 32 may be attached to a lateral surface of the door 30. The handle 32 may include, for example, a vertical rod forming a grip portion and a coupling portion horizontally extending from the vertical rod so as to be fastened to the lateral surface of the door 30. The latch switch device 600 may be embedded in the door 30, in the vicinity of a position where the handle 32 is fastened to the door 30.

Fixing members 550 may be provided at edge portions of the door 30 and protrude rearward from the rear surface of the door 30. The fixing members 550 may be inserted into the latch devices 520 and 530 and the guide support devices 510 and 540 so as to be coupled to or engaged by these devices 520, 530, 510 and 540.

The fixing members 550 may be selectively inserted into the first and second latch devices 520 and 530 of the storage container 100 so as to be engaged by the first and second latch devices 520 and 530, thereby facilitating coupling of the storage container 100 to the door 30. Accordingly, when the door 30 is rotated, the storage container 100 rotates together with the door 30 via coupling between the latch devices 520 and 530 and the corresponding fixing members 550.

In certain embodiments, the latch switch device 600 may push a specific one of the latch devices 520 and 530, i.e. the latch device 520 located at the left lower corner of the storage container 100 when viewed from the front side of the refrigerator, thereby releasing the latch device 520 from a locked state.

As such, if the user releases the latch device 520 from a locked state via the latch switch device 600 by pushing the button 610 provided at the handle 32 of the door 30 and thereafter, pulls the door handle 32, the storage container 100 remains coupled to the refrigerator body 10 and only the door 30 is rotated and opened.

A pair of roller devices 300 may be provided at the lower portion of the storage container 100. The roller devices 300 may be considered components of the storage container support device.

The roller devices 300 may include a plurality of rollers each of which selectively supports the storage container 100 on a bottom surface of the storage compartment 20, an upper surface of a shelf 23, and a support bar 35 protruding from the rear surface of the door 30. Specifically, in the case in which the storage container 100 and the refrigerator body 10 are connected to each other, the roller devices 300 come into contact with the bottom surface of the storage compartment 20 or the upper surface of the shelf 23, thereby supporting the load of the storage container 100. In the case in which the storage container 100 and the door 30 are connected to each other, the roller devices 300 come into contact with the support bar 35 of the door 30, thereby supporting the load of the storage container 100 on the support bar 35.

In the exemplary embodiment shown in FIG. 2, the storage container 100 does not completely cover the front opening of the storage compartment 20. Rather, the storage container 100 covers a portion of the front opening above the shelf 23. The shelf 23 is positioned above a drawer 26 arranged in a lowermost region of the storage compartment 20. In this arrangement, the storage container 100 together with the shelf 23 and drawer 26 provide for substantially full closure of the front opening of the compartment 20.

In this case, when the storage container 100 is coupled to the refrigerator body 10, one or more rollers of the roller devices 300 are supported by a front region of the upper surface of the shelf 23 that is positioned above the lowermost drawer 26.

Additionally, as shown in FIG. 2, shapes/dimensions of a plurality of shelves 21 and 22 and a drawer 25 above the lowermost drawer 26 in the refrigerating compartment 20 may also be designed to accommodate the storage container 100 coupled to the refrigerator body 10 at a predetermined depth.

A refrigerator as embodied and broadly described herein may be configured such that the storage container 100 completely closes the front opening of the storage compartment 20. In this case, the storage container 100 may have a vertical height corresponding to a height of the front opening of the storage compartment 20 and a width corresponding to a width of the front opening of the storage compartment 20, so that the storage container 100 fits within the front opening. If this arrangement includes two drawers 25 and 26 provided in the refrigerating compartment 20, a shape and dimension of the lowermost drawer 26 may be selected so as not to interfere with the storage container 100, similar to the drawer 25 above. In this arrangement, the roller devices 300 come into contact with the bottom surface of the refrigerating compartment 20, and not the shelf 23 above the lowermost drawer 26.

As illustrated in FIG. 4 and discussed above, the latch devices 520 and 530 and the guide support devices 510 and 540, which may selectively secure the storage container 100 to the refrigerator body 10 or the door 30 may include the first latch device 520 provided at a lower (left) corner portion of the frame 110 of the storage container 100 and the second latch device 530 provided at an upper (left) corner portion of the frame 110, at a side of the door 30 opposite the hinge 13, so that the fixing members 550 may be selectively engaged by and coupled to the first and second latch devices 520 and 530.

The fixing members 550 may be located at the four corners of the rear surface of the door 30 so as to catch and engage the first and second latch devices 520 and 530 and the first and second guide support devices 510 and 540. As such, a pair of upper fixing members 550 and a pair of lower fixing members 550 may be provided to correspond to the latch devices 520 and 530 and the support guide devices 510 and 540.

Through operation of the above described components, the storage container 100 may be connected to the door 30 so as to be moved together with the door 30, or may be separated from the door 30 and be fixed to the refrigerator body 10.

In the case in which the storage container 100 is fixed to the refrigerator body 10, the first and second latch devices 520 and 530 are engaged by the refrigerator body 10, and connection between the connection support device 200 and the door 30 is released. In such a state, the roller devices 300 are supported by the refrigerator body 10, thereby supporting the downward load of the storage container 100.

The case in which the storage container 100 is connected to the door 30 may be further considered based on the following two cases.

In the case in which the storage container 100 is connected to the door 30, the first and second latch devices 520 and 530 provided on the storage container 100 are connected to the door 30 and connection between the storage container 100 and the refrigerator body 10 is released. If the door 30 is opened in this state, the connection support device 200, also provided on the storage container 100, is connected to the door 30, thereby preventing downward movement of the storage container 100. The roller devices 300 are supported by the support bar 35 provided at the lower portion of the door 30, thereby supporting the load of the storage container 100. However, if the door 30 is closed, connection between the connection support device 200 and the door 30 is released, and the roller devices 300 are supported by the refrigerator body 10. Since the storage container 100 may be received in and supported by the refrigerator body 10 even if connection between the connection support device 200 and the door 30 is released, the storage container 100 may be stably located at a fixed position.

Figure 5:
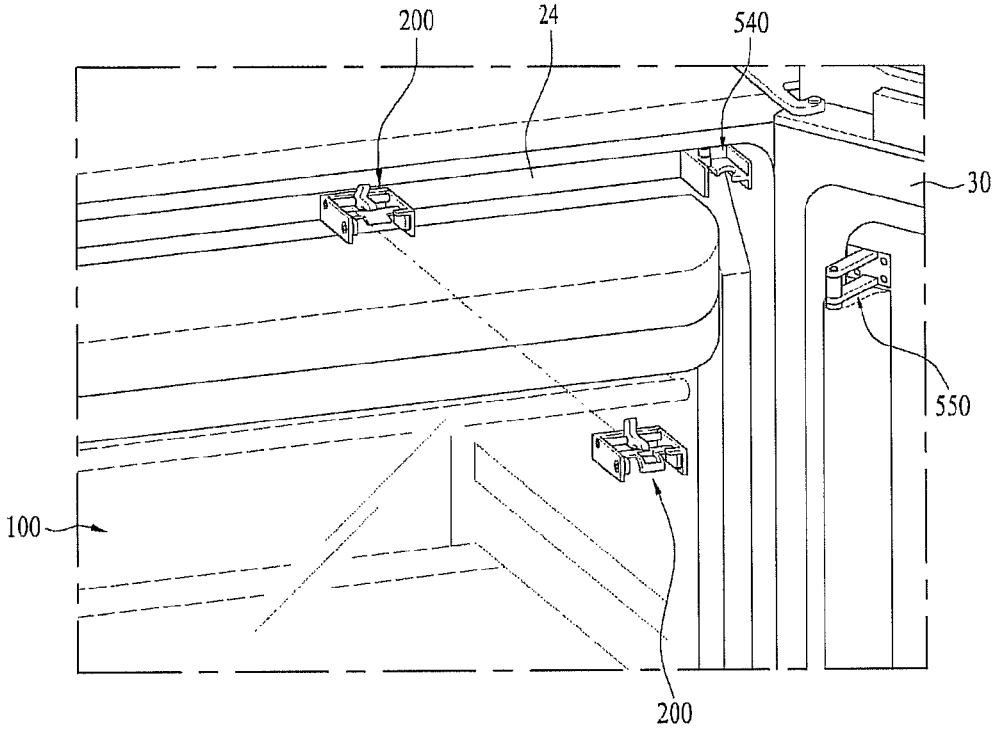
FIGS. 5 and 6 are perspective views of a connection support device provided at the storage container of the refrigerator, in accordance with one embodiment as broadly described herein.

As illustrated in FIG. 5, the connection support device 200 may be located at the top of the storage container 100. Based on whether or not the connection support device 200 comes into contact with the entrance rim 24 of the storage compartment 20, positions of the internal components may be adjusted accordingly.

A detailed configuration and operation of the connection support device 200 will be described hereinafter.

Figure 6:
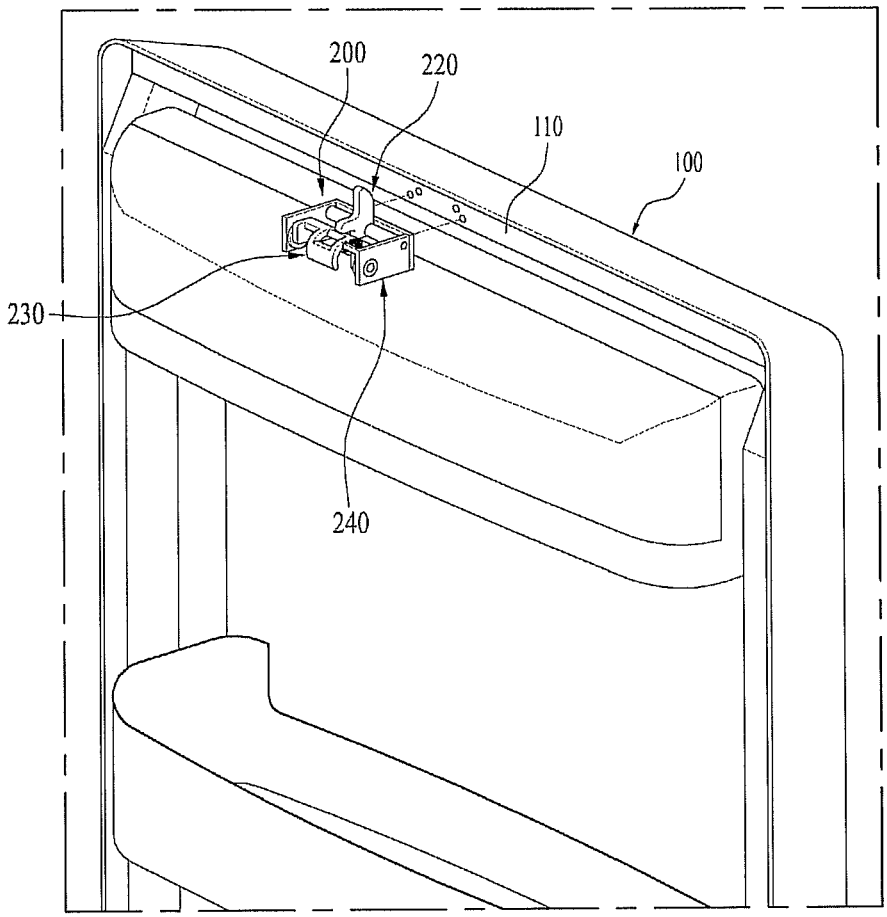

As illustrated in FIG. 6, the connection support device 200 may include a bracket 240 coupled to the frame 110, a pivoting member 220 rotatably provided at the bracket 240, an upper end of the pivoting member 220 being configured to come into contact with an upper portion of the entrance into the storage compartment 20, and a connecting member 230 configured to come into contact with the pivoting member 220, the connecting member 230 being connected to or disconnected from the fixing device 210 provided at the door 30 according to whether or not the connecting member 230 comes into contact with the pivoting member 220.

Figure 7A:
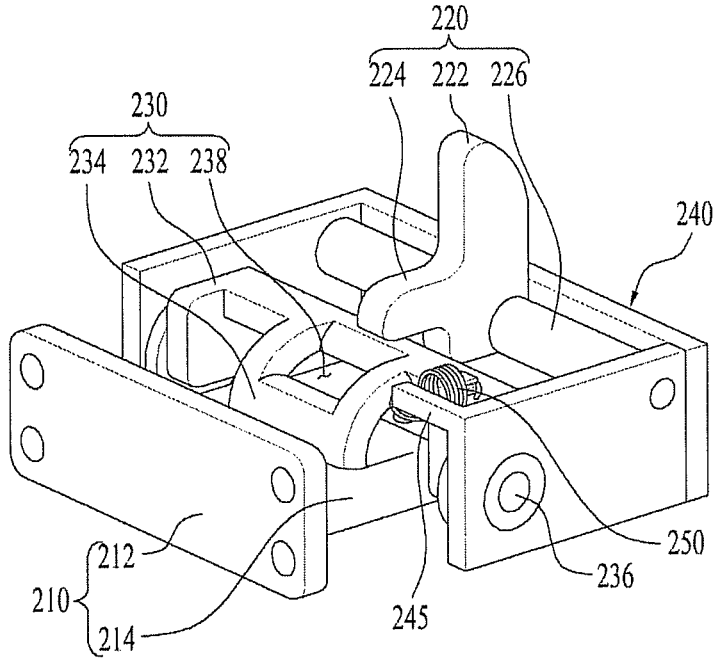
FIGS. 7A-7B are perspective views of the connection support device.
Figure 7B:
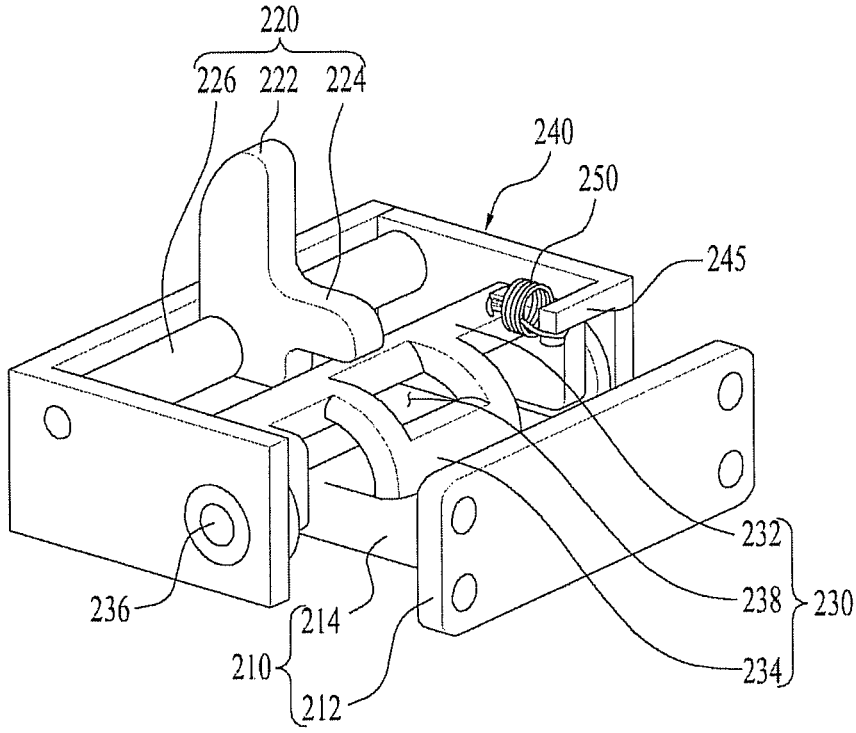
Figure 8:
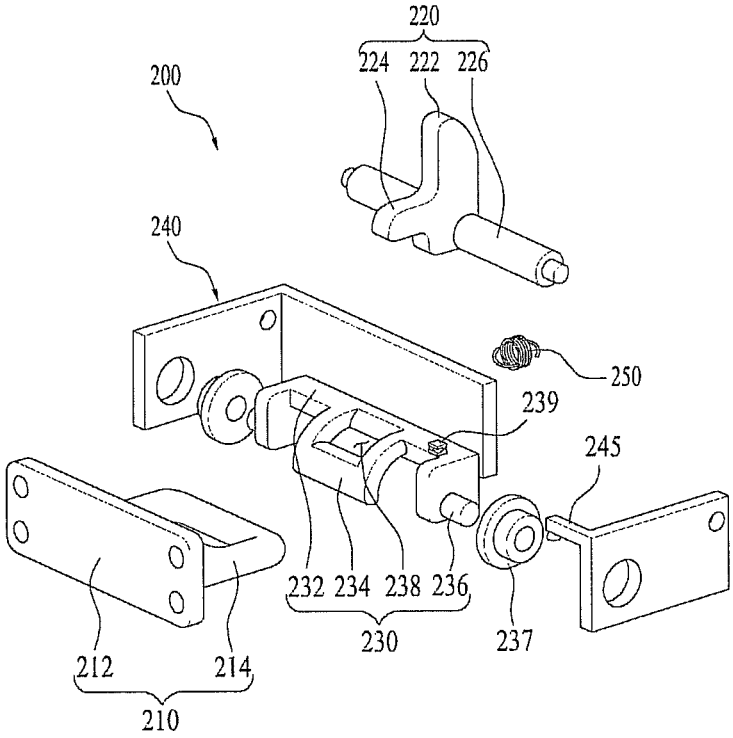
FIG. 8 is an exploded perspective view of the connection support device.

As shown in FIGS. 7A-7B and 8, the connection support device 200 may include the pivoting member 220, the connecting member 230 and the bracket 240. When the storage container 100 is coupled to the refrigerator body 10, the pivoting member 220 is pushed by an upper portion of the front surface of the refrigerator body 10 and rotated. Through rotation of the pivoting member 220, the connecting member 230 is rotated together with the pivoting member 220. The bracket 240 may support both the connecting member 230 and the pivoting member 220, and may be coupled to an upper portion of the storage container 100.

The bracket 240 may have a "U"-shaped form having a predetermined height when viewed from the upper side. A rear wall surface of the bracket 240 may be fastened to the upper portion of the storage container 100 using, for example, a plurality of screws or other fastening mechanism as appropriate.

Pivoting shafts 226 and 236 of the pivoting member 220 and the connecting member 230 are respectively rotatably installed between opposite sidewalls of the U-shaped bracket 240.

The pivoting member 220 may include the pivoting shaft 226 mounted to a left upper portion of the bracket 240 when viewed from the lateral side. The pivoting shaft 226 may include a contact portion 222 and a push portion 224 at a central portion thereof.

When one side of the pivoting member 220 is pushed by the upper portion of the front surface of the refrigerator body 10 causing downward or forward rotation, a portion of the pivoting member 220 pushes the connecting member 230, thereby causing the connecting member 230 to also rotate.

The connecting member 230 may be engaged with the fixing device 210 in a state in which the connecting member 230 is not in a rotated position. The engagement between the connecting member 230 and the fixing device 210 may be released when the connecting member 230 is rotated.

The connection support device 200 may also include an elastic member 250 positioned between the connecting member 230 and a corresponding side of the bracket 240 to return the connecting member 230 to an original position thereof when the pivoting member 220 no longer pushes the connecting member 230.

Although in certain embodiments the elastic member 250 may be a coil spring, other components may be used so long as they provide appropriate elastic force.

Thus, as the connecting member 230 is upwardly rotated by the elastic member 250, the connecting member 230 pushes the pivoting member 220 upward, and the connecting member 230 and the pivoting member 220 are returned to original positions.

The fixing device 210 may include a plate 212 coupled, for example, by screw to an upper portion of the rear surface of the door 30, and a receiving portion 214 integrally formed with the plate 212, the receiving portion 214 taking the form of a "U"-shaped loop horizontally fixed to the plate 212 so as to receive a portion of the connecting member 230. The plate 212 may have a horizontally elongated rectangular form and may be provided near opposite lateral edges thereof with a plurality of holes for receiving a plurality of fasteners.

The receiving portion 214 may extend horizontally from the plate 212, and may be integrally formed with the plate 212. The receiving portion 214 may define an aperture therein that receives the connecting member 230 via rotation thereof.

In certain embodiments, the fixing device 210 may be formed of a high strength material because the fixing device 210 supports a significant portion of the weight of the storage container 100. Therefore, the fixing device 210 may be an integral component formed of a metallic material or reinforced plastic.

As described above, pivoting member 220 includes the pivoting shaft 226 rotatably mounted between opposite side walls of the bracket 240, the contact portion 222 protruding upward from the pivoting shaft 226 so as to come into contact with the entrance of the storage compartment 20, and the push portion 224 extending from the pivoting shaft 226 and connected to the contact portion 222.

When the contact portion 222 comes into contact with the storage compartment 20 and is rotated downward, the push portion 224 is moved along with the contact portion 222, thereby pushing the connecting member 230.

The contact portion 222 and the push portion 224 may be integrally formed to define a substantially right angle therebetween. Both the contact portion 222 and the push portion 224 may be integrally formed with the pivoting shaft 226, or may be rotatably mounted to the pivoting shaft 226.

The contact portion 222 may be positioned substantially vertically at an initial position thereof. When the storage container 100 is inserted into the storage compartment 20, the contact portion 222 is pushed by an inclined surface provided at an upper portion of the entrance of the storage compartment 20, thereby being rotated forward or downward.

The push portion 224 integrally formed with the contact portion 222 is rotated together with the contact portion 222, thereby pushing a depressible portion 232 eccentric to the pivoting shaft 236 so as to enable rotation of the connecting member 230.

The depressible portion 232 of the connecting member 230 may extend in a left-and-right direction between opposite side walls of the bracket 240 and may come into contact with and be pushed by the push portion 224, with the pivoting shafts 236 provided respectively at opposite ends of the depressible portion 232 for rotatable connection to the bracket 240.

Pivoting guide members 237 may be respectively provided at the opposite end of the depressible portion 232 to provide for smooth rotation of the connecting member 230 and serve as a spacer between the depressible portion 232 and the bracket 240. In certain embodiments, the pivoting guide members 237 may take the form of bearings or washers.

The connecting member 230 may also include a hook 234 having curved convex form extending from the depressible portion 232 toward the fixing device 210 so as to be easily caught by or released from the receiving portion 214 of the fixing device 210.

A connecting region between the hook 234 and the depressible portion 232 of the connecting member 230 may be provided with an insertion aperture 238 into which the push portion 224 of the pivoting member 220 may be inserted. The insertion aperture 238 may have a substantially rectangular form and may be located close to the depressible portion 232, rather than being centered on the upwardly convex hook 234.

In certain embodiments, a plurality of connection support devices 200 may be arranged at an upper portion of the storage container 100, or home bar cabinet, so as to be spaced apart from one another by a predetermined distance.

Two (or more) support devices may more effectively prevent leftward and rightward (i.e., lateral) shaking of the storage container 100 as compared to a single connection support device.

One of the sidewalls of the bracket 240 may be provided with a first holding piece 245 which extends inward from the sidewall of the bracket 240 such that one end of the elastic member 250 is caught by the first holding piece 245. A second holding piece 239 may be provided at an upper surface of the depressible portion 232 such that the other end of the elastic member 250 is caught by the second holding piece 239. Accordingly, if the connecting member 230 is upwardly rotated via push operation of the pivoting member 220, the elastic member 250 is elongated to thereby accumulate elastic force therein. Then, if push force applied to the connecting member 230 is removed, the connecting member 230 is pivotally rotated downward by the elastic force of the elastic member 250 and returned to an original position thereof. Through this operation of the connecting member 230, the pivoting member 220 may be returned to an original position thereof.

Figure 9:
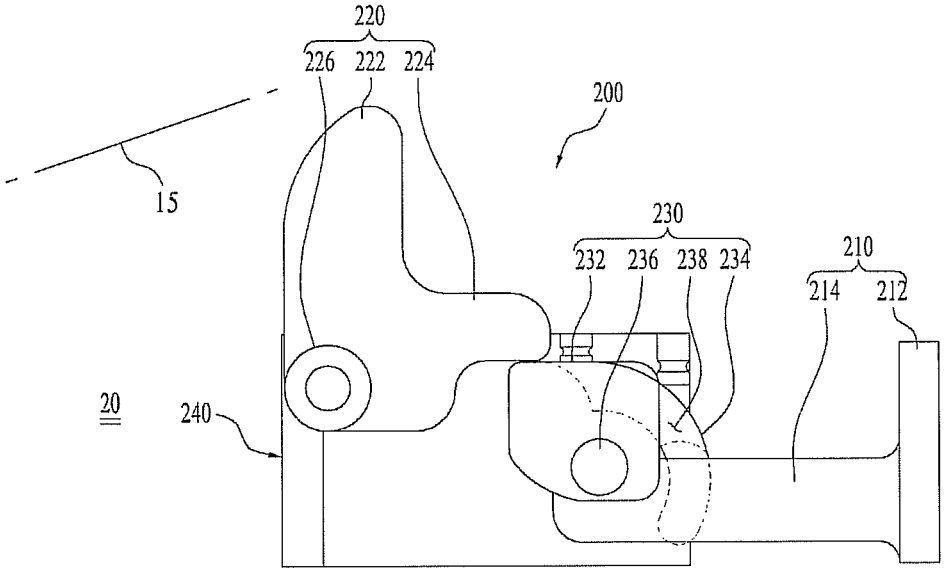
FIG. 9 is a side view of the connection support device connected to a fixing device of the door.

As illustrated in FIG. 9, in a state in which the contact portion 222 of the pivoting member 220 does not come into contact with an inclined surface 15 provided at the entrance of the storage compartment 20, the contact portion 222 is substantially vertically oriented and the push portion 224 is substantially horizontally oriented.

The depressible portion 232 of the connecting member 230 may come into contact with the push portion 224, or may be spaced apart from the push portion 224. In this case, since the push portion 224 does not actually push the depressible portion 232, even though the push portion 224 does come into contact with the depressible portion 232, the push portion 224 may remain horizontally oriented. While the push portion 224 remains horizontally oriented, an end of the hook 234 is received in and engaged by the receiving portion 214 of the fixing device 210, thus connecting the connection support device 200 to the fixing device 210, and connecting the storage container 100, to which the connection support device 200 is mounted, and the door 30, to which the fixing part 210 is mounted. If the door 30 is rotated in the above described state, the storage container 100 may be moved together with the door 30.

Figure 10:
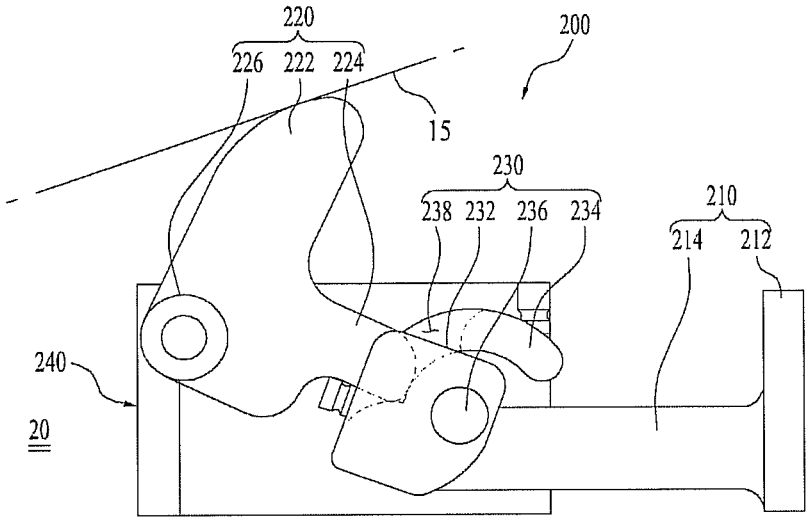
FIG. 10 is a side view of the connection support device separated from the fixing device of the door.

As illustrated in FIG. 10, if the contact portion 222 of the pivoting member 220 comes into contact with the inclined surface 15 provided at the entrance of the storage compartment 20 and is pushed forward, the entire pivoting member 220 is rotated forward or downward, inserting the push portion 224 into the insertion aperture 238 while pushing the depressible portion 232 of the connecting member 230. When the depressible portion 232 is pushed, the depressible portion 232 is rotated rearward or upward, thereby causing the hook 234 to be rotated upward and separated from the receiving portion 214 of the fixing device 210, thus releasing connection between the connection support device 200 and the fixing device 210, and releasing the storage container 100, to which the connection support device 200 is mounted, from the door 30, to which the fixing device 210 is mounted. Accordingly, in the case in which a position of the storage container 100 is maintained at the entrance of the storage compartment 20 and the door 30 is rotated, the storage container 100 does not move together with the door 30, and only the door 30 rotates.

Figure 11:
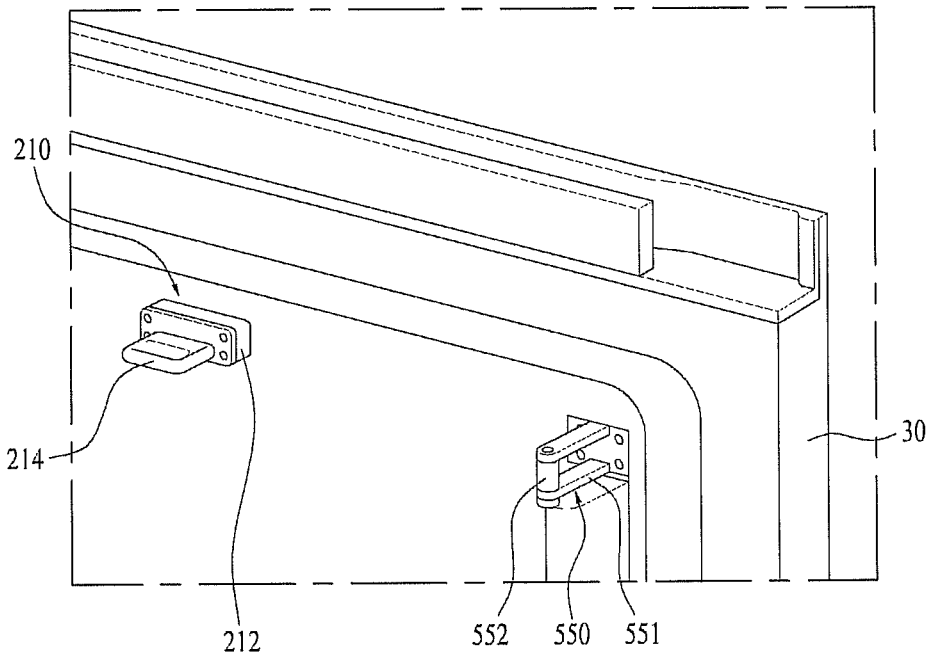
FIG. 11 is a perspective view of the fixing device of the door and a fixing member.

As illustrated in FIGS. 4 and 11, the fixing device 210 may be located at the upper portion of the rear surface of the door 30, and, as shown in FIGS. 7-10, may include the plate 212 mounted to the rear surface of the door 30 and the receiving portion 214 extending outward from the plate 212.

As previously described, the fixing member 550 may be provided at a lateral portion of the rear surface of the door 30 so as to be inserted into and engaged by the latch device 530. As shown in FIG. 11, the fixing member 550 may include legs 551 extending from the rear surface of the door 30 and a fixing pin 552 disposed at distal ends of the legs 551 so as to be caught by the latch device 530.

A connection support device 1200 in accordance with another embodiment will be described with reference to FIGS. 12 to 14.

The connection support device 1200 may include a connecting member 1230 including a pivoting shaft 1236 rotatably coupled to a bracket 1240, a hook 1234 extending from the pivoting shaft 1236 so as to be selectively engaged with a fixing device 1210, and a depressible portion 1232 extending from the pivoting shaft 1236 in an opposite direction of the hook 1234, the depressible portion 1232 being adapted to be pushed by a pivoting member 1220.

Similar to the above described first embodiment, in addition to the connecting member 1230 including the depressible portion 1232 and the hook 1234 which are integrally formed with each other and are rotatable about the pivoting shaft 1236, the connection support device 1200 in accordance with this embodiment may also include the pivoting member 1220 including a contact portion 1222 and a push portion 1224, which are integrally formed with each other and are rotatable about a pivoting shaft 1226, and the bracket 1240, to which the pivoting shafts 1226 and 1236 of the pivoting member 1220 and the connecting member 1230 are mounted. Also, similar to the first embodiment, the fixing device 1210 is configured to be engaged with the connecting member 1230.

Figure 12:
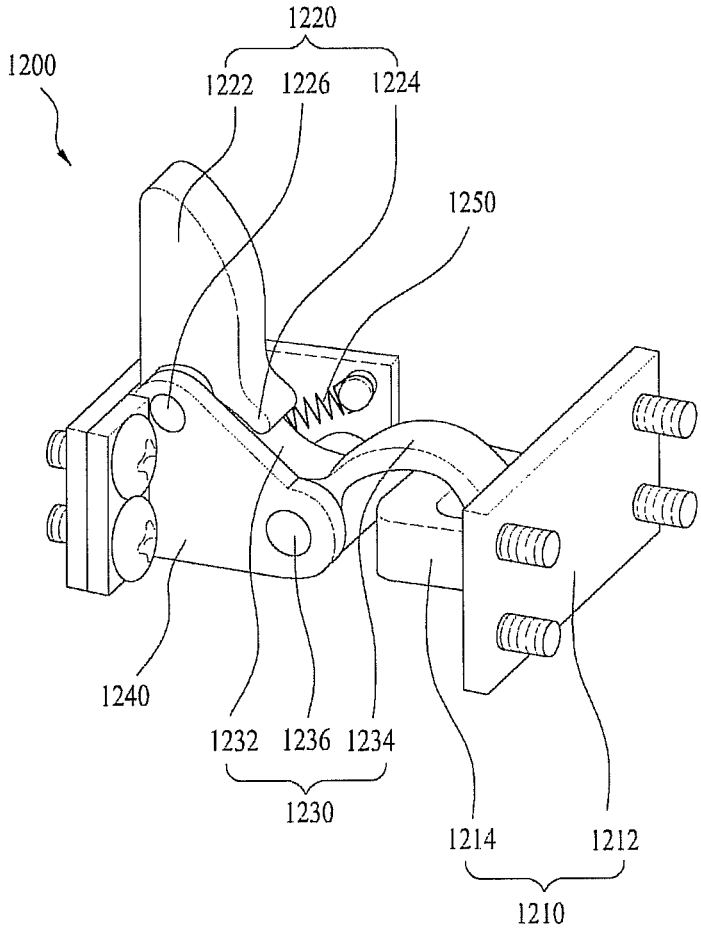
FIG. 12 is a perspective view of another embodiment of the connection support device.
Figure 13:
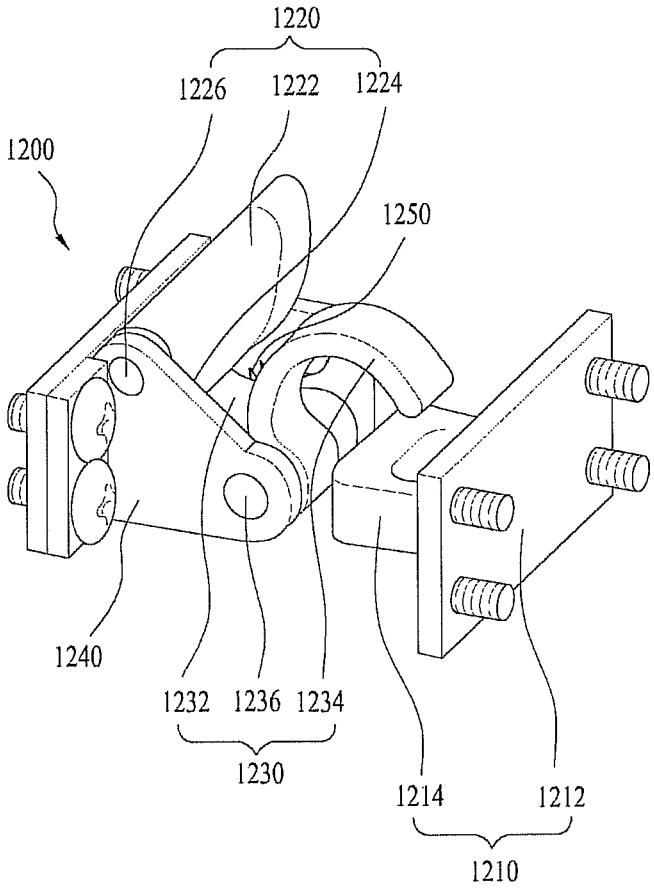
FIG. 13 is a perspective view of a locking hook of the connection support device shown in FIG. 12.
Figure 14:
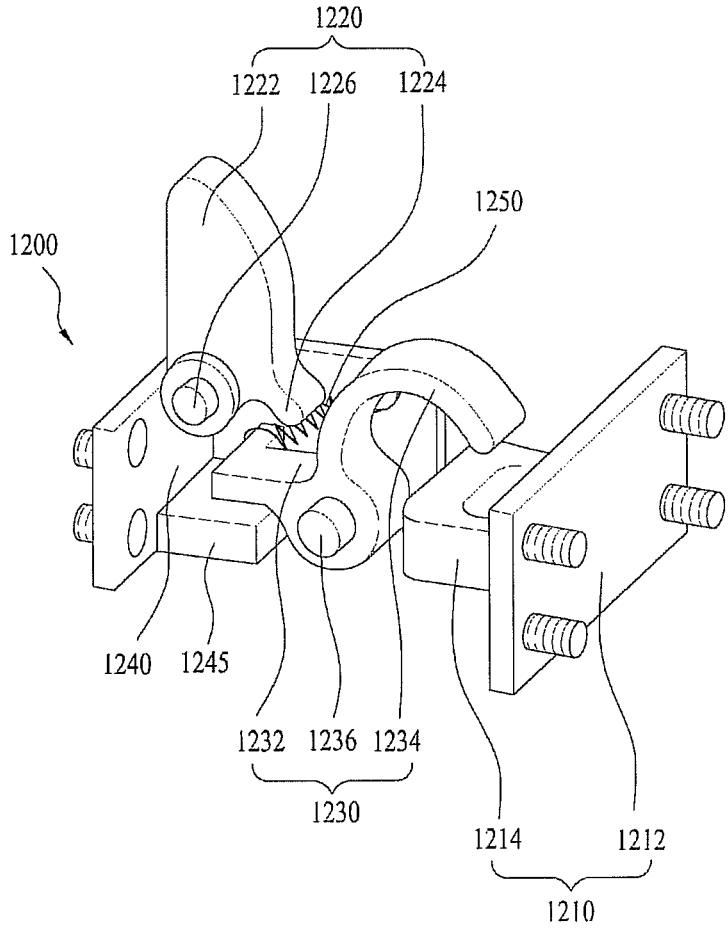
FIG. 14 is a perspective view of the connection support device of FIG. 12, in which a lateral portion of a bracket is omitted to show a rotation limiter of the connection support device.

However, in the connecting member 1230 shown in FIGS. 12-14, the depressible portion 1232 and the hook 1234 may have a predetermined angle formed therebetween with respect to the pivoting shaft 1236. Additionally, the contact portion 1222 and the push portion 1224 of the pivoting member 1220 may respectively extend upward and forward from the pivoting shaft 1226 to form an obtuse angle therebetween, rather than a substantially right angle.

As illustrated in FIG. 14, a spring 1250 may be connected between a protrusion formed at an inner surface of a sidewall of the bracket 1240 and a protrusion laterally extending from an end of the depressible portion 1232 of the connecting member 1230.

The connection support device 1200 may also include a rotation limiter 1245 fixed to a lower portion of the bracket 1240 to limit a pivoting angle of the depressible portion 1232. The rotation limiter 1245 may be fixed to a portion of the bracket 1240 below the pivoting member 1220 to limit a pivoting angle of the connecting member 1230 such that the depressible portion 1232 is pivotally rotatable only to a substantially horizontal position thereof.

Operation of the connection support device 1200 according to this embodiment is similar to that of the first embodiment, however there are differences as follows.

If the connection support device 1200 is pushed by the inclined surface 15 formed at the upper portion of the refrigerating compartment 20 and rotated, the various components of the connection support device 1200 are positioned as illustrated in FIG. 13. Then, if the storage container 100 is coupled to the door 30 and is removed from the refrigerating compartment 20, the various components of the connection support device 1200 are positioned as illustrated in FIG. 12.

In this case, as a lower surface of the hook 1234 of the connecting member 1230 comes into contact with an upper surface of a receiving portion 1214 of the fixing part 1210 by the weight of the storage container 100, the connection support device 1200 acts to support the storage container 100. Thus, the storage container 100 is suspended from the fixing device 1210 in a similar manner to that of a hanger on a rod.

Meanwhile, if the door 30 moves to close the refrigerating compartment 20, the pivoting member 1220 comes into contact with the upper portion of the front surface of the refrigerating compartment 20, thereby being pushed forward. As the entire pivoting member 1220 is rotated downward, the push portion 1224 pushes the depressible portion 1232 of the connecting member 1230, and the connecting member 1230 is again rotated to the position as illustrated in FIG. 13, thereby being spaced apart from the fixing device 1210. In this way, connection between the connecting member 1230 and the fixing device 1210 is released. As illustrated in FIG. 14, the rotation limiter 1245 limits rotation of the connecting member 1230.

Figure 15:
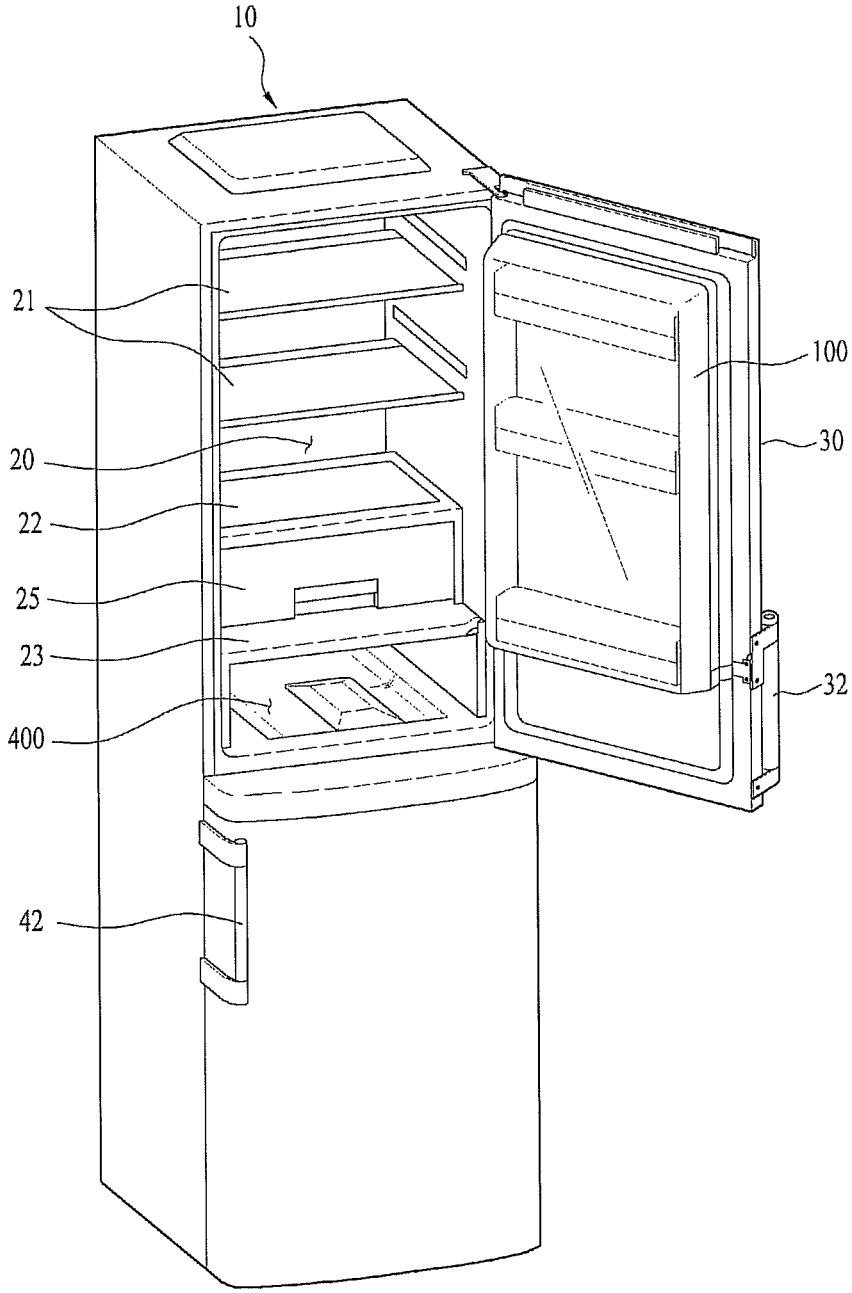
FIG. 15 is a perspective view of a drawer of an auxiliary storage compartment removed from the refrigerator shown in FIGS. 1 and 2.

As illustrated in FIG. 15 and discussed above, the refrigerator as embodied and broadly described herein may include the refrigerator body 10, the storage compartment 20 defined in the refrigerator body 10, the doors 30 and 40 including handles 32 and 42 and rotatably coupled to the refrigerator body 10 via the hinge 13, the storage container 100 configured to be selectively mounted to the door 30 or the refrigerator body 10, one or more first shelves 21 and 22 detachably and adjustably installed in the storage compartment 20, a second shelf 23 arranged below the first shelves 21 and 22 to selectively support the storage container 100, the second shelf 23 having a front to rear length close to a corresponding length from a rear surface to the front opening of the refrigerating compartment 20 in order to support the storage container 100 when the storage container 100 is mounted to the front surface of the refrigerating compartment 20. As such, the storage container 100 may be selectively positioned on the second shelf 23 when inserted into the front opening of the refrigerating compartment 20.

The embodiment shown in FIG. 15 may also include an auxiliary storage compartment 400 defined within the refrigerator body 10 independent of the storage compartment 20. The auxiliary storage compartment 400 may include the drawer 26, which may be removably inserted between the second shelf 23 and a bottom surface of the auxiliary storage compartment 400. The drawer 26 may be pulled outward from the auxiliary storage compartment 400 so as to remove food from the drawer 26 when the door 30 is open, even when the storage container 100 is coupled to the front surface of the refrigerating compartment 20.

For example, a vegetable chamber in the form of a drawer may be provided in a lower region of the refrigerating compartment. Thus, if a front surface of the auxiliary storage compartment 400 takes the form of a drawer, storage efficiency may be enhanced.

The refrigerator may also include the drawer 25 removably disposed between the second shelf 23 and the first shelf 22. The drawer 25 may be removably placed on the second shelf 23 and located behind the storage container 100 when the storage container 100 is coupled to the refrigerator body 10. Hereinafter, the drawer 25 located below the first shelf 22 will be referred to as a first drawer, and the drawer 26 placed below the second shelf 23 will be referred to as a second drawer.

The first shelf 22 may have a front to rear length that is less than that of the second shelf 23, as the first shelf 22 is located behind the storage container 100 when the storage container 100 is coupled to the refrigerator body 10.

On the other hand, since the second shelf 23 is configured such that a front region of the upper surface of the second shelf 23 may selectively support the storage container 100, the second shelf 23 may extend to as close to the front opening of the refrigerating compartment 20 as possible, close to the rear surface of the door 30.

Accordingly, the first shelf 22 may have a front to rear length that is less than that of the second shelf 23.

Figure 16A:
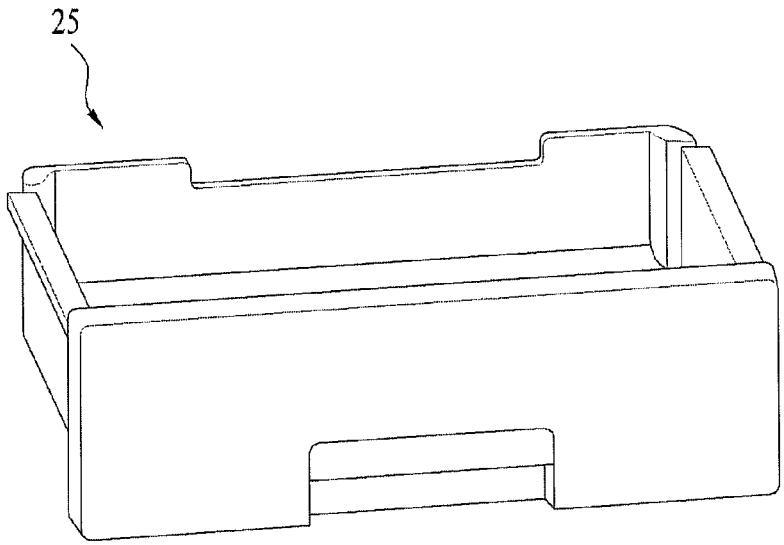
FIGS. 16A-16B are perspective views of two drawers provided in the refrigerator shown in FIGS. 1 and 2.
Figure 16B:
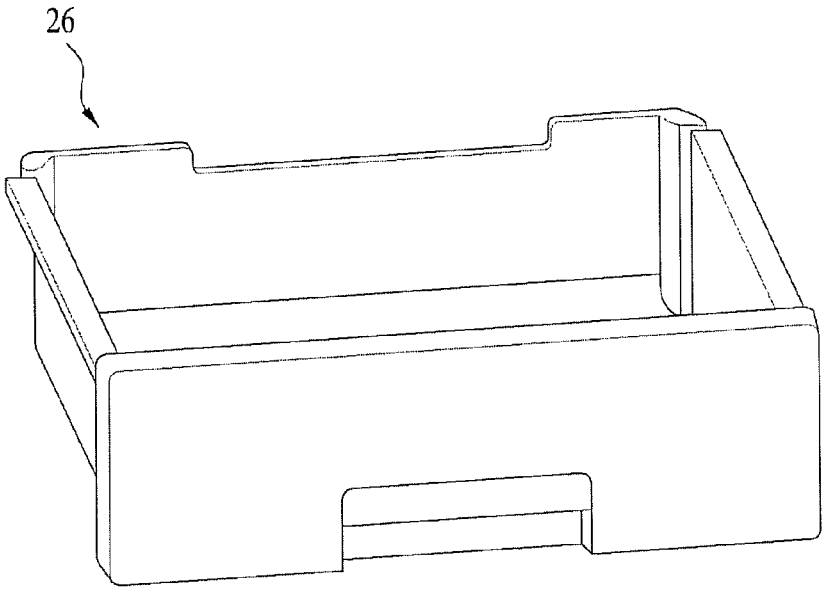
Figure 17:
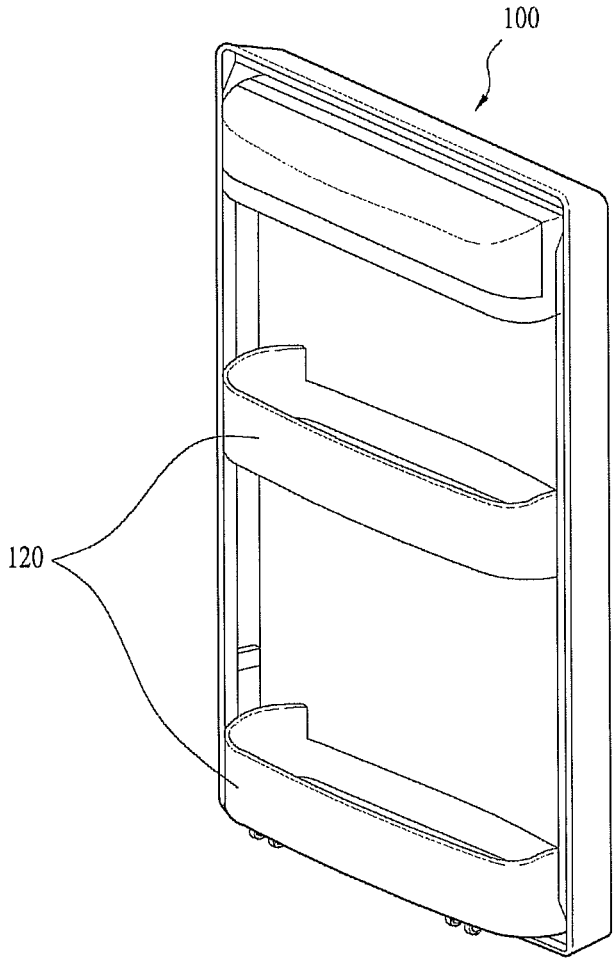
FIG. 17 is a perspective view of the storage container separated from the door.
Figure 18:
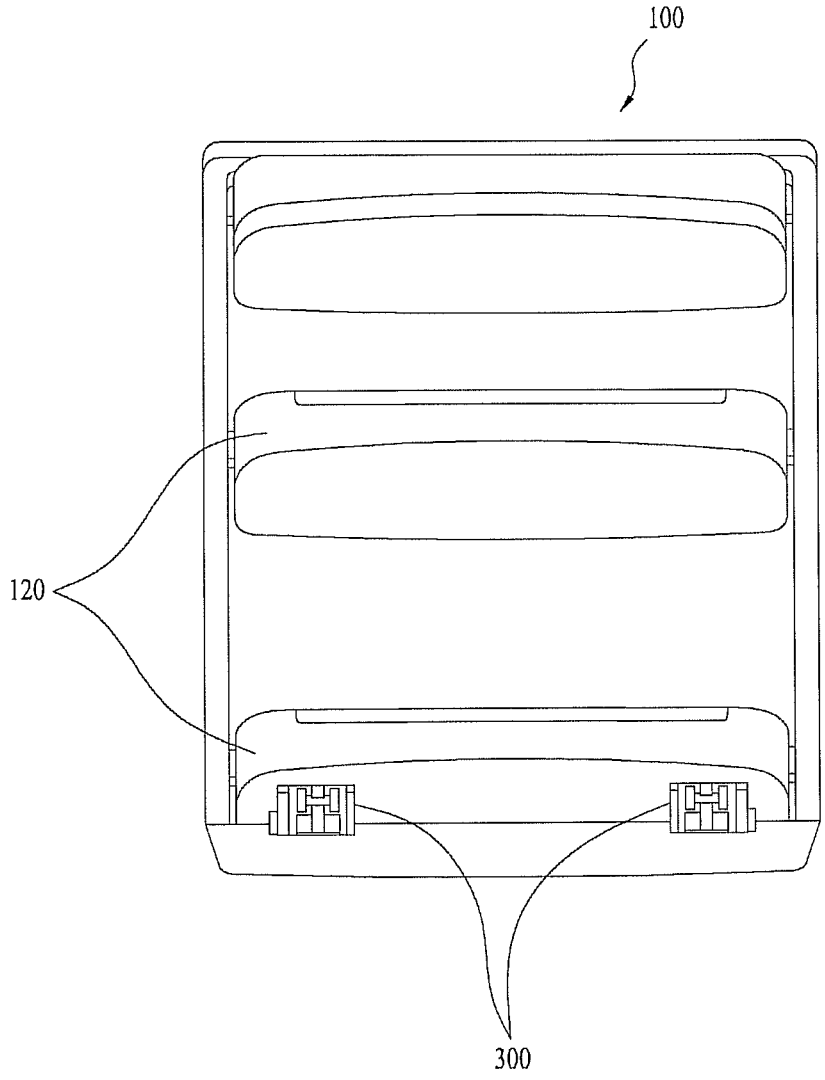
FIG. 18 is a perspective view of a pair of roller devices mounted to the storage container shown in FIG. 17.

As illustrated in FIGS. 16A-16B, the first drawer 25 below the first shelf 22 and the second drawer 26 below the second shelf 23 may be similarly configured such that a front to rear length of the second drawer 26 is greater than a front to rear length of the first drawer 25. In addition, a surface of the first drawer 25 positioned near the door 30 may vertically coincide with an end surface of the first shelf 22 positioned near the door 30, and a surface of the second drawer 26 positioned near the door 30 may vertically coincide with an end surface of the second shelf 23 positioned near the door 30. As such, the second shelf 23 may partition the upper storage compartment 20 from the lower auxiliary storage compartment 400.

As illustrated in FIGS. 17, 18 and 19A-19B, the pair of roller devices 300 may be provided at the lower portion of the storage container 100 to selectively support the storage container 100 with respect to the refrigerator body 10 and the door 30. The roller devices 300 may be supported by the front region of the upper surface of the second shelf 23 when the storage container 100 is mounted to the refrigerator body 10.

The roller devices 300 may include a plurality of rollers 310 and 320 such that the rollers 310 and 320 selectively support the storage container 100 with respect to the upper surface of the second shelf 23 placed in the refrigerator body 10 and the support bar 35 protruding from the lower portion of the rear surface of the door 30.

In the embodiment illustrated in FIG. 2, the storage container 100 is not configured to completely cover the front opening of the refrigerating compartment 20, but rather, is configured to cover a portion of the front opening above the shelf 23 placed on the drawer 26 arranged in the lowermost region of the refrigerating compartment 20. In this case, if the storage container 100 is mounted to the refrigerator body 10, the single roller 320 is supported by the front region of the upper surface of the second shelf 23 placed on the lowermost second drawer 26.

The plurality of shelves 21 and 22 mounted in the refrigerating compartment 20 and the drawer 25 above the lowermost drawer 26 may have shapes and dimensions to allow the storage container 100 to be mounted in the refrigerator body 10 to a predetermined depth.

As noted above, in alternative embodiments the refrigerator may be configured such that the storage container 100 completely closes the front opening of the refrigerating compartment 20. In this case, a vertical height and horizontal width of the storage container 100 may be close to a corresponding height and width of the front opening of the refrigerating compartment 20 to allow the storage container 100 to be positioned in the opening. If two drawers are provided in such a refrigerating compartment 20, the lowermost drawer 26 may have shapes and dimensions suitable to be inwardly located so as not to interfere with the storage container 100, similar to the drawer 25. In this case, the roller devices 300 come into contact with the bottom surface of the refrigerating compartment 20, rather than the shelf 23 above the lowermost drawer 26.

As illustrated in FIGS. 19-22, the roller device 300 may include first rollers 310 configured to be selectively supported by the door 30, a second roller 320 configured to be selectively supported by the refrigerator body 10, and a roller bracket 330 to which the first rollers 310 and the second roller 320 are rotatably mounted, the roller bracket 330 being fixed to the storage container 100.

The roller bracket 330 may include an upper bracket 340 configured to cover the rollers 310 and 320, and a lower bracket 350 coupled to the storage container 100. The second roller 320 may be rotatably mounted to one side of the upper bracket 340, and the first rollers 310 may be rotatably mounted to opposite sides of the lower bracket 350. To this end, the upper bracket 340 and the lower bracket 350 may include fastening holes 345 and 355 into which the second roller 320 and the first rollers 310 may be rotatably inserted.

The first rollers 310 are supported by the door 30 and therefore, rotating shafts of the first rollers 310 may be located in front of the second roller 320 (in the exemplary view shown in FIG. 2), as a region of the door 30 where the rollers 310 support the storage container 100 is located forward (i.e. toward the door 30) of a bottom surface region of the refrigerator body 10 where the roller 320 supports the storage container 100.

The first rollers 310 and the second roller 320 may be installed at different heights. That is, the region of the door 30 where the first rollers 310 support the storage container 100 and the bottom surface region of the refrigerator body 10 where the second roller 320 supports the storage container 100 are located at different heights. Thus, reliability in the movement of the storage container 100 when the storage container 100 is transferred between the refrigerator body 10 and the door 30 so as to be selectively supported by the refrigerator body 10 and the door 30 may be achieved.

In particular, the first rollers 310 may be installed higher than the second roller 320. As a result of the first rollers 310 being mounted higher than the second roller 320, the roller device 300 including the roller bracket 330 may achieve greater durability as well as enhanced reliability in the attachment/detachment operation of the storage container 100.

The door 30 may include the inwardly protruding support bar 35 at a lower portion of the rear surface thereof to support the first rollers 310. This provides a planar surface on which the first rollers 310 may be seated and freely rotate, since the first rollers 310 vertically support the storage container 100 in a state in which the storage container 100 comes into close contact with the door 30. For this reason, the support bar 35 may horizontally protrude from the lower portion of the rear surface of the door 30, i.e. inward of the storage compartment 20 by a predetermined length, in consideration of a height thereof relative to the first rollers 310. The protruding length of the support bar 35 may be based on a position of the support bar 35 relative to the storage container 100 mounted to the door 30 as well as interference between the support bar 35 and the storage container 100.

Referring again to FIG. 4, the support bar 35 may be inclined, gradually rising at a predetermined angle as it approaches the inner surface of the door 30, and thus when the first rollers 310 come into contact with and are supported by the support bar 35, the storage container 100 may be slightly lifted.

The pair of roller devices 300 may be symmetrically arranged at the lower portion of the storage container 100. The roller devices 300 may vertically support the storage container 100, and also facilitate horizontal alignment the storage container 100. For this reason, it may be beneficial to provide the pair of roller devices 300 at the lower portion of the storage container 100, separated by a predetermined interval, than to provide a single roller device 300 at the center of the lower portion of the storage container 100.

Figure 19A:
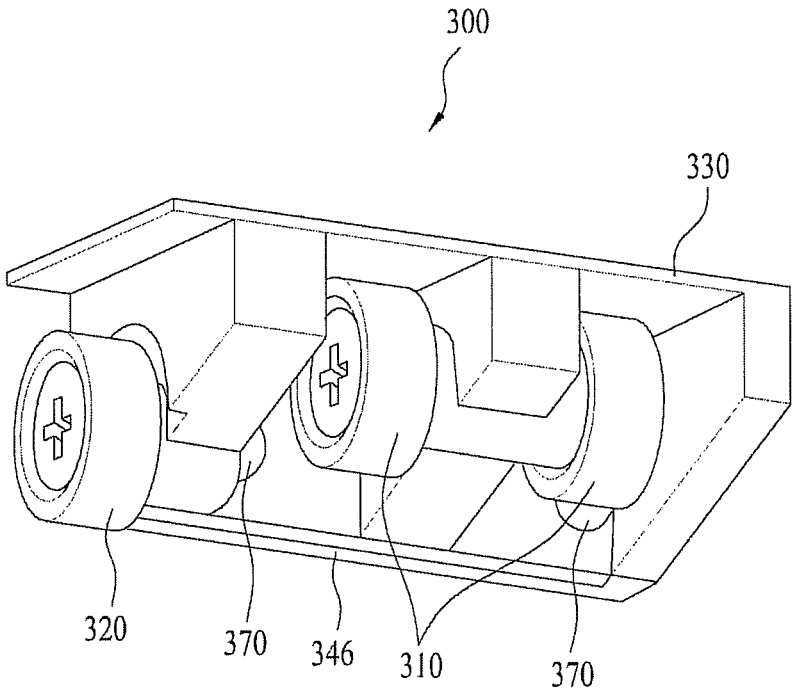
FIGS. 19A-19B are perspective views the roller device shown in FIG. 18.
Figure 19B:
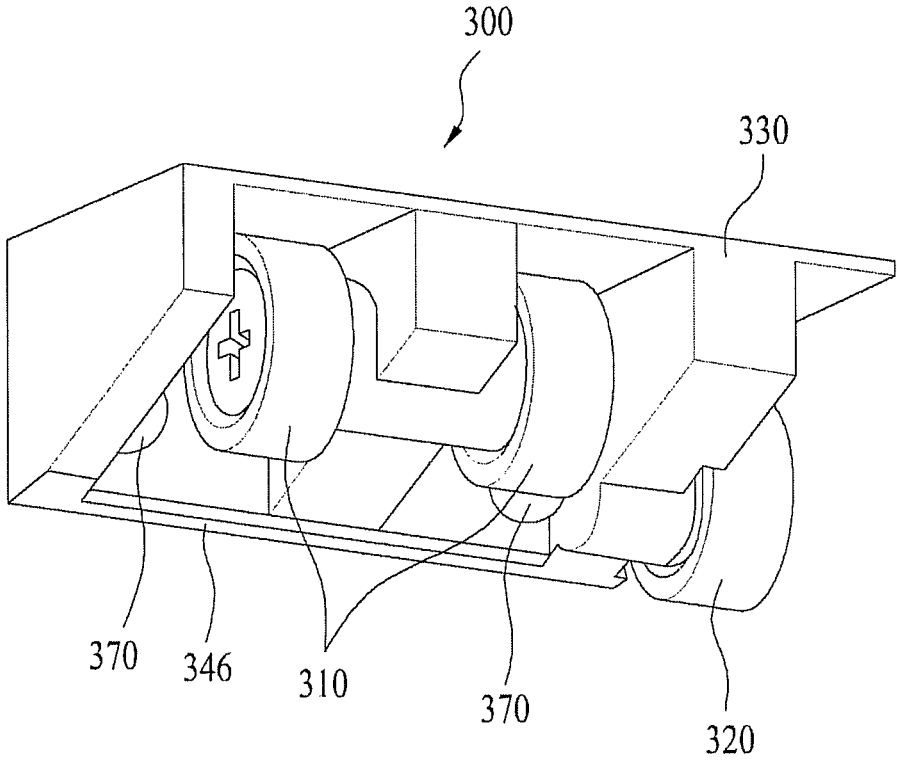

As illustrated in FIGS. 19A-19B, the pair of first rollers 310 may be arranged at the center of the roller bracket 330, and the single second roller 320 may be mounted to a lateral portion of the roller bracket 330. The pair of roller devices 300 may be arranged so that the left roller device 300 and the right roller device 300 may be symmetrical to each other.

Figure 20:
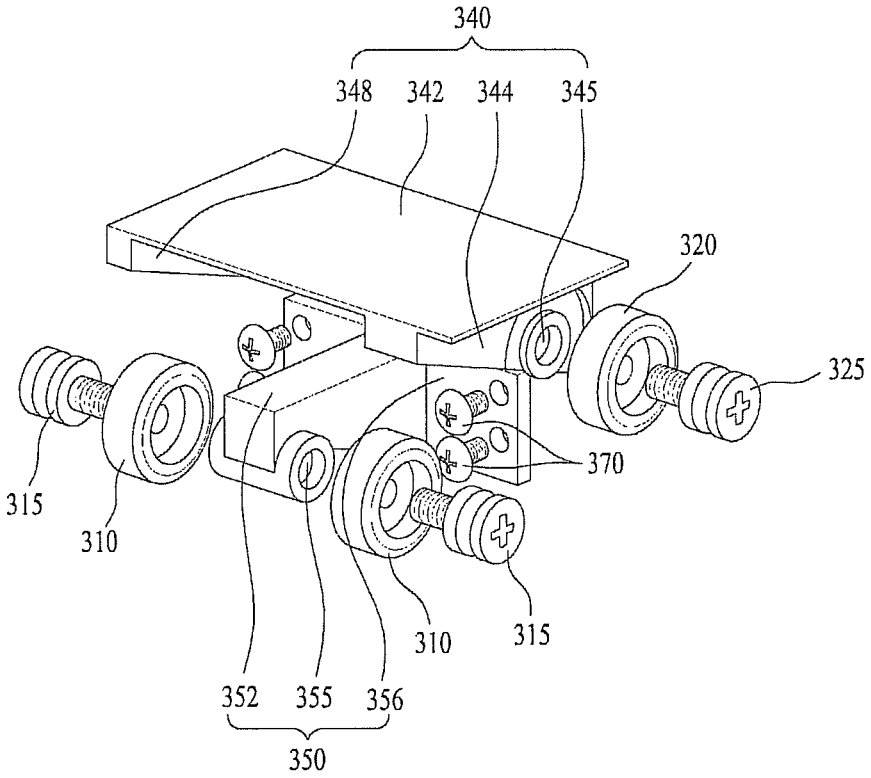
FIG. 20 is an exploded perspective view of the roller device shown in FIGS. 19A-19B.

Hereinafter, a configuration of the roller devices 300 according to an exemplary embodiment will be described in more detail with reference to FIG. 20 which, for purposes of discussion, provides an exploded perspective view of the right roller device 300 shown in FIG. 19B.

As described above, the roller bracket 330 of the roller device 300 may include the upper bracket 340 and the lower bracket 350. The upper bracket 340 may be formed by integrating two plates with each other and may have an "L"-shaped form when viewed from the lateral side. A roller mount 344 and fastening hole 345, to which the second roller 320 may be coupled by a fastener 325, may be integrally formed at a right side of the upper bracket 340. The two plates of the upper bracket 340 may include a cover plate 342 configured to define an upper surface of the roller device 300 and a mounting plate 346 (see FIGS. 19A-19B) extending vertically downward from the cover plate 342.

The roller device 300 is provided at a left side thereof with a sidewall 348. The sidewall 348 may be integrally formed with the upper bracket 340 so as to cover the first rollers 310 at the left side thereof.

The first rollers 310 may be installed in the lower bracket 350. The lower bracket 350 may have a "T"-shaped form when viewed from the upper side. The lower bracket 350 may include a mounting plate 356 configured to be coupled to the storage container 100, and a roller mount 352 and fastening holes 355 that allow the first rollers 310 to be symmetrically coupled to the roller mount 352 by fasteners 315. The mounting plate 356 may also include a plurality of fastening holes so as to be mounted to the storage container 100 using a plurality of screws 370.

The fastening hole 345 formed in the roller mount 344 of the upper bracket 340 may be located rearward and downward of the fastening holes 355 formed in the roller mount 352 of the lower bracket 350.

Arrangement of the fastening holes 345 and 355 may be determined taking into consideration that the first rollers 310 and the second roller 320 are respectively supported by the bottom surface of the storage compartment 20 and the support bar 35 of the door 30.

Additionally, the mounting plate 346 of the upper bracket 340 may include fastening holes corresponding to those formed in the mounting plate 356 such that fasteners 370 are fastened through fastening holes of the lower bracket 350 and the fastening holes of the upper bracket 340.

Although in the above described embodiment a roller assembly includes a pair of roller devices 300, only one roller device 300 may be provided as occasion demands. If only one roller device is provided, a pair of second rollers 320 may be symmetrically provided at opposite sides of the bracket 330 or the upper bracket 340, rather than the single second roller 320 at one side of the bracket 330 or the upper bracket 340.

Hereinafter, operation of the roller devices 300 will be described with reference to FIGS. 21 and 22.

Figure 21:
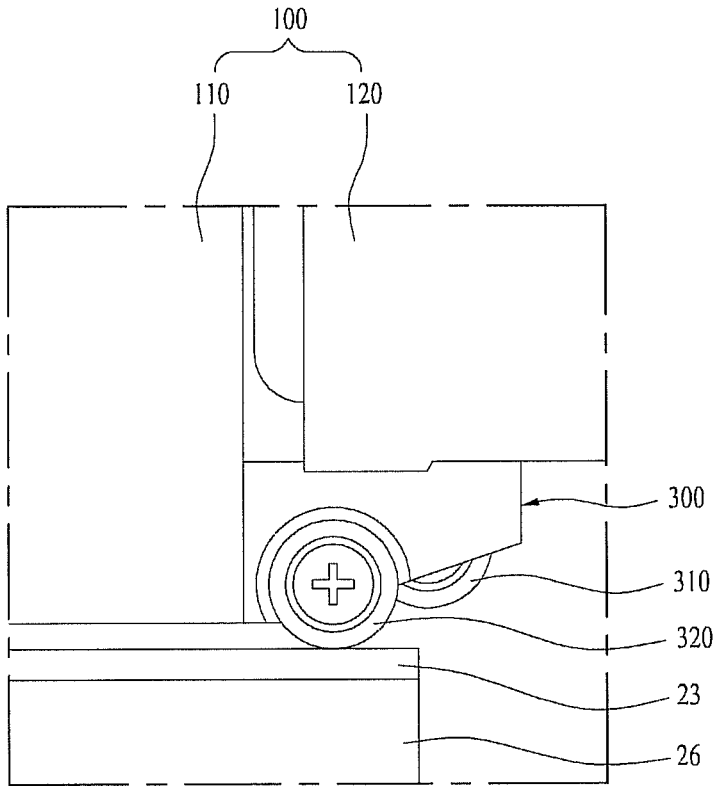
FIG. 21 is a partial side sectional view of the roller device coupled to and supported by a refrigerator body.
Figure 22:
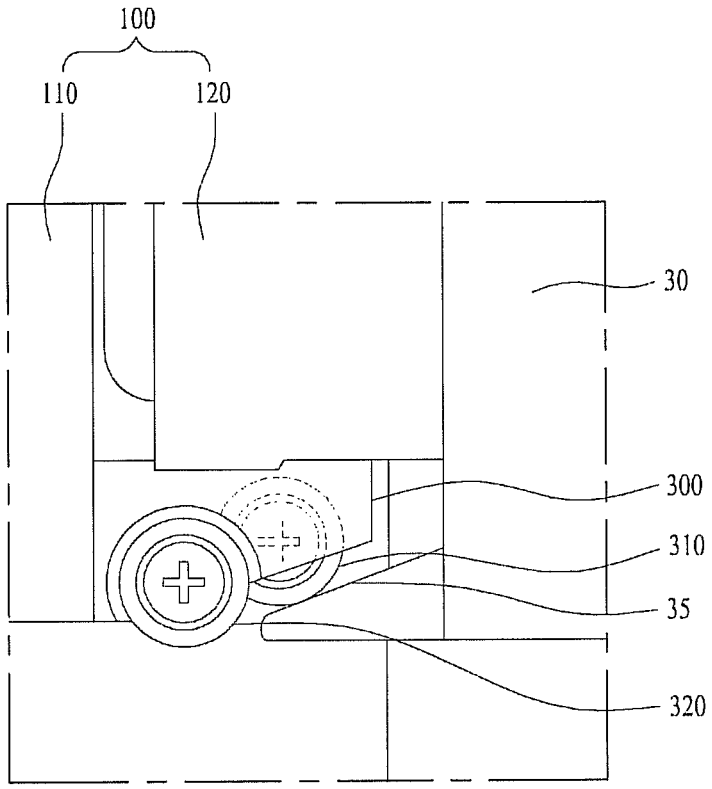
FIG. 22 is a partial side sectional view of the roller device in contact with a roller support bar of the door.

FIG. 21 is a partial side sectional view illustrating a state in which the storage container 100 is coupled to and supported by the refrigerator body, and FIG. 22 is a partial side sectional view illustrating a state in which the roller device 300 comes into contact with the support bar 35 formed at the rear surface of the door 30.

As illustrated in FIG. 21, once the storage container 100 has been coupled to the refrigerator body 10, the second roller 320 of the roller device 300 conies into contact with and is supported by the upper surface of the shelf 23 that covers the lowermost drawer 26 within the refrigerating compartment 20 of the refrigerator body 10.

In this case, since the first roller 310 is located at the right side of the second roller 320 and at a higher position, the first roller 310 is suspended and does not come into contact with the upper surface of the shelf 23.

In the arrangement shown in FIG. 21, the door 30 is open and thus the door 30 is not illustrated. However, if the door 30 were closed, the first roller 310 of the roller device 300 would contact the support bar 35 formed at the rear surface of the door 30, providing support for both the first rollers 310 and the second 320 rollers.

As illustrated in FIG. 22, once the storage container 100 has been coupled to the door 30, the first roller 310 of the roller device 300 comes into contact with and is supported by the support bar 35 formed at the rear surface of the door 30. In this case, since the second roller 320 is located at the left side of the first roller 310, the second roller 320 is suspended, rather than coming into contact with the support bar 35.

Thus, when the storage container 100 is mounted to the refrigerator body 10 or to the door 30, the roller device 300 may facilitate support of the storage container 100 by the support bar 35 of the door 30 or in the refrigerator body 10.

Additionally, in the case in which the storage container 100 is mounted to the door 30 and the door 30 rotates, the roller device 300 may guide movement of the storage container 100 toward or away from the refrigerator body 10 without great friction.

Figure 23:
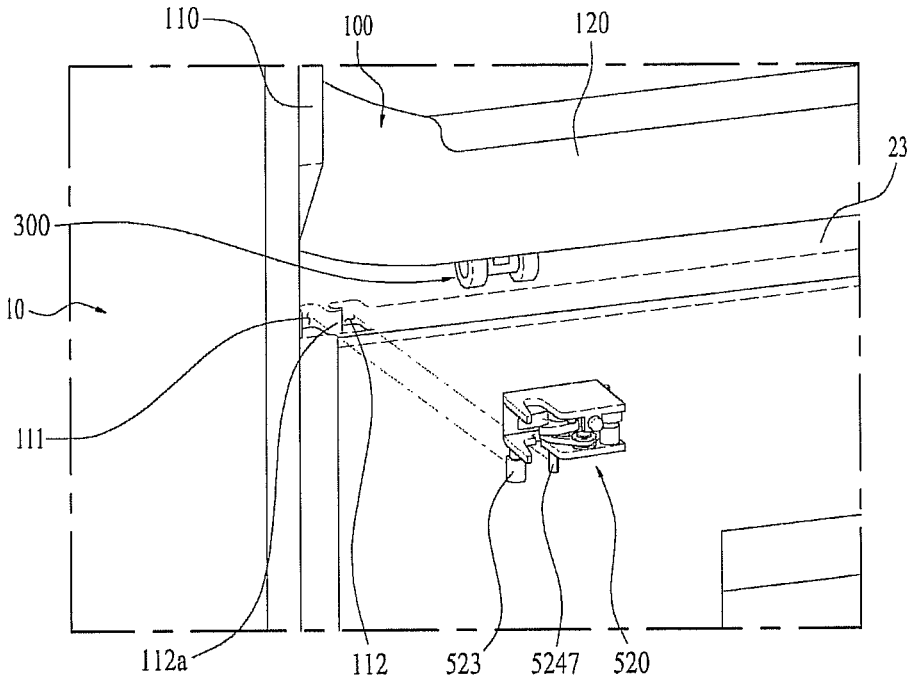
FIG. 23 is a perspective view of a first latch device coupled to the storage container of the refrigerator, in accordance with an embodiment as broadly described herein.
Figure 26:
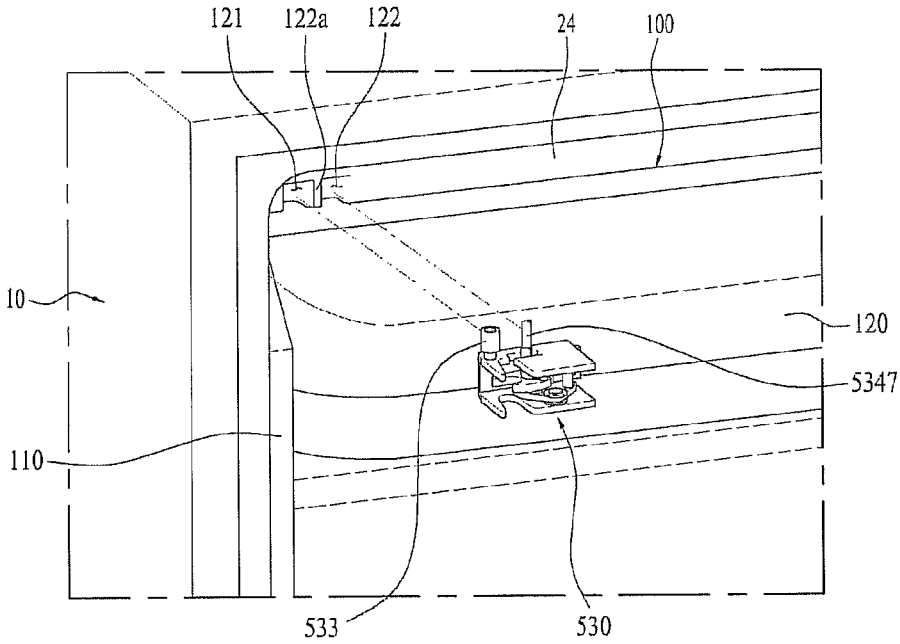
FIG. 26 is a perspective view of a second latch device coupled to the storage container of the refrigerator, in accordance with an embodiment as broadly described herein.

FIG. 23 illustrates the first latch device 520 provided at the lower portion of the frame 110, and FIG. 26 illustrates the second latch device 530 provided at the upper portion of the frame 110.

The first latch device 520 may be linked to and operated in response to operation of the latch switch device 600 provided at the door 30. When the fixing member 550 of the door 30 is inserted into the first latch device 520, the first latch device 520 may actively secure the fixing member 550, so that the fixing member 550 may be continuously inserted in and fixed by the first latch device 520.

When the button 610 provided at the latch switch device 600 is pushed, the first latch device 520 may push the fixing member 550 outward to separate the fixing member 550 from the first latch device 520. That is, the first latch device 520 performs an active role so as to ensure that the fixing member 550 may be smoothly inserted into or separated from the first latch device 520.

On the other hand, the second latch device 530 illustrated in FIG. 26 does not necessarily secure the fixing member 550 inserted into the second latch device 530, because the second latch device 530 is not directly linked to the latch switch device 600. When attempting to insert the fixing member 550 into the second latch device 530, a portion of the fixing member 550 may be smoothly inserted into the second latch device 530. However, differently from the first latch device 520 that actively secures the fixing member 550, the second latch device 530 simply keeps the fixing member 550 caught therein.

If the door 30 is pulled forward (open) while releasing locking between the first latch device 520 and the fixing member 550 by operating the latch switch device 600, the fixing member 550 inserted into the second latch device 530 may also be separated from the second latch device 530. In this scenario, some components of the second latch device 530 may push the fixing member 550 inserted into the second latch device 530 so as to guide outward separation of the fixing member 550.

As illustrated in FIG. 23, the first latch device 520 may be installed on the frame 110 and arranged near the roller device 300.

The first latch device 520 may include a stopper 523 and a holding pin 5247. A stopper recess 111, into which the stopper 523 is inserted, and a holding guide recess 112, into which the holding pin 5247 is inserted, may be formed in a lower rim of the storage compartment 20 or in the upper surface of the shelf 23. A "C"-shaped expanded recess may be formed at a position of the holding guide recess 112 adjacent to the stopper recess 111.

In the case in which the storage container 100 is coupled to the door 30 so as to move together with the door 30, the holding pin 5247 is not caught by the expanded recess of the holding guide recess 112 and may freely move according to a rotating direction of the door 30.

When the storage container 100 is separated from the door 30, the holding pin 5247 may move into the expanded recess until it is caught by a stepped portion 112*a* of the expanded recess, thereby preventing forward movement of the storage container 100.

The stopper 523 may take the form of, for example, a rod or roller extending downward from the bottom of the first latch device 520. The stopper 523 may limit movement of the storage container 100 to prevent the storage container 100 from being too deeply inserted into the storage compartment 20 as the storage container 100 rotates together with the door 30 to close the front opening of the storage compartment 20. As the stopper 523 comes into contact with a rear surface of the stopper recess 111, the stopper 523 may prevent the storage container 100 from being introduced into the storage compartment 20 beyond a predetermined depth.

Figure 24:
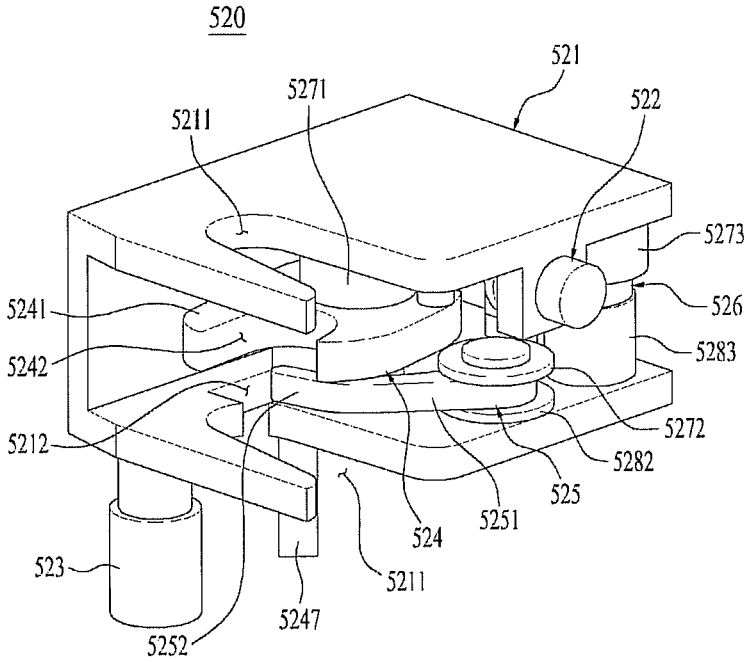
FIG. 24 is a perspective view of the first latch device shown in FIG. 23.

As illustrated in FIG. 24, the first latch device 520 may include a housing 521 having a U-shaped sectional form with a front opening, and a holding member 524 rotatably installed in the housing 521, the holding member 524 being configured to be caught by the fixing member 550 (see FIG. 11) or the holding guide recess 112 (see FIG. 23). A rotation limiter 525 may also be rotatably installed in the housing 521, below the holding member 524, and configured to be inserted into the holding member 524 so as to limit rotation of the holding member 524 when the holding member 524 is disconnected or separated from the fixing member 550.

A movement guider 526 (see FIG. 25) may be connected to the holding member 524 via a first elastic member 5291 (see FIG. 25) to guide rotation of the holding member 524. A press piece 522 may be provided at a front end of the housing 521 to press the movement guider 526 so as to pivotally rotate the movement guider 526. The press piece 522 may come into contact with the latch switch device 600 (see FIG. 4) and be moved into the housing 521 when pushed by the latch switch device 600, thereby moving the movement guider 526 and consequently rotating the holding member 524. The holding pin 5247 may extend downward from a lower surface of the holding member 524, which may include a holding recess 5242 at a lateral end thereof by which the fixing member 550 may be caught and supported.

The housing 521 may include insertion guide recesses 5211 at the top and bottom thereof to guide insertion of the fixing member 550, and a movement guide recess 5212 may be formed in the bottom of the housing 521 to guide movement of the holding pin 5247.

When the holding member 524 is rotated, the holding pin 5247 may move in the same rotating direction, as the movement guide recess 5212 may have a region corresponding to the movement trace of the holding pin 5247. The corresponding region of the movement guide recess 5212 may have a form corresponding to that of the holding guide recess 112 (see FIG. 23) when viewed from the upper side. The stopper 523 may extend downward from a lower surface of the housing 521, and may have a cylindrical form.

The housing 521, as described above, may include the insertion guide recesses 5211 at the top and bottom thereof and the movement guide recess 5212 at the bottom thereof. As may be seen more clearly in FIG. 25, the housing 521 may also include insertion holes 5213, 5214 and 5215 at the bottom thereof into which rotating shafts 5267, 5268 and 5269 may be inserted to rotatably support the holding member 524, the rotation limiter 525 and the movement guider 526. A guide hole 5216 may be formed in an upper front end of the housing 521 to receive and support the press piece 522 and guide forward and rearward movement of the press piece 522.

A support rod 5217 may be provided in the housing 521 to engage and support a second elastic member 5292, such as, for example, a coil spring. The second elastic member 5292 may be connected between the support rod 5217 and a holding protrusion 5254 of the rotation limiter 525.

Accordingly, if an external force, which has been applied by the fixing member 550 to the rotation limiter 525, is removed after rotation of the rotation limiter 525, the rotation limiter 525 may return to an original position thereof.

Fastening holes 5218 may be formed in a rear wall of the housing 521 such that certain fastening members may pass through the fastening holes 5218 and be coupled to the frame 110.

The holding member 524 may include a body 5241, the holding recess 5242 formed in a lateral portion of the body 5241, a holding protrusion 5243 provided at an upper surface of the body 5241, a first insertion recess 5244 and a second insertion recess 5245 respectively formed in the body 5241 at opposite positions of the holding recess 5242, a first rotating shaft hole 5246 into which a first rotating shaft 5267 is inserted, and the holding pin 5247 extending downward from a lower surface of the body 5241.

One end of the first elastic member 5291 may be caught by the holding protrusion 5243 and the other end of the first elastic member 5291 may be caught by a holding protrusion 5265 provided at the movement guider 526. The first elastic member 5291 may be, for example, a coil spring or the like.

Accordingly, if the movement guider 526 is pushed by the press piece 522 and rotated, this rotation of the movement guider 526 is transmitted to the holding member 524 via the first elastic member 5291, and thus the holding member 524 is also rotated and moved forward in a state in which the holding recess 5242 faces laterally.

The first rotating shaft 5267 is inserted into the first rotating shaft hole 5246 of the holding member 524 in a state of being inserted into the insertion hole 5215.

A first upper boss 5271 and a first lower boss 5281 at upper and lower surfaces of the holding member 524, respectively, may allow the holding member 524 to be spaced apart from the upper and lower surfaces of the housing 521.

The rotation limiter 525 may include a body 5251, a first extension 5252 extending from one side of the body 5251 so as to come into contact with the fixing member 550, the first extension 5252 having a bent form, and a second extension 5253 extending in a different direction from the first extension 5252. The body 5251 may include a second rotating shaft hole 5256. The holding protrusion 5254 may be provided at an end of the second extension 5253 such that the second elastic member 5292 is caught by the holding protrusion 5254. An insert piece 5255 may extend upward from an upper surface of the second extension 5253 so as to be selectively inserted into the second insertion recess 5245 of the holding member 524. When the insert piece 5255 is inserted into the second insertion recess 5245, rotation of the holding member 524 may be limited. This corresponds to a case in which the fixing member 550 and the holding member 524 are separated from each other.

A second rotating shaft 5269 may pass through the insertion hole 5214 after being inserted into the second rotating shaft hole 5256. In this case, a second upper boss 5272 and a second lower boss 5282 may be provided respectively at upper and lower surfaces of the rotation limiter 525 to support the rotation limiter 525 and to allow the rotation limiter 525 to be spaced apart from the lower and upper surfaces of the housing 521.

The second rotating shaft 5269 may penetrate the second upper boss 5272, the second rotating shaft hole 5256 and the second lower boss 5282.

The second upper boss 5272 and the second lower boss 5282 may be, for example, washers.

The movement guider 526 may include a body 5261, a contact piece 5263 extending in a lateral direction from the body 5261 so as to come into contact with the press piece 522, an insert piece 5262 extending in a different direction from the body 5261 so as to be selectively inserted into the first insertion recess 5244 of the holding member 524, and the holding protrusion 5265 extending upward from the body portion 5261 such that the second elastic member 5292 may be caught by the holding protrusion 5265. A third rotating shaft hole 5264 may be formed at a pivoting center of the body 5261, with a third upper boss 5273 and a third lower boss 5283 provided above and below the third rotating shaft hole 5264. A third rotating shaft 5268 may pass through the insertion hole 5213, the third lower boss 5283, the third rotating shaft hole 5264 and the third upper boss 5273 so as to rotatably support the movement guider 526.

As illustrated in FIG. 26, the second latch device 530 may be installed at an upper portion of the frame 110, and may include a stopper 533 and a holding pin 5347. A stopper recess 121, into which the stopper 533 may be inserted, and a holding guide recess 122, into which the holding pin 5347 may be inserted, may be formed in an upper rim 24 of the storage compartment 20. A "C"-shaped expanded recess may be formed at a position of the holding guide recess 122 adjacent to the stopper recess 121.

In the case in which the storage container 100 is coupled to the door 30 so as to move together with the door 30, the holding pin 5347 is not caught by the expanded recess of the holding guide recess 122 and may freely move according to a rotating direction of the door 30. When the storage container 100 is separated from the door 30, the holding pin 5347 may move to the expanded recess until it is caught by a stepped portion 122*a* of the expanded recess, thereby preventing forward movement of the storage container 100.

The stopper 533 may be, for example, a rod or roller extending downward from the bottom of the second latch device 530. The stopper 533 may limit movement of the storage container 100 to prevent the storage container 100 from being inserted too deeply into the storage compartment 20 as the storage container 100 rotates with the door 30 to close the front opening of the storage compartment 20.

As the stopper 533 comes into contact with a rear surface of the stopper recess 121, the stopper 533 may prevent the storage container 100 from being introduced into the storage compartment 20 beyond a predetermined depth.

Figure 27:
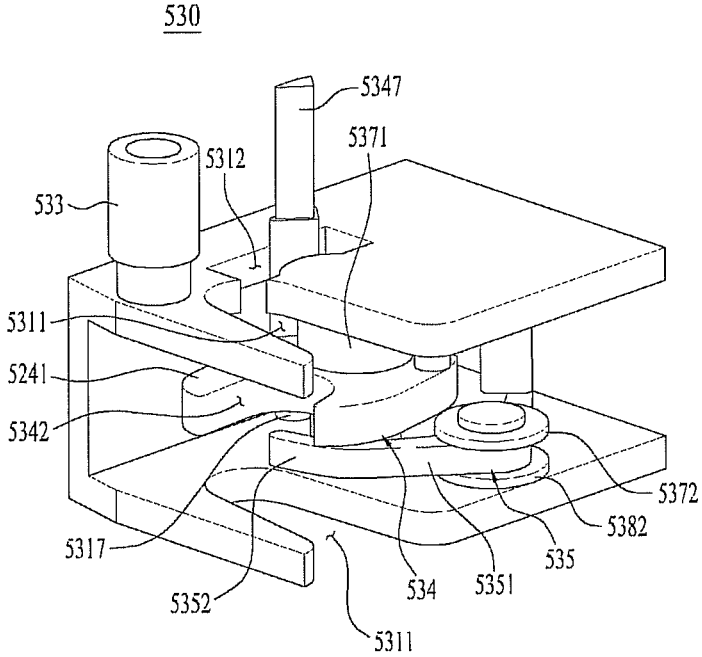
FIG. 27 is a perspective view of the second latch device shown in FIG. 26.

As illustrated in FIG. 27, the second latch device 530 may include a housing 531 having a U-shaped side sectional form with a front opening, and a holding member 534 rotatably provided in the housing 531, the holding member 534 being configured to be caught by the fixing member 550 or the holding guide recess 122. The second latch device 530 may also include a rotation limiter 535 rotatably provided in the housing 531, the rotation limiter 535 being located below the holding member 534 and configured to be inserted into the holding member 534 so as to limit rotation of the holding member 534 when the holding member 534 is disconnected or separated from the fixing member 550.

The holding pin 5347 may extend upward from an upper surface of the holding member 534 and may include a holding recess 5342 that engages and supports the fixing member 550.

The housing 531 may also include insertion guide recesses 5311 formed at the top and bottom thereof to guide insertion of the fixing member 550. A movement guide recess 5312 to guide movement of the holding pin 5347 may be formed in the top of the housing 531 at a position near the top insertion guide recess 531.

When the holding member 534 is rotated, the holding pin 5347 may move in the same rotating direction. The movement guide recess 5312 may have a region corresponding to the movement trace of the holding pin 5347. The corresponding region of the movement guide recess 5312 may have a form corresponding to that of the holding guide recess 122 when viewed from the upper side. The stopper 533 may extend upward from an upper surface of the housing 531 and may have a cylindrical form.

The housing 531, as described above, may include the insertion guide recesses 5311 and the movement guide recess 5312. As may be shown more clearly in FIG. 28, the housing 531 may also include insertion holes 5314 and 5315 at the bottom thereof into which rotating shafts 5361 and 5362 to rotatably support the holding member 534, the rotation limiter 535 and the movement guider 536 may be inserted. A support rod 5317 may be provided in the housing 531 to catch and support an elastic member 5392. The elastic member 5392 may be connected between the support rod 5317 and a holding protrusion 5354 of the rotation limiter 535.

Accordingly, if an external force, which has been applied by the fixing member 550 to the rotation limiter 535, is removed after rotation of the rotation limiter 535, the rotation limiter 525 may be returned to an original position thereof.

Fastening holes 5318 may be formed in a rear wall of the housing 531 such that certain fastening members may pass through the fastening holes 5318 to thereby be coupled to the frame 110.

The holding member 534 may include a body 5341, the holding recess 5342 formed in a lateral portion of the body 5341, a first insertion recess 5344 and a second insertion recess 5345 formed respectively in the body 5341 at opposite positions of the holding recess 5342, a first rotating shaft hole 5346 into which a first rotating shaft 5361 is inserted, and the holding pin 5347 extending upward from an upper surface of the body 5341.

In a state in which the fixing member 550 is caught and supported by the holding recess 5342, the holding recess 5342 may be oriented to face laterally. Then, when the fixing member 550 is separated from the holding recess 5342, the holding recess 5342 may be oriented to face forward.

The first rotating shaft 5361 may be inserted into the first rotating shaft hole 5346 of the holding member 524 in a state of being inserted into the insertion hole 5315.

A first upper boss 5371 and a first lower boss 5381 may be respectively provided at upper and lower surfaces of the holding member 534, to allow the holding member 534 to be spaced apart from the upper and lower surfaces of the housing 531.

The rotation limiter 535 may include a body 5351, a first extension 5352 extending from one side of the body 5351 so as to come into contact with the fixing member 550, the first extension 5352 having a bent form, and a second extension 5353 extending in a different direction from the first extension 5352. The body 5351 may include a second rotating shaft hole 5356. The holding protrusion 5354 may be provided at an end of the second extension 5353 such that the elastic member 5392 is caught by the holding protrusion 5354. An insert piece 5355 may extend upward from an upper surface of the second extension 5353 so as to be selectively inserted into the second insertion recess 5345 of the holding member 534. When the insert piece 5355 is inserted into the second insertion recess 5345, rotation of the holding member 534 may be limited. This corresponds to a case in which the fixing member 550 and the holding member 534 are separated from each other. A second rotating shaft 5362 may pass through the insertion hole 5314 after being inserted into the second rotating shaft hole 5356.

In this case, a second upper boss 5372 and a second lower boss 5382 may be respectively provided at upper and lower surfaces of the rotation limiter 535, thereby serving to support the rotation limiter 535 and to allow the rotation limiter 535 to be spaced apart from the lower and upper surfaces of the housing 531.

The second rotating shaft 5362 may penetrate the second upper boss 5372, the second rotating shaft hole 5356 and the second lower boss 5382.

The second upper boss 5372 and the second lower boss 5382 may be, for example, washers.

Although the above described first and second latch devices 520 and 530 are of a mechanical type, these latch devices may be of an electric or electronic type and more particularly, may be solenoid devices, or other types of devices as appropriate.

In particular, the latch switch device 600, which serves as the control device provided at the door 30, may be linked to the latch devices 520 and 530. Thus, the latch devices 520 and 530 may realize connection between the storage container 100 and the refrigerator body 10 or connection between the storage container 100 and the door 30 according to operation of the latch switch device 600.

Figure 25:
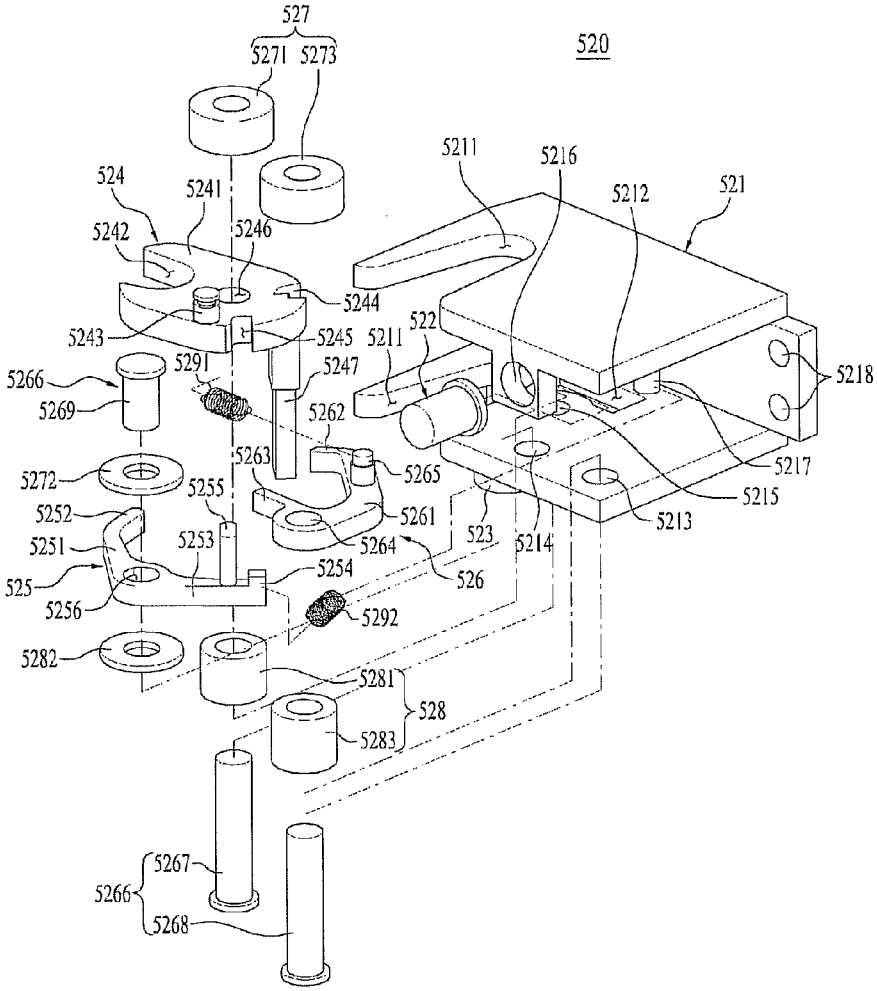
FIG. 25 is an exploded perspective view of the first latch device shown in FIGS. 23 and 24.
Figure 28:
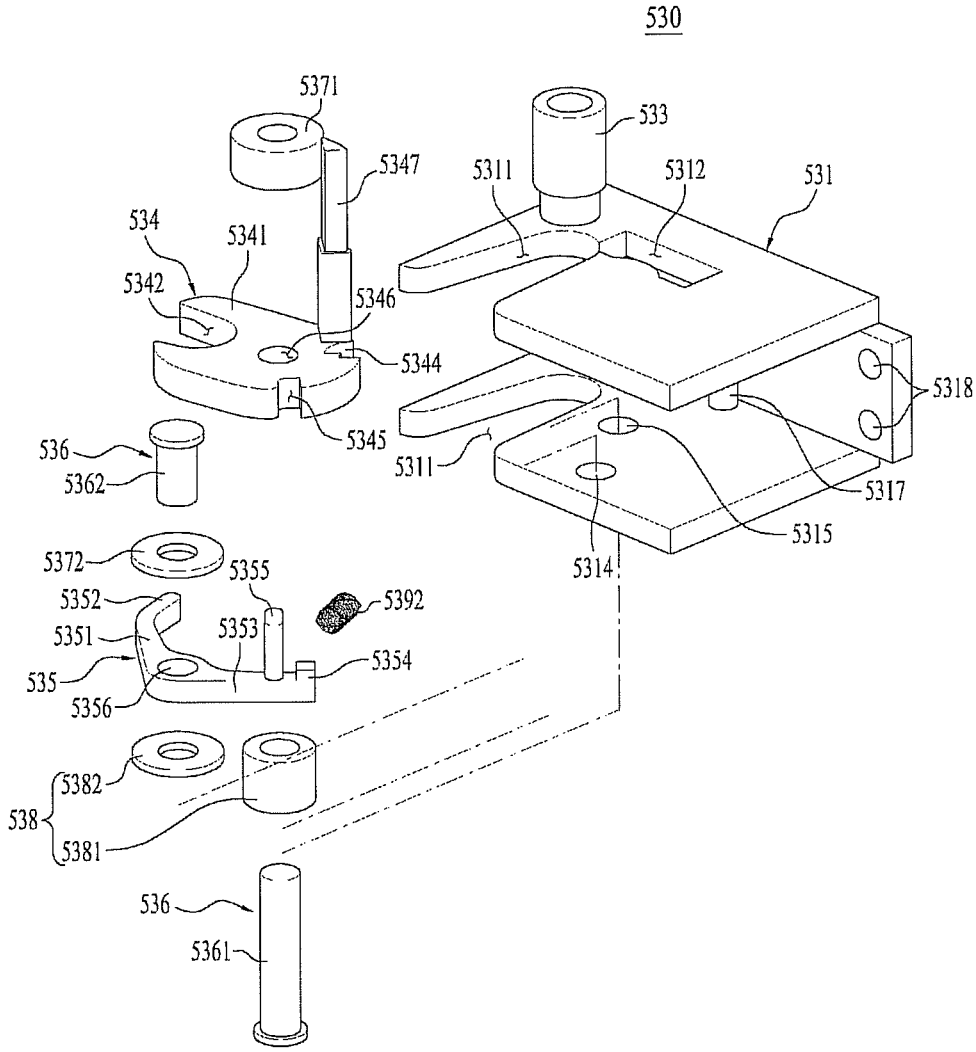
FIG. 28 is an exploded perspective view of the second latch device shown in FIGS. 26 and 27.

A difference between the second latch device 530 illustrated in FIG. 28 and the first latch device 520 illustrated in FIG. 25 is that the second latch device 530 does not include the movement guider 526 and the press piece 522 which are included in the first latch device 520. Specifically, in the first latch device 520, the movement guider 526 guides pivotal rotation of the holding member 524, or is inserted into the first insertion recess 5244 of the holding member 524. Insertion of the movement guider 526 into the first insertion recess 5244 may prevent the holding recess 5242 of the holding member 524 from being oriented forward. Accordingly, once the fixing member 550 has been inserted into and caught by the holding recess 5242 and the movement guider 526 has been inserted into the first insertion recess 5244, it is possible to prevent separation of the fixing member 550 from the holding member 524. That is, through interaction between the holding member 524 and the movement guider 526, the first latch device 520 may actively keep the fixing member 50 secured in the first latch device 520.

Then, if the press piece 522, whose operation is linked to the latch switch device 600, is pushed, the press piece 522 may push the movement guider 526, thereby releasing locking between the movement guider 526 and the holding member 524. Since the holding member 524 may freely rotate in such a state, if the door 30 is pulled (open), the holding member 524 rotates forward, thereby allowing the fixing member 550 to be separated from the holding member 524 and released from the first latch device 520. Then, as the second latch device 530, which provides more passive latching, is separated from the fixing member 550, the storage container 100 and the door 30 may be separated from each other.

Figure 29:
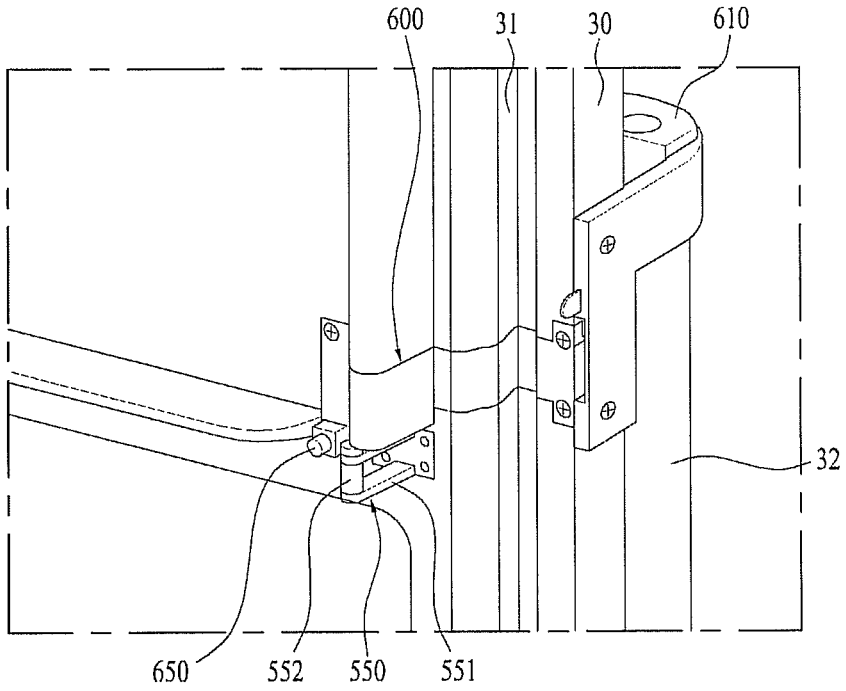
FIG. 29 is a perspective view of the door and a latch switch device of the refrigerator, in accordance with an embodiment as broadly described herein.

As illustrated in FIG. 29, the handle 32 may be provided at a front surface of the door 30, and the button 610 at the upper end of the handle 32. The gasket 31 may be installed along the rim of the rear surface of the door 30. The latch switch device 600 connected to the handle 32 may be located at, for example, the rear surface of the door 30 and may include a release pin 650. The link provided in the latch switch device 600 may move in response to operation of the button 610. The release pin 650 may be located at an end of the link. Accordingly, if the button 610 is pushed, the link is moved so as to move the release pin 650 rearward, thereby allowing the release pin 650 to push the press piece 522 of the first latch device 520.

The fixing member 550 may be located below the latch switch device 600. As previously discussed, the fixing member 550 includes legs 551 extending rearward from the rear surface of the door 30 and the fixing pin 552 disposed at the ends of the legs 551. The legs 551 may be vertically spaced apart from each other to define a predetermined space therebetween, and the fixing pin 552 may be disposed at the ends of the upper and lower legs 551 so that the fixing pin 552 may be caught and supported by the holding recess 5242 (see FIGS. 24 and 25) of the first latch device 520.

Figure 30:
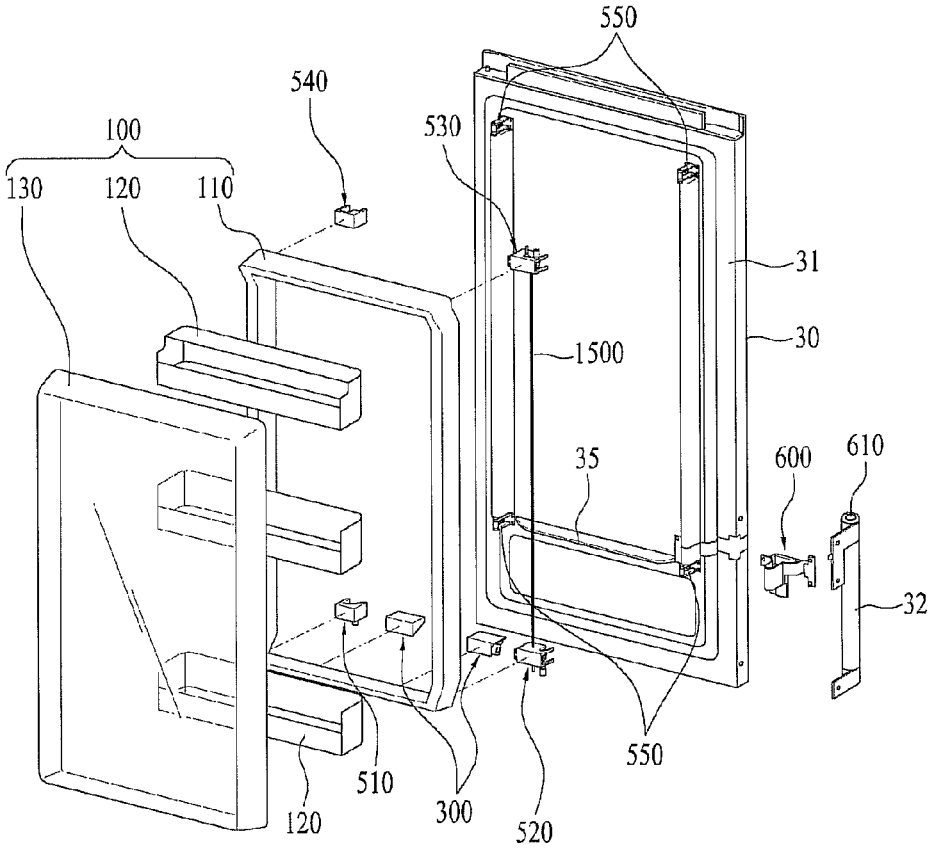
FIG. 30 is an exploded perspective view of the storage container and the door of the refrigerator, in accordance with an embodiment as broadly described herein.

FIG. 30 illustrates another embodiment in which the first and second latch devices 520 and 530 are connected to each other via a connector 1500 so as to be simultaneously operated.

As illustrated in the exemplary embodiment shown in FIG. 30, when viewed from the front side, the handle 32 is mounted at the left lower corner of the door 30, the first and second latch devices 520 and 530 are respectively located at the lower left corner and the upper left corner of the storage container 100, and the first and second guide support devices 510 and 540 are located at the lower right corner and the upper right corner of the storage container 100.

In particular, the first latch device 520 and the second latch device 530 may be located at a first side of the door 30 opposite a second side of the door at which the hinge 13 that couples the door 30 to the refrigerator body 10 is provided.

The first and second guide support devices 510 and 540 may be respectively located at positions opposite the first and second latch devices 520 and 530, corresponding to the second side of the door 30.

The latch switch device 600 is provided at a region of the door 30 where the handle 32 of the door 30 is installed to operate the first latch device 520 by pressing the first latch device 520. The latch switch device 500 serves as the control device for the first latch device 520.

As previously discussed, latch switch device 600 is linked to the button 610 so as to apply force in a predetermined direction, such as, for example, rearward of the door 30. As the latch device 520 is operated via operation of the latch switch device 600, coupling between the door 30 and the storage container 100 may be released.

Specifically, the door 30 and the storage container 100 may remain coupled to each other so long as the user does not push the button 610. However, if the button 610 is pushed, coupling between the door 30 and the storage container 100 is released from the door 30, and the storage container 100 is then coupled to the refrigerator body 10 instead. The handle 32 may include the vertical rod forming a grip portion and the coupling portion horizontally extending from the vertical rod so as to be fastened to the lateral surface of the door 30. The latch switch device 600 may be embedded in the door 30 in the vicinity of the handle 32.

Additionally, the fixing members 550 may be fastened to edge positions of the door 30 and protrude rearward from the rear surface of the door 30 so as to be inserted into and engaged with the first and second latch devices 520 and 530 and the first and second guide support devices 510 and 540. More particularly, the fixing members 550 may be selectively inserted into and engaged by the first and second latch devices 520 and 530 of the storage container 100 so as to facilitate the coupling of the storage container 100 to the door 30. Accordingly, when the door 30 is rotated, the storage container 100 rotates together with the door 30 via coupling between the first and second latch devices 520 and 530 and the fixing members 550.

The handle 32 may include the button 610 to operate the latch switch device 600, and the link of the latch switch device 600 may push a specific one of the latch devices 520 or 530, i.e. the first latch device 520, thereby releasing the first latch device 520 from a locked state. If the first latch device 520 is released from the locked state in this manner and the door 30 is then opened, the storage container 100 may remain coupled to the refrigerator body 10 and only the door 30 is rotated and opened.

In certain embodiments, the first latch device 520 and the second latch device 530 may be connected to each other via the connector 1500 so as to be simultaneously operated. In the embodiment shown in FIG. 30, the first latch device 520 is located at a lower portion of one side of the frame 110, and the second latch device 530 is located at an upper portion of the same side of the frame 110. The connector 1500 may be vertically oriented to connect the first and second latch devices 520 and 530. In this arrangement, the first latch device 520 may serve as a driving device and the second latch device 530 may serve as a driven device, as the latch switch device 600 is located close to the first latch device 520.

In alternative embodiments, the positions and driving-driven relationship of the first and second latch devices 520 and 530 may be reversed/rearranged as appropriate.

Figure 31:
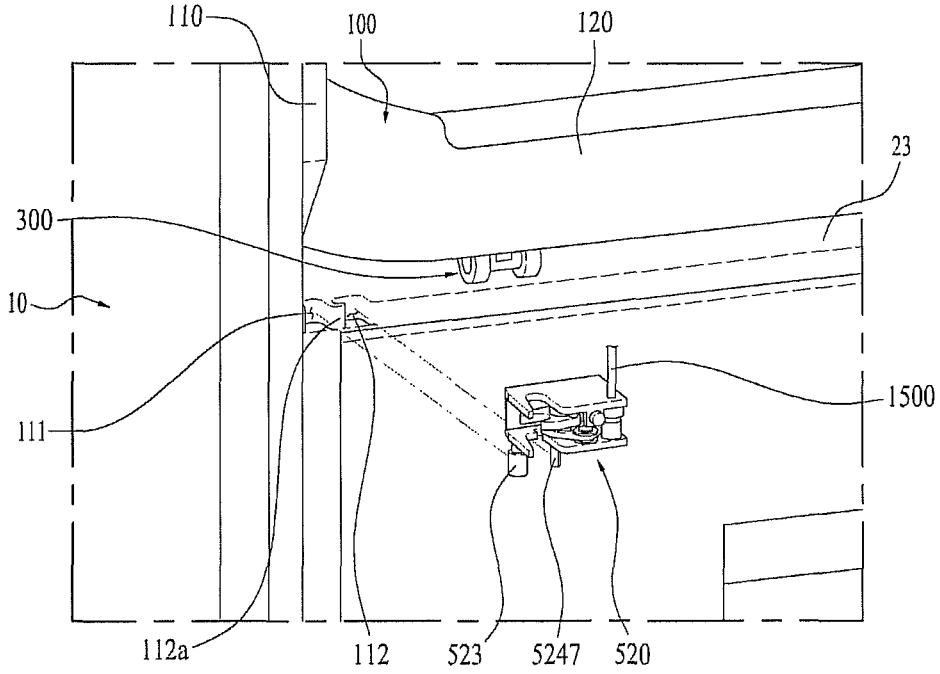
FIG. 31 is a perspective view of an installation of the first latch device with respect to the storage container in accordance with another embodiment as broadly described herein.
Figure 32:
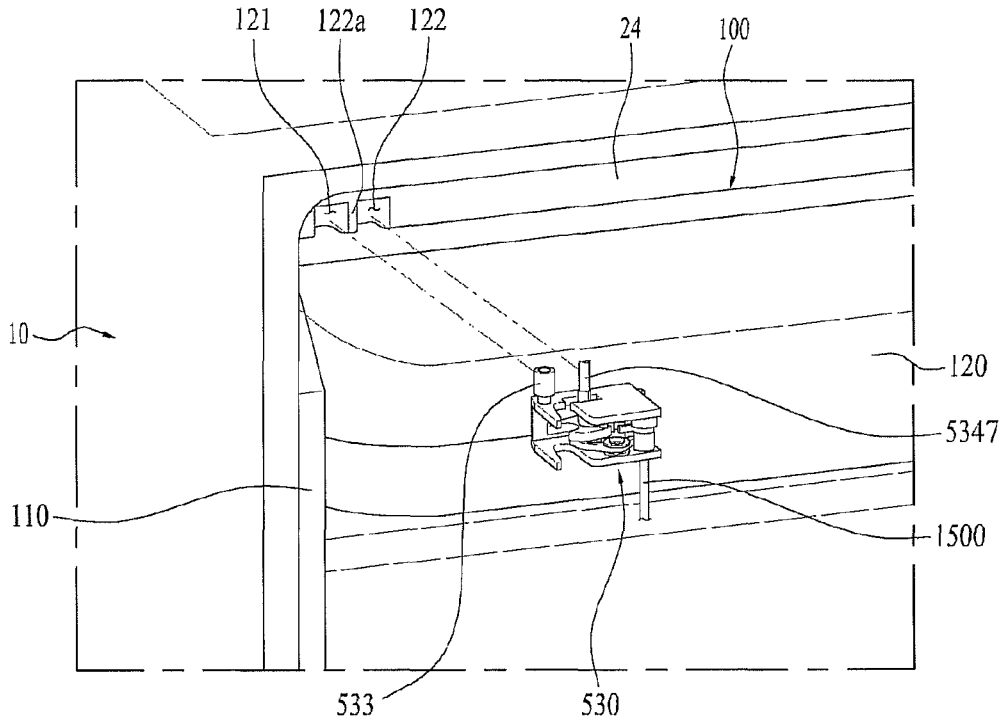
FIG. 32 is a perspective view of an installation of the second latch device with respect to the storage container in accordance with another embodiment as broadly described herein.

As illustrated in FIG. 31, the first latch device 520 may be installed on the frame 110, near the roller devices 300, and may include the stopper 523 and the holding pin 5247. The stopper recess 111, into which the stopper 523 is inserted, and the holding guide recess 112, into which the holding pin 5247 is inserted, may be formed in the lower rim of the storage compartment 20 or in the upper surface of the shelf 23 as appropriate, and the "C"-shaped expanded recess may be formed at a position of the holding guide recess 112 adjacent to the stopper recess 111.

In the case in which the storage container 100 is coupled to the door 30 so as to move together with the door 30, the holding pin 5247 is not caught by the expanded recess of the holding guide recess 112 and may move freely according to a rotating direction of the door 30. When the storage container 100 is separated from the door 30, the holding pin 5247 is moved to the expanded recess until it is caught by the stepped portion 112*a* of the expanded recess, thereby preventing forward movement of the storage container 100.

As previously noted, the stopper 523 may limit movement of the storage container 100 to prevent the storage container 100 from being inserted too deeply into the storage compartment 20 as the storage container 100 rotates with the door 30 to close the front opening of the storage compartment 20. As the stopper 523 comes into contact with the rear surface of the stopper recess 111, the stopper 523 prevents the storage container 100 from being introduced into the storage compartment 20 beyond a predetermined depth.

The connector 1500 may be connected to the top of the first latch device 520 and to the bottom of the second latch device 530, as shown in FIGS. 30-33. The stopper recess 121, into which the stopper 533 of the second latch device 530 is inserted, and the holding guide recess 122, into which the holding pin 5347 of the second latch device 530 is inserted, may be formed in the upper rim of the storage compartment 20, with the "C"-shaped expanded recess formed at a position of the holding guide recess 122 adjacent to the stopper recess 121.

In the case in which the storage container 100 is coupled to the door 30 so as to move together with the door 30, the holding pin 5347 is not caught by the expanded recess of the holding guide recess 122 and may freely move according to a rotating direction of the door 30. When the storage container 100 is separated from the door 30, the holding pin 5347 is moved to the expanded recess until it is caught by the stepped portion 122*a* of the expanded recess, thereby preventing forward movement of the storage container 100.

The stopper 533 may limit movement of the storage container 100 to prevent the storage container 100 from being inserted too deeply into the storage compartment 20 as the storage container 100 rotates with the door 30 to close the front opening of the storage compartment 20. As the stopper 533 comes into contact with a rear surface of the stopper recess 121, the stopper 533 prevents the storage container 100 from being introduced into the storage compartment 20 beyond a predetermined depth.

Thus, as described above, if the connector 1500 is moved via operation of the first latch device 520, the second latch device 530 may be simultaneously moved in the same direction.

Figure 33:
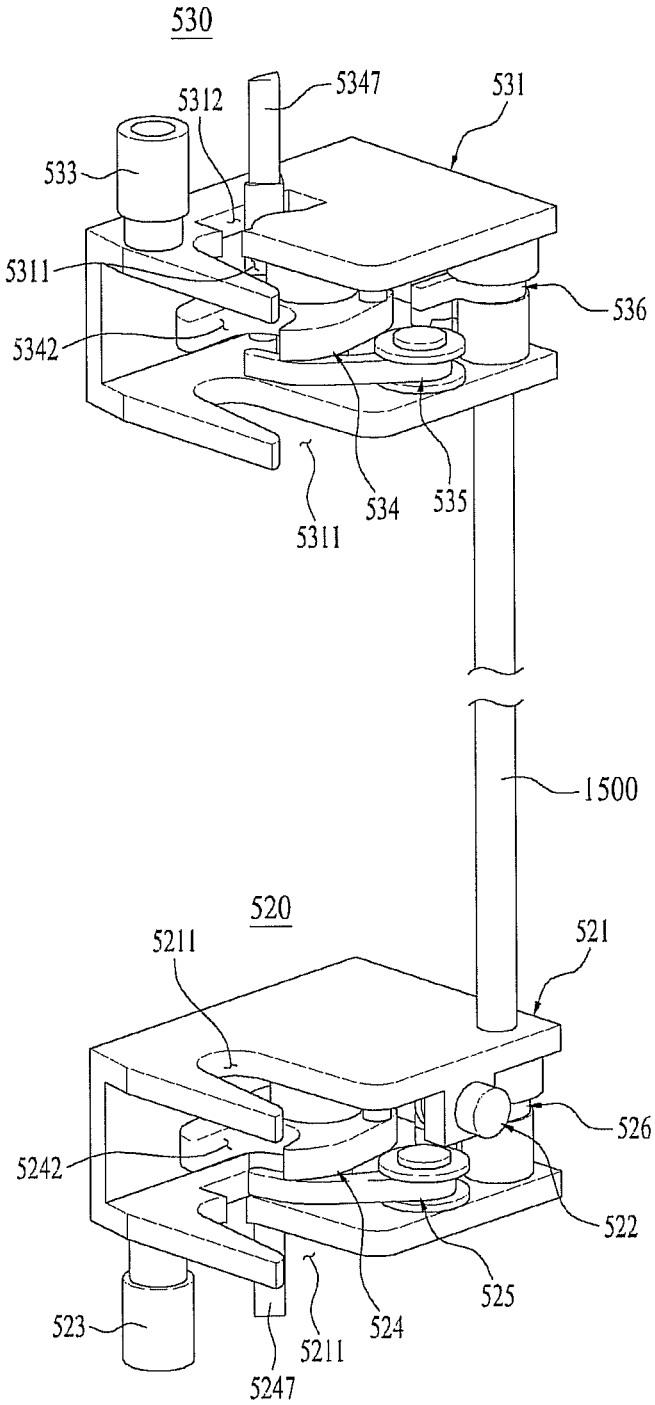
FIG. 33 is a perspective view of another embodiment of the first latch device and the second latch device.

As illustrated in FIG. 33, the first latch device 520 includes the housing 521, the holding member 524 rotatably provided in the housing 521 and configured to be caught by the fixing member 550 or the holding guide recess 112, the rotation limiter 525 rotatably provided in the housing 521 below the holding member 524 and configured to be inserted into the holding member 524 so as to limit rotation of the holding member 524 when it is separated from the fixing member 550, the movement guider 526 provided in the housing 521 and connected to the holding member 524 via the first elastic member 5291 so as to guide rotation of the holding member 524, and the press piece 522 provided at the front of the housing 521 to press the movement guider 526 so as to rotate the movement guider 526.

The press piece 522 may contact the latch switch device 600, and may move into the housing 521 when pushed by the latch switch device 600 to move the movement guider 526 and consequently, to rotate the holding member 524.

The holding pin 5247 extends downward from the lower surface of the holding member 524 and includes the holding recess 5242, the insertion guide recesses 5211, and the movement guide recess 5212. When the holding member 524 is rotated, the holding pin 5247 is moved in the same rotating direction. The movement guide recess 5212 has a region corresponding to the movement trace of the holding pin 5247.

The corresponding region of the movement guide recess 5212 may have a shape corresponding to that of the holding guide recess 112 when viewed from the upper side. The stopper 523 extends downward from the lower surface of the housing 521 and may have a cylindrical form. The connector 1500 may penetrate the top of the housing 521 and extend upward, taking the form of a vertically elongated shaft.

As previously described, the second latch device 530, which is connected to the first latch device 520 via the connector 1500, may include the housing 531, the holding member 534 rotatably provided in the housing 531 and configured to be caught by the fixing member 550 or the holding guide recess 122, the rotation limiter 535 rotatably provided in the housing 531 below the holding member 534 and configured to be inserted into the holding member 534 so as to limit rotation of the holding member 534 when it is separated from the fixing member 550, the movement guider 536 provided in the housing 531 and connected to the holding member 534 via a first elastic member 5391 so as to guide rotation of the holding member 534, the holding pin 5347 extending upward from the upper surface of the holding member 534 and including the holding recess 5342 to catch and support the fixing member 550, the insertion guide recesses 5311 to guide insertion of the fixing member 550, and the movement guide recess 5312 to guide movement of the holding pin 5347.

When the holding member 534 is rotated, the holding pin 5347 is moved in the same rotating direction. The movement guide recess 5312 has a region corresponding to the movement trace of the holding pin 5347. The corresponding region of the movement guide recess 5312 may have a shape corresponding to that of the holding guide recess 122 when viewed from the upper side.

The connector 1500 may penetrate the housing 531 so as to be connected to the movement guider 536. Accordingly, the movement guider 526 of the first latch device 520 and the movement guider 536 of the second latch device 530 may be linked to each other.

Figure 34:
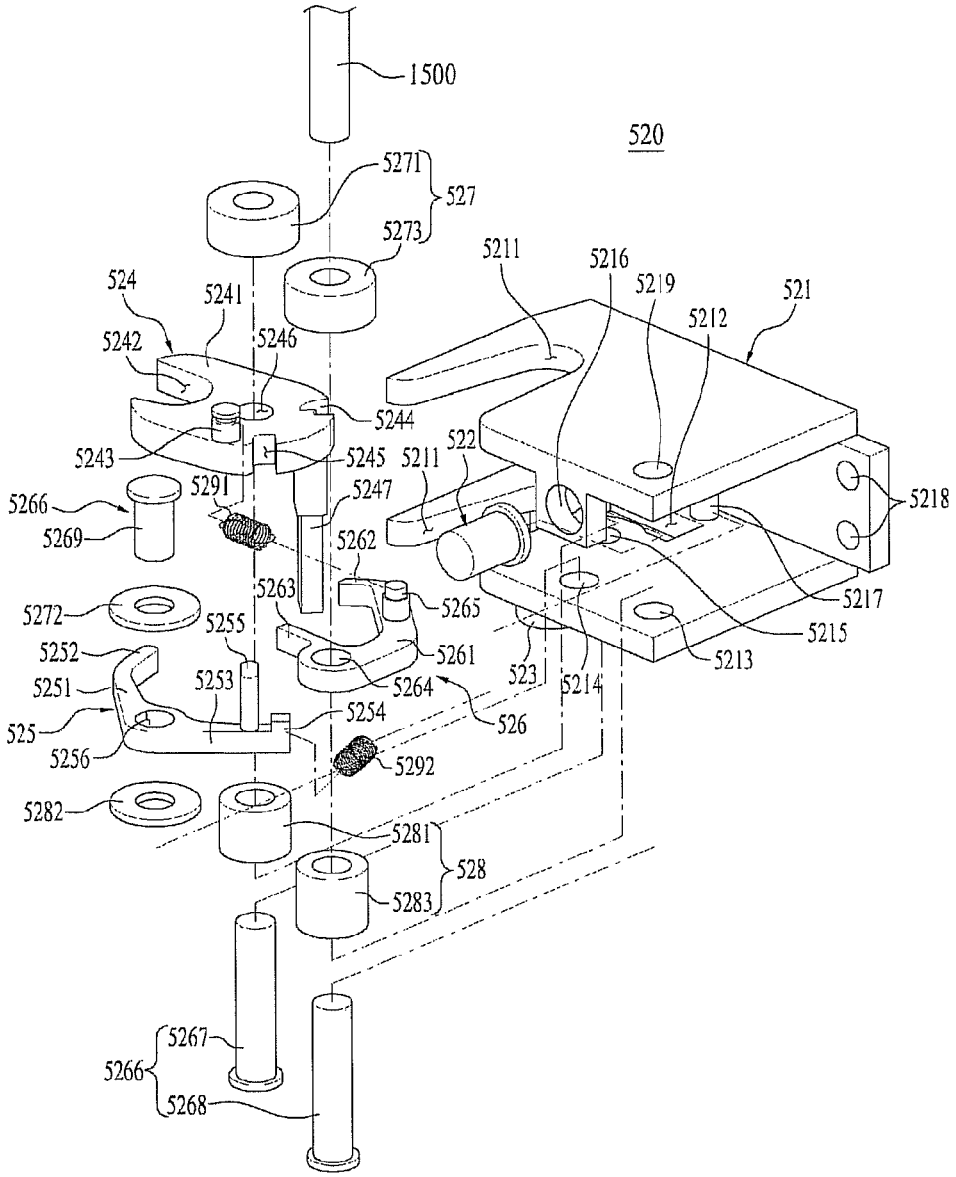
FIG. 34 is an exploded perspective view of a first latch device in accordance with another embodiment as broadly described herein.

FIG. 34 is an exploded perspective view of the first latch device 520, in accordance with embodiments as broadly described herein. The embodiment of the first latch device 520 shown in FIG. 34 is very similar, both in construction and operation, to previously discussed embodiments. However, in the embodiment shown in FIG. 34, the connector 1500 may be connected to the third rotating shaft 5268 of the movement guider 526 of the first latch device 520, or may be integrally formed with the third rotating shaft 5268.

Accordingly, in the embodiment shown in FIG. 34, the third rotating shaft 5268, the connector 1500 and the movement guider 526 may be moved together, causing the connector 1500 to be rotated via rotation of the movement guider 526. A connector hole 5219 may be formed in the top of the housing 521 so that the connector 1500 may be rotatably inserted therethrough and supported by the housing 521.

Figure 35:
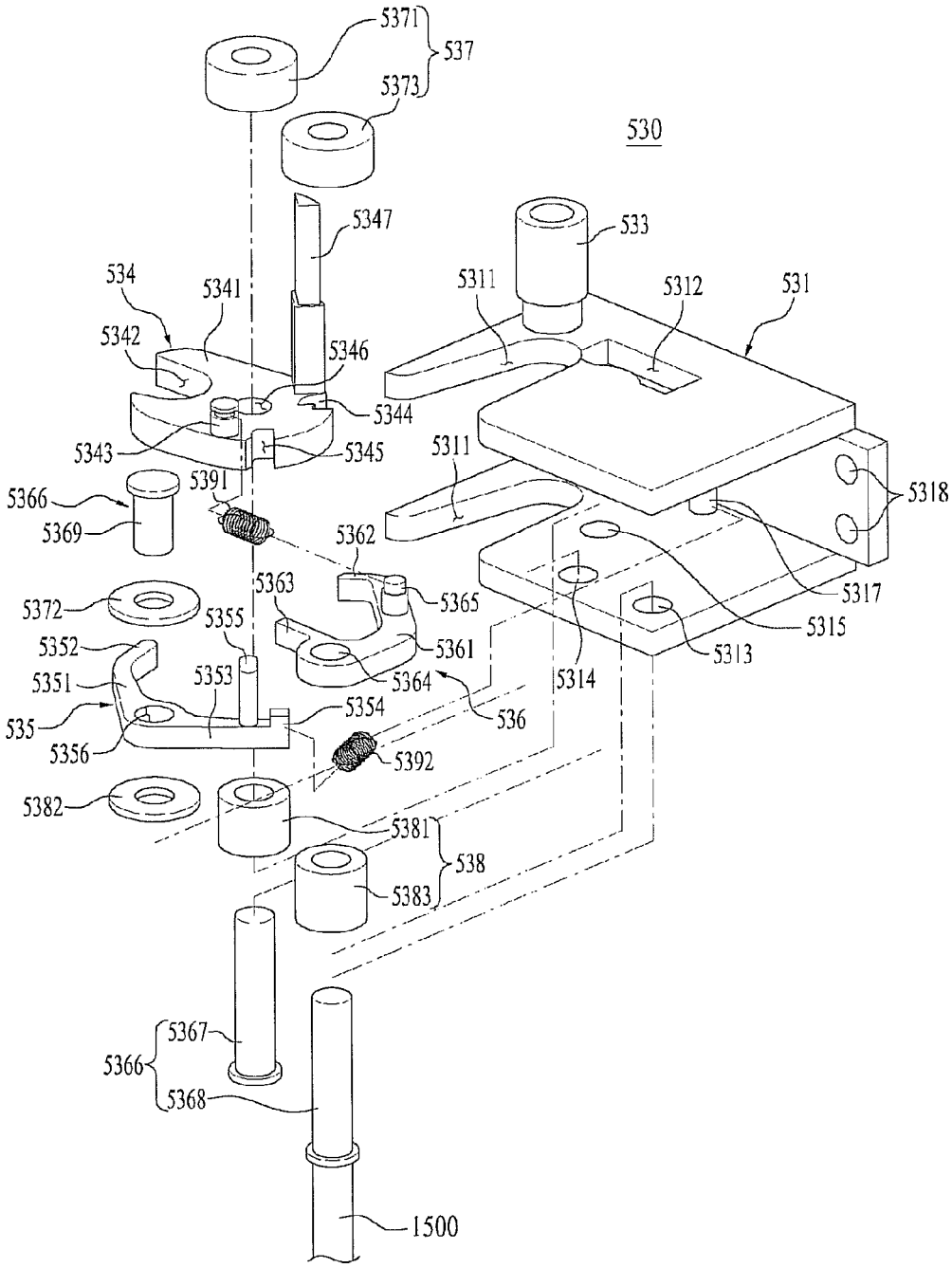
FIG. 35 is an exploded perspective view of a second latch device in accordance with another embodiment as broadly described herein.

FIG. 35 is an exploded perspective view of the second latch device 520, in accordance with embodiments as broadly described herein. The embodiment of the second latch device 530 shown in FIG. 35 is similar to previously discussed embodiments, and thus only differences will be discussed in detail.

In addition to the insertion guide recesses 5311 and the movement guide recess 5312, the housing 531 may also include insertion holes 5313, 5314 and 5315 into which rotating shafts 5367, 5368 and 5369 may be inserted to rotatably support the holding member 534, the rotation limiter 535 and the movement guider 536.

The support rod 5317 provided in the housing 531 may catch and support a second elastic member 5392. The second elastic member 5392 may take the form of a coil spring. The second member 5392 may be connected between the support rod 5317 and the holding protrusion 5354 of the pivotal rotation limiter 535. Accordingly, if external force, which has been applied (by the fixing member 550) to the rotation limiter 535, is removed after rotation of the rotation limiter 535, the rotation limiter 535 may be returned to an original position thereof.

In addition to the body 5341, the holding recess 5342, the first insertion recess 5344 and the second insertion recess 5345, the first rotating shaft hole 5346 into which the first rotating shaft 5367 is inserted, and the holding pin 5347 as previously described, the holding member 534 may also include a holding protrusion 5343 extending upward from an upper surface of the body 5341. One end of the first elastic member 5391 may be caught by the holding protrusion 5343 and the other end of the first elastic member 5391 may be caught by a holding protrusion 5365 provided at an upper surface of a body 5361 the movement guider 536.

Accordingly, if the movement guider 536 is rotated by the connector 1500, which is, at its other end, connected to the movement guider 526 of the first latch device 520, rotation of the movement guider 536 is transmitted to the holding member 534 through the first elastic member 5391, thereby rotating the holding member 534 and moving the holding member 534 forward in a state in which the holding recess 5342 is oriented to face laterally.

The first rotating shaft 5367 may be inserted into the first rotating shaft hole 5346 of the holding member 534 via the insertion hole 5315, with first upper boss 5371 and the first lower boss 5381 respectively provided at the upper and lower surfaces of the holding member 534 to allow the holding member 534 to be spaced apart from the upper and lower surfaces of the housing 531.

As previously described, the rotation limiter 535 may include the body 5351, the first extension 5352 that comes into contact with the fixing member 550, the second extension 5353, the second rotating shaft hole 5356, the holding protrusion 5354 provided at the end of the second extension 5353 such that the second elastic member 5392 is caught by the holding protrusion 5354, and the insert piece 5355 that extends upward from the upper surface of the second extension 5353 so as to be selectively inserted into the second insertion recess 5345 of the holding member 534 to limit rotation of the holding member 534 (when the fixing member 550 and the holding member 534 are separated from each other).

The second rotating shaft 5369 may pass through the insertion hole 5314 after being inserted into the second rotating shaft hole 5356, with the second upper boss 5372 and the second lower boss 5382 respectively provided at the upper and lower surfaces of the rotation limiter 535 to support the rotation limiter 535 and to allow the rotation limiter 535 to be spaced apart from the lower and upper surfaces of the housing 531.

The movement guider 536 shown in FIG. 35 may also include a contact piece 5363 extending in a lateral direction from the body 5361, an insert piece 5362 extending in a different direction from the body 5361 so as to be selectively inserted into the first insertion recess 5344 of the holding member 534, with the holding protrusion 5365 extending upward from the body 5361, and a third rotating shaft hole 5364 formed at a pivoting center of the body 5361. A third upper boss 5373 and a third lower boss 5383 may also be respectively provided above and below the third rotating shaft hole 5364.

The third rotating shaft 5368 may pass through the insertion hole 5313, the third lower boss 5383, the third rotating shaft hole 5364 and the third upper boss 5373, to rotatably support the movement guider 536. The third rotating shaft 5368 may be configured to move together with the movement guider 536 so that the third rotating shaft 5368 may be simultaneously rotated with the movement guider 536.

The connector 1500 may be connected to the third rotating shaft 5368, or may be integrally formed with the third rotating shaft 5368. In such an arrangement, the second rotating shaft 5368, the connector 1500 and the movement guider 536 may be moved together such that the connector 1500 may be rotated via rotation of the movement guider 536.

Although the above described first and second latch devices 520 and 530 are of a mechanical type, these latch devices 520 and 530 may be of an electric or electronic type and more particularly, may be solenoid devices, or other types of devices as appropriate.

In particular, the latch switch device 600, which serves as the control device provided at the door 30, may be linked to the latch devices 520 and 530. Thus, the latch devices 520 and 530 may realize connection between the storage container 100 and the refrigerator body 10 or connection between the storage container 100 and the door 30 according to operation of the latch switch device 600.

Figure 36:
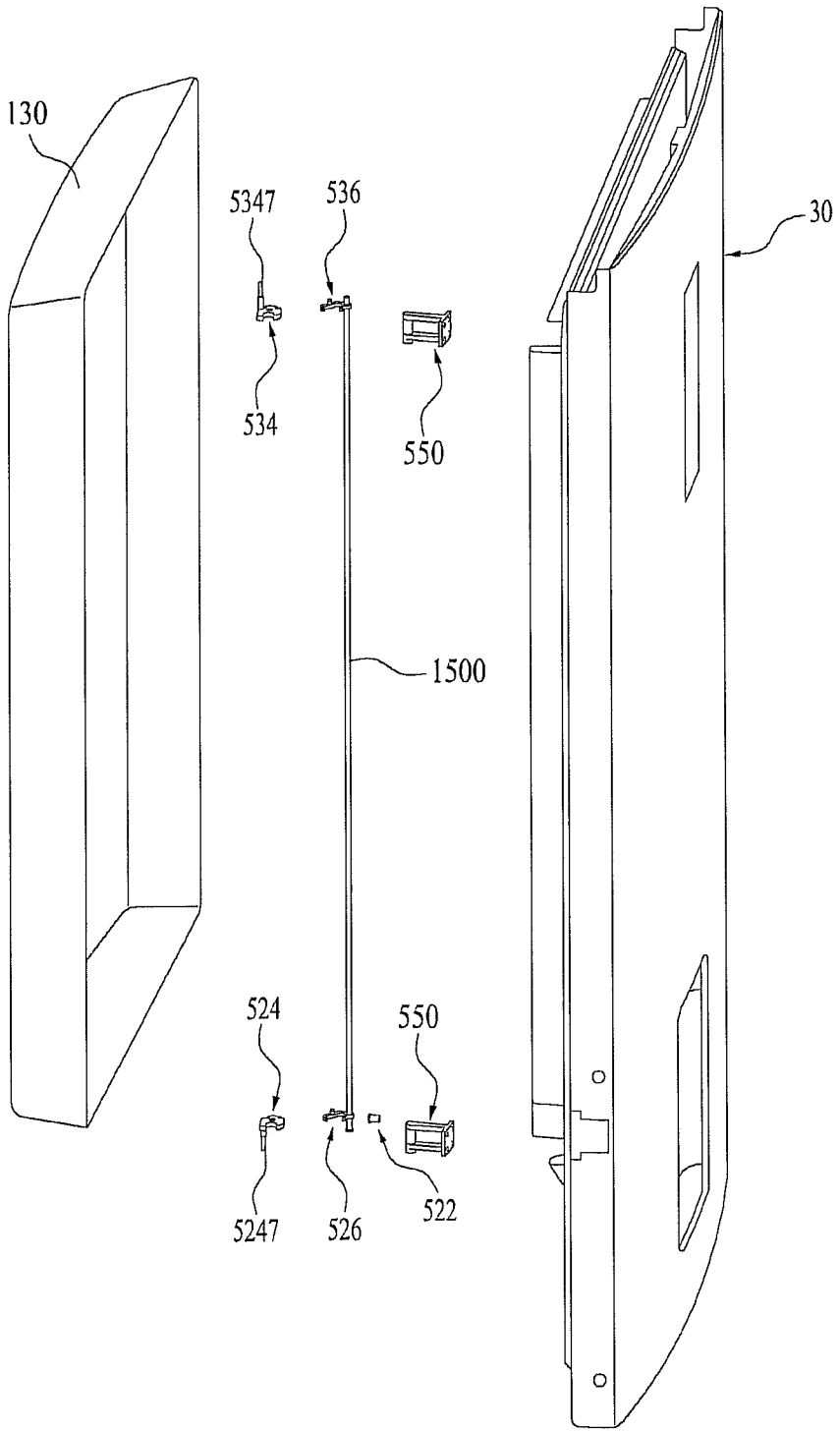
FIG. 36 is a perspective view of holding members of the first and second latch devices shown in FIGS. 33-35, illustrating connection between the holding members using a connector.
Figure 37:
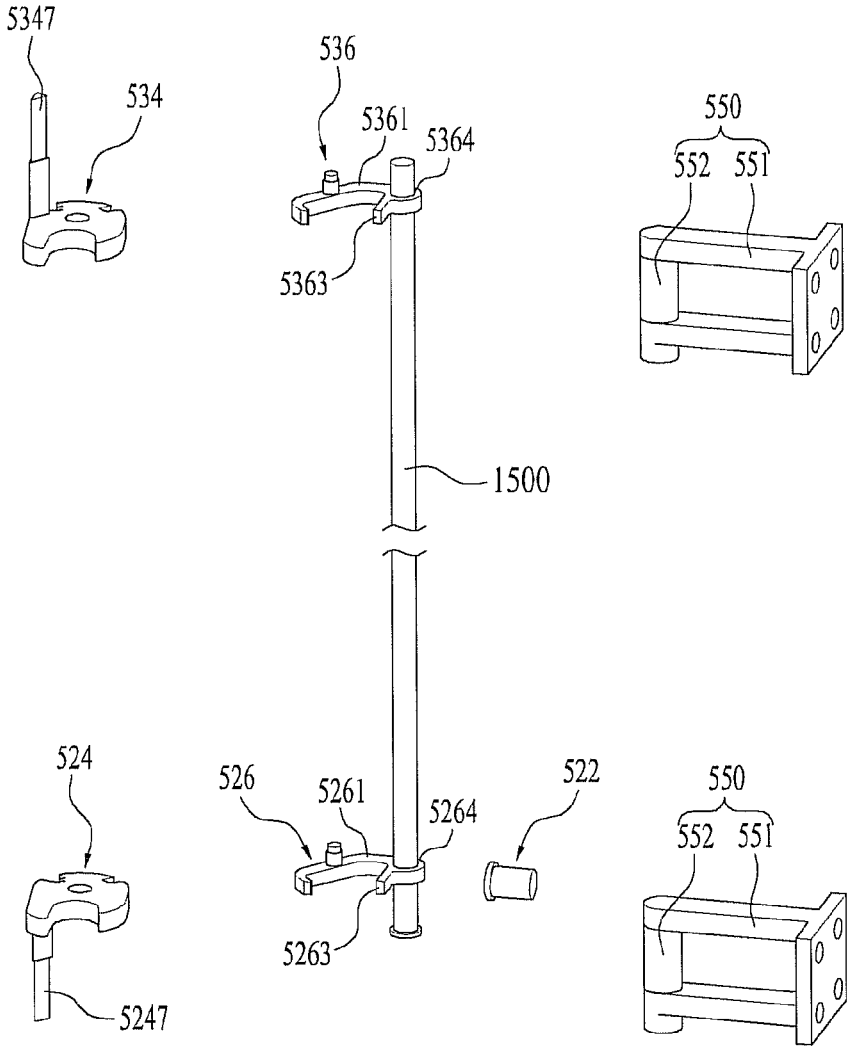
FIG. 37 is an enlarged perspective view illustrating connection between the holding members of the first and second latch devices shown in FIGS. 33-35.

FIGS. 36 and 37 illustrate connection of the holding member 524 and the movement guider 526 of the first latch device 520 and the holding member 535 and the movement guider 536 of the second latch device 530. As illustrated in FIGS. 36 and 37, the respective movement guiders 526 and 536 may be arranged at upper and lower end portions of the connector 1500. As described above, the movement guiders 526 and 536 may be connected to the respective holding members 524 and 534 via elastic members such that the holding members 524 and 534 may rotate via rotation of the movement guiders 526 and 536, thereby being selectively connected to or separated from the respective fixing members 550.

In particular, if the movement guider 526 of the first latch device 520 is rotated through operation of the press piece 522, the rotation is transmitted to the movement guider 536 of the second latch device 530, thereby causing the movement guider 536 to be rotated. Thus, the movement guider 526 of the first latch device 520 and the movement guider 536 of the second latch device 530 have the same rotating direction. As a result, the holding member 524 of the first latch device 520 and the holding member 534 of the second latch device 530 have the same movement direction. This allows coupling/separation between the first latch device 520 and the fixing member 550 and coupling/separation between the second latch device 530 and the fixing member 550 to be accomplished simultaneously.

Figure 38:
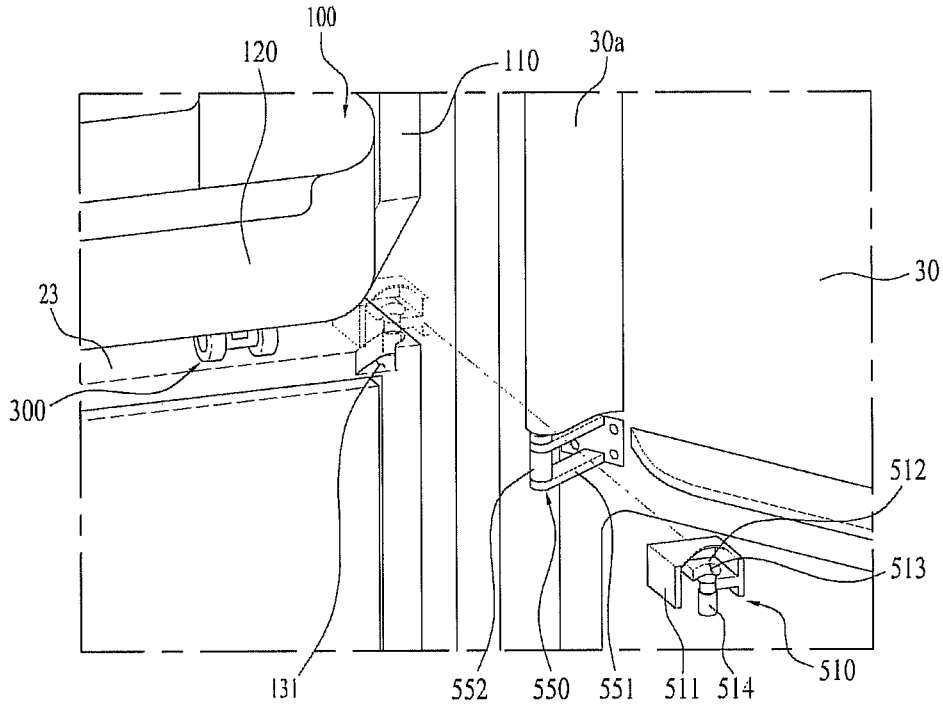
FIG. 38 is a perspective view of a first guide support device and a fixing member of a refrigerator, in accordance with an embodiment as broadly described herein.

As illustrated in FIG. 38, the first guide support device 510 may be mounted to the frame 110. For example, when viewed from the front side, the first guide support device 510 may be fixed to the lower right corner of the frame 110 and is configured such that the fixing member 550 provided at the rear surface of the door 30 may be inserted into the first guide support device 510. Specifically, if the door 30 is rotated in a state in which the door 30 and the storage container 100 are not coupled to each other, the fixing member 550 is inserted into or separated from the first guide support device 510.

The first guide support device 510 may include a housing 511, a support plate 512 provided in the housing 511, an insertion guide recess 513 formed in the support plate 512, and a stopper 514 extending downward from a lower surface of the support plate 512. The stopper 514 may be inserted into a stopper recess 131 formed in a lower right rim of the entrance of the storage compartment 20.

The stopper 514 may limit movement of the storage container 100 to prevent the storage container 100 from being inserted too deeply into the storage compartment 20 when the storage container 100 moves with the door 30 so as to close the front opening of the storage compartment 20. As the stopper 514 comes into contact with a rear surface of the stopper recess 131, the stopper 514 prevents the storage container 100 from being introduced into the storage compartment 20 beyond a predetermined depth.

Since the fixing pin 552 of the fixing member 550 may move along the rotating trace of the door 30, the stopper recess 131 may diagonally extend to correspond to the rotating trace of the fixing pin 552 and a sidewall of the stopper recess 131 may have a predetermined curvature. Specifically, since the fixing member 550 located close to the hinge 13 of the door 30 may have a curvilinear rotating trace, the sidewall of the stopper recess 131 may have a curvature to correspond to the curvilinear rotating trace.

Figure 39:
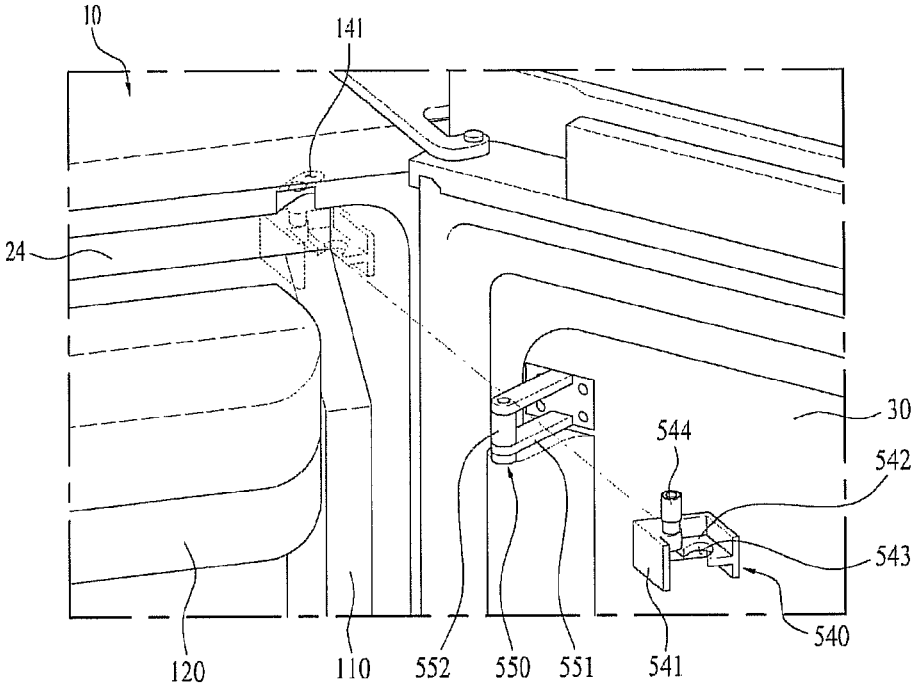
FIG. 39 is a perspective view of a second guide support device and a fixing member of a refrigerator, in accordance with an embodiment as broadly described herein.

As illustrated in FIG. 39, the second guide support device 540 may be mounted to the frame 110. For example, when viewed from the front side, the second guide support device 540 may be fixed to the upper right corner of the frame 110 and may be configured such that the fixing member 550 provided at the rear surface of the door 30 may be inserted into the second guide support device 540. Specifically, if the door 30 is rotated in a state in which the door 30 and the storage container 100 are not coupled to each other, the fixing member 550 is inserted into or separated from the second guide support device 540.

The second guide support device 540 may include a housing 541, a support plate 542 provided in the housing 541, an insertion guide recess 543 formed in the support plate 542, and a stopper 544 extending downward from a lower surface of the support plate 542. The stopper 544 may be inserted into a stopper recess 141 formed in an upper right rim of the entrance of the storage compartment 20.

The stopper 544 may limit movement of the storage container 100 to prevent the storage container 100 from being inserted too deeply into the storage compartment 20 in the case in which the storage container 100 moves with the door 30 to close the front opening of the storage compartment 20. As the stopper 544 comes into contact with a rear surface of the stopper recess 141, the stopper 544 prevents the storage container 100 from being introduced into the storage compartment 20 beyond a predetermined depth.

Since the fixing pin 552 of the fixing member 550 moves along a rotating trace of the door 30, the stopper recess 141 may diagonally extend to correspond to the rotating trace of the fixing pin 552 and a sidewall of the stopper recess 141 may have a predetermined curvature. Specifically, since the fixing member 550 located close to the hinge 13 of the door 30 has a curvilinear rotating trace, the sidewall of the stopper recess 141 may have a curvature to correspond to the curvilinear rotating trace.

Figure 40:
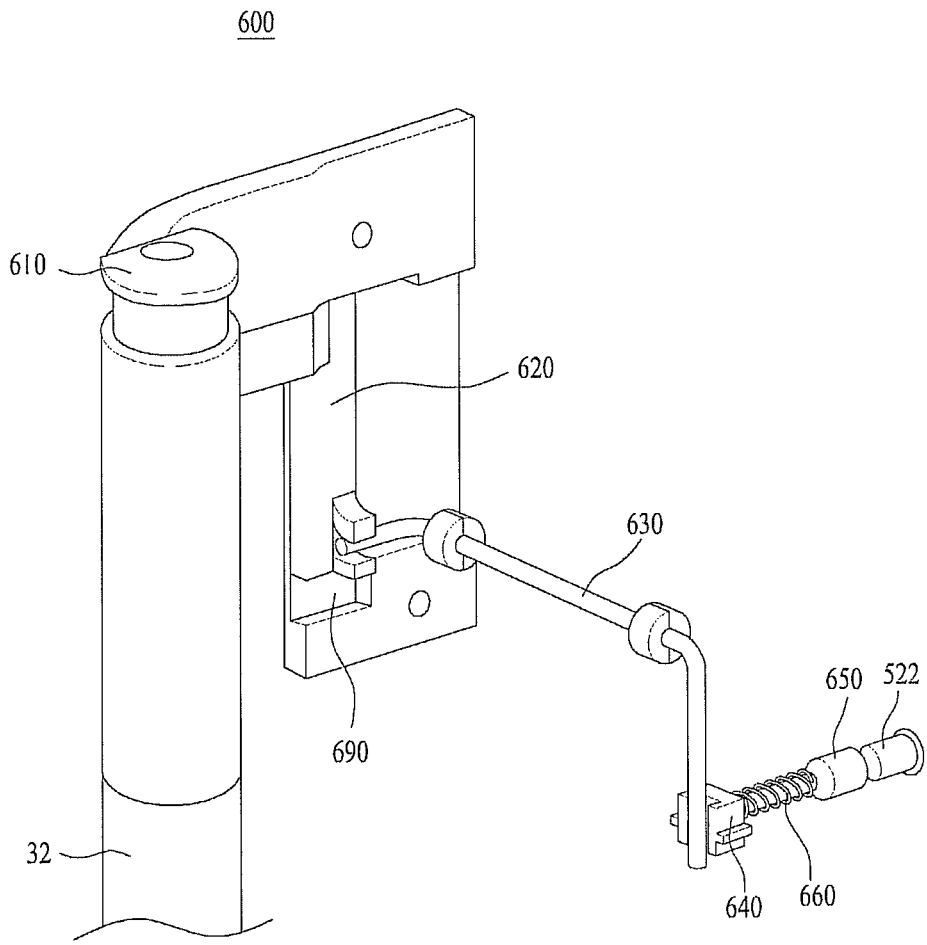
FIG. 40 is a perspective view of a link structure of the latch switch device.
Figure 41:
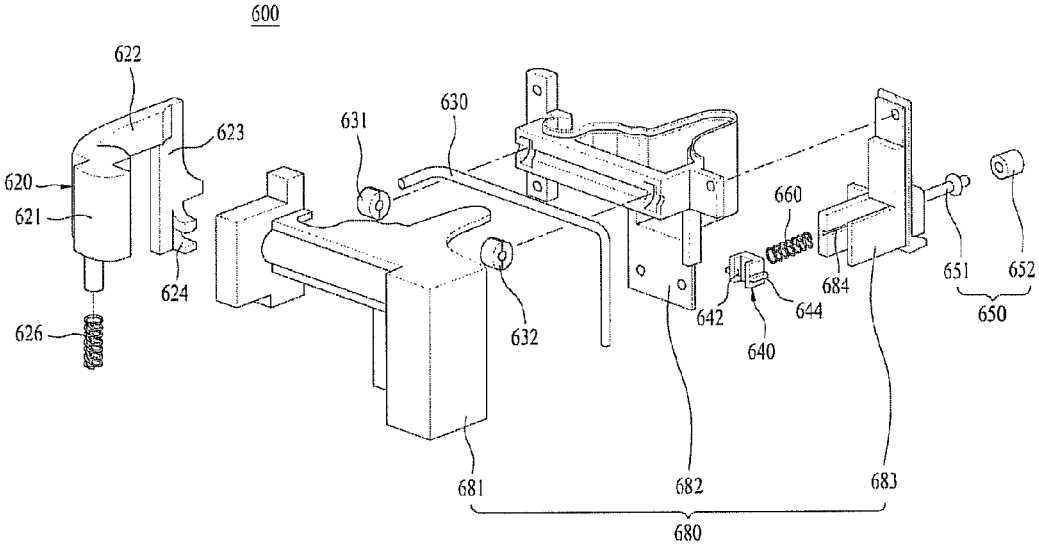
FIG. 41 is an exploded perspective view of the latch switch device shown in FIG. 40.

FIG. 40 is a perspective view illustrating a link structure of the latch switch device operably coupled to the door handle, and FIG. 41 is an exploded perspective view of the latch switch device.

The latch switch device 600 may include the button 610 provided at the handle 32 of the door 30, and a movement converting device to convert a movement direction and an acting position of a push force applied by the button 610 into a different direction and position so as to selectively release the first latch device 520 from a locked state. The movement converting device of the latch switch device 600 may be, for example, a link 630 that is operably coupled to the button 610 so as to be rotated by the button 610. For example, when the link 630 pushes the release pin 650, the release pin 650 may release the first latch device 520 from a locked state to thereby enable operation of the first latch device 520.

As illustrated in FIG. 40, the button 610 may protrude from the upper end of the handle 32 to allow the user to push the button 610 with the thumb while gripping the handle 32 with the other fingers. Other arrangements may also be appropriate. The link 630 may be rotatably embedded in the door 30 and may have, for example, a rod shape, with its two opposite ends extending in different directions perpendicular to each other. As the rotated link 630 pushes the release pin 650, the release pin 650 may push the press piece 522 of the first latch device 520.

The latch switch device 600 may also include a push lever 620 connected to the button 610 so as to be moved along with the button 610 when the button 610 is pushed, thereby rotating the link 630.

The push lever 620, as illustrated in FIG. 41, may include a sliding portion 621 connected to the button 610 and configured to vertically slide within the handle 32, a horizontal extension 622 extending horizontally from an upper end of the sliding portion 621, a vertical extension 623 extending downward from an end of the horizontal extension 622, and a U-shaped link inserting portion 624 protruding from a lower end of the vertical extension 623 such that one end of the link member 630 is inserted into the U-shaped link inserting portion 624. The push lever 620 may also include a protrusion 625 provided at a lower end of the sliding portion 621 and configured to press a spring 626 provided in the handle 32.

The latch switch device 600 may also include a case 680 embedded in the door 30. The link 630 may be rotatably received in the case 680.

The case 680 may include a first case 681 and a second case 682 coupled to face each other, and a third case 683 coupled to one side of the second case 682, the third case 683 being configured to guide rectilinear movement of the release pin 650.

The first case 681 and the second case 682 may include a plurality of fastening holes for attaching the first case 681 and the second case 682 to each other. The second case 682 may also have a fastening hole for coupling the second case 682 to the door 30, and the third case 683 may have a fastening hole for coupling the third case 683 to the second case 682.

The door 30 may contain insulating foam therein and therefore, the case 680 may be sealed to prevent the foam from entering the case 680. The link 630 may be rotatably mounted in the portion of the case 680 constituted by the first case 681 and the second case 682. In particular, the link 630 may be indirectly mounted in the case 680 with two bearing members 631 and 632 interposed therebetween, rather than being directly attached to the case 680. This may reduce friction of the link 630 and facilitate smooth rotation of the link 630.

The latch switch device 600 may also include a spring 660 to return the release pin 650 to an original position thereof.

If a push force applied to the button 610 is removed after the link 630 has pushed the release pin 650 to thereby push the press piece 522, the release pin 650 will be returned to an original position thereof because the link member 630 no longer exhibits rotation force. To this end, the spring 660 may surround the release pin 650. As the spring 660 compressed by the third case 683 is expanded by its elastic force, the spring 660 acts to return the release pin 650 to an original position thereof.

The release pin 650 may include a pin member 651 configured to be rectilinearly moved in the third case 683 and a push member 652 coupled to an end of the pin member 651.

The pin member 651 and the push member 652 may be formed of different materials. In one example, the pin member 651, which performs rectilinear movement, may be formed of plastic, and the push member 652, which acts to push the press piece 522, may be formed of elastic rubber. Other materials may also be appropriate.

The latch switch device 600 may also include a slider 640 slidably mounted in the case 680 to convert rotation of the link 630 into rectilinear movement, thereby transmitting rectilinear movement force to the release pin 650.

To this end, the slider 640 may include a link receiving recess 642 formed in a surface thereof to receive and come into contact with the other end of the link 630, and guide protrusions 644 protruding from opposite lateral surfaces thereof so as to be slidably inserted into guide grooves 684 formed in inner lateral surfaces of the third case 683.

The release pin 650 may be coupled and fixed to the slider 640 so as to move together with the slider 640 when the link 630 pushes the slider 640.

One end of the spring 660 may be supported by an inner surface of the third case 683, and the other end of the spring 660 may be supported by a surface of the slider 640 opposite the link receiving recess 642.

The push lever 620 may include a guider 690 provided at an extension protruding from the upper end of the handle 32 to allow the handle 32 to be attached to the lateral surface of the door 30. The guider 690 may include stepped portions at upper and lower ends thereof to guide vertical movement of the push lever 620 while defining upper and lower limits of the vertical movement.

Hereinafter, operation of the latch switch device will be described with reference to FIGS. 42 and 43.

Figure 42:
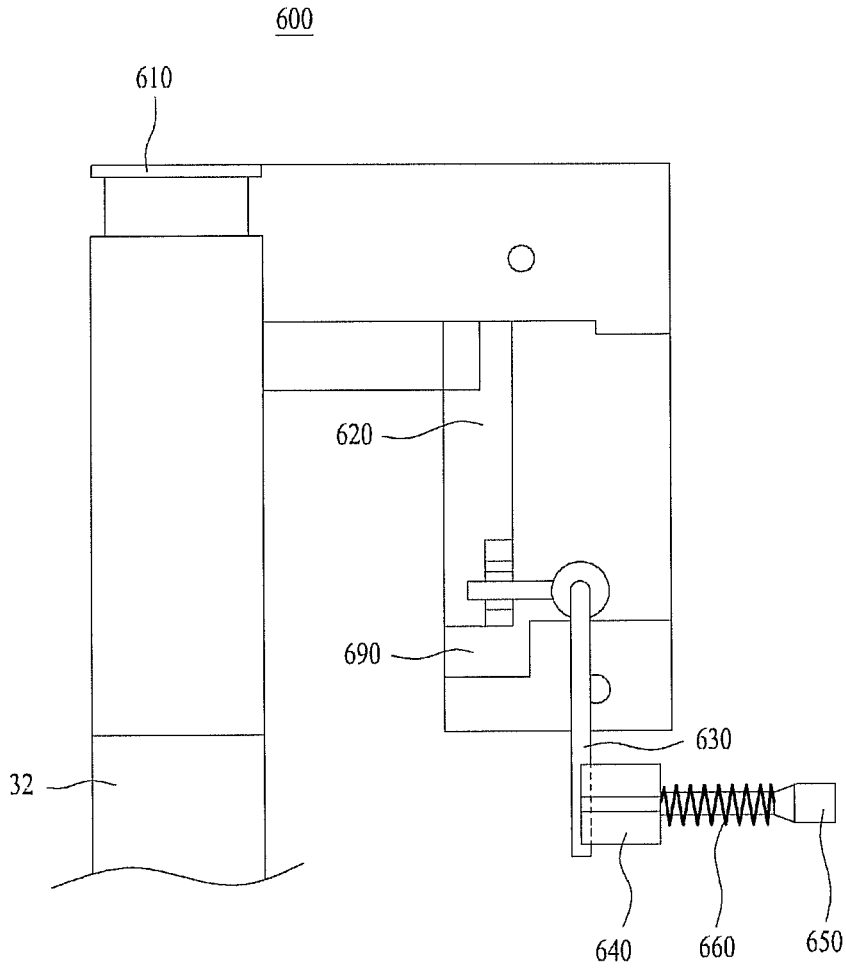
FIGS. 42 and 43 are side views illustrating operation of the latch switch device.

As illustrated in FIG. 42, when the button 610 is not pushed, the button 610 does not push on the push lever 620 and thus, there is no rotation of the link 630, the link 630 does not push the slider 640, and the release pin 650 remains in an initial position in which the release pin 650 protrudes from the inner surface of the door 30. In such a state, the spring 626 applies elastic force to the push lever 620 coupled to the button 610, causing an upper surface of the push lever 620 to come into contact with the stepped portion formed at the upper end of the guider 690, thereby preventing the button 610 coupled to the push lever 620 from being separated upward from a mounting portion thereof. Also, the spring 660 surrounding the release pin 650 pushes the slider 640 toward the link 630 while coming into contact with the inner surface of the third case 683, with the spring 626 below the push lever 620 and the spring 660 between the inner surface of the third case 683 and the slider 640 keeping the link 630 in a rotated initial position.

Figure 43:
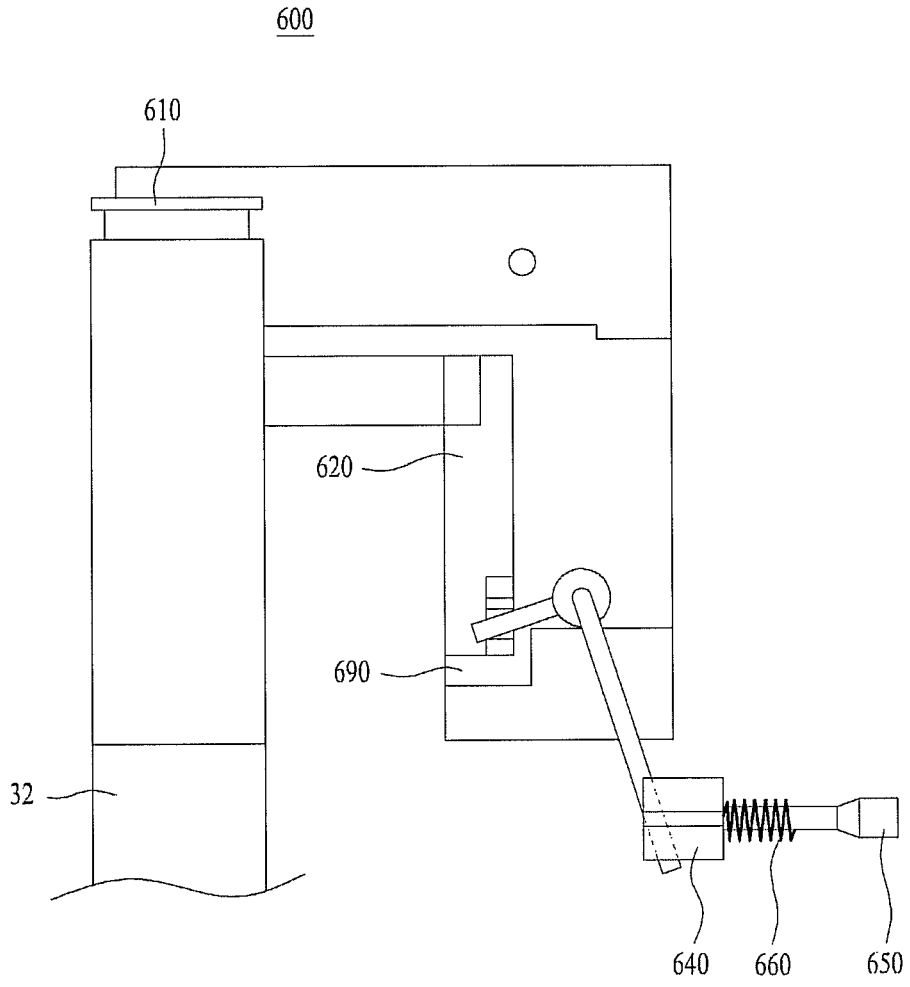

Then, if the user pushes the button 610, as illustrated in FIG. 43, the push lever 620 is moved downward, rotating one end of the link 630 by a predetermined angle. As the other end of the link 630 pushes the slider 640 by a predetermined distance, the spring 660 is compressed against the inner surface of the third case 683 and the release pin 650 coupled to the slider 640 further protrudes from the inner surface of the door 30, thereby pushing the press piece 522 of the first latch device 520.

If the press piece 522 is pushed as described above, the first latch device 520 (and the second latch device 530 coupled thereto by the connector 1500) is released from a locked state, whereby the fixing pin 552 of the fixing member 550 may be separated from the first latch device 520.

Accordingly, if the user pushes the button 610 to release the first latch device 520 from a locked state and thereafter opens the door 30, the fixing member 550 is separated from the first latch device 520. This may allow the storage container 100 to be coupled to the refrigerating compartment 20 and separated from the door 30, thereby causing only the door 30 to be opened.

In an alternative embodiment, the latch switch device 600 may prevent the button 610 from being pushed when the door 30 opens the storage compartment 20.

Specifically, if the button 610 is pushed, connection between the first latch device 520 and the fixing member 550 of the door 30 may be released and the storage container 100 could, in certain circumstances, be unintentionally separated from the rear surface of the door.

Figure 44:
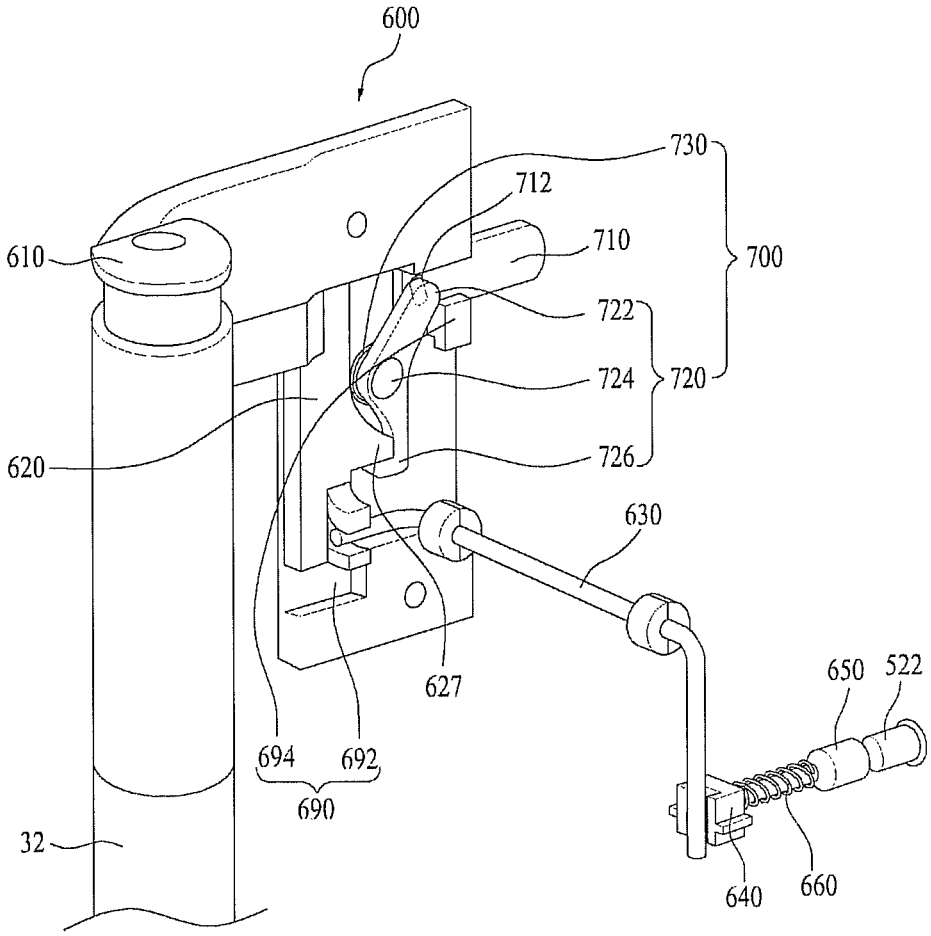
FIG. 44 is a perspective view of the latch switch device and a stopper device.
Figure 45:
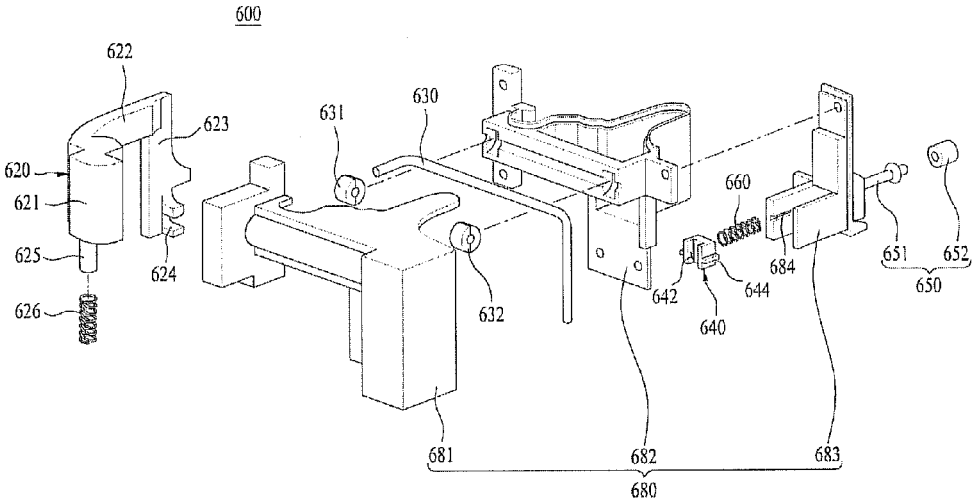
FIG. 45 is an exploded perspective view of the latch switch device.

FIG. 44 is a perspective view of an internal configuration of the alternative embodiment of the latch switch device 600, and FIG. 45 is an exploded perspective view of the alternative embodiment of the latch switch device 600.

As illustrated in FIG. 44, the button 610 may protrude from the upper end of the handle 32, with the link 630 rotatably mounted in the door 30 so as to push the release pin 650 via rotation thereof. As the rotated link member 630 pushes the release pin 650, the release pin 650 pushes the press piece 522 of the first latch device 520 illustrated in FIG. 24. The push lever 620 may be connected to the button 610 so as to move with the button 610 when the button 610 is pushed and rotate the link 630. When the user pushes the button 610, the push lever 620 is moved downward along with the button 610, thereby rotating one end of the link member 630.

The push lever 620, as illustrated in FIG. 45, may include the sliding portion 621 connected to the button 610 and adapted to vertically slide within the handle 32, the horizontal extension 622 horizontally extending from the upper end of the sliding portion 621, the vertical extension 623 extending downward from the end of the horizontal extension 622, and the U-shaped link inserting portion 624 protruding from the lower end of the vertical extension 623 to receive one end of the link 630. The push lever 620 may also include the protrusion 625 provided at the lower end of the sliding portion 621 and configured to press the spring 626 placed in the handle 32. The case 680 of the latch switch device 600 may be embedded in the door 30 and the link 630 may be rotatably received in the case 680.

The case 680, as illustrated in FIG. 45, may include the first case 681, the second case 682, and the third case 683 as described above.

The link 630 may be indirectly rotatably mounted in the portion of the case 680 constituted by the first case 681 and the second case 682 with two bearing members 631 and 632 interposed therebetween, and the spring 660 may return the release pin 650 to an original position thereof.

As described above, the slider 640 may include the link receiving recess 642 and the guide protrusions 644. The release pin 650 may be coupled and fixed to the slider 640 so as to move with the slider 640 when the link 630 pushes the slider 640.

Figure 46:
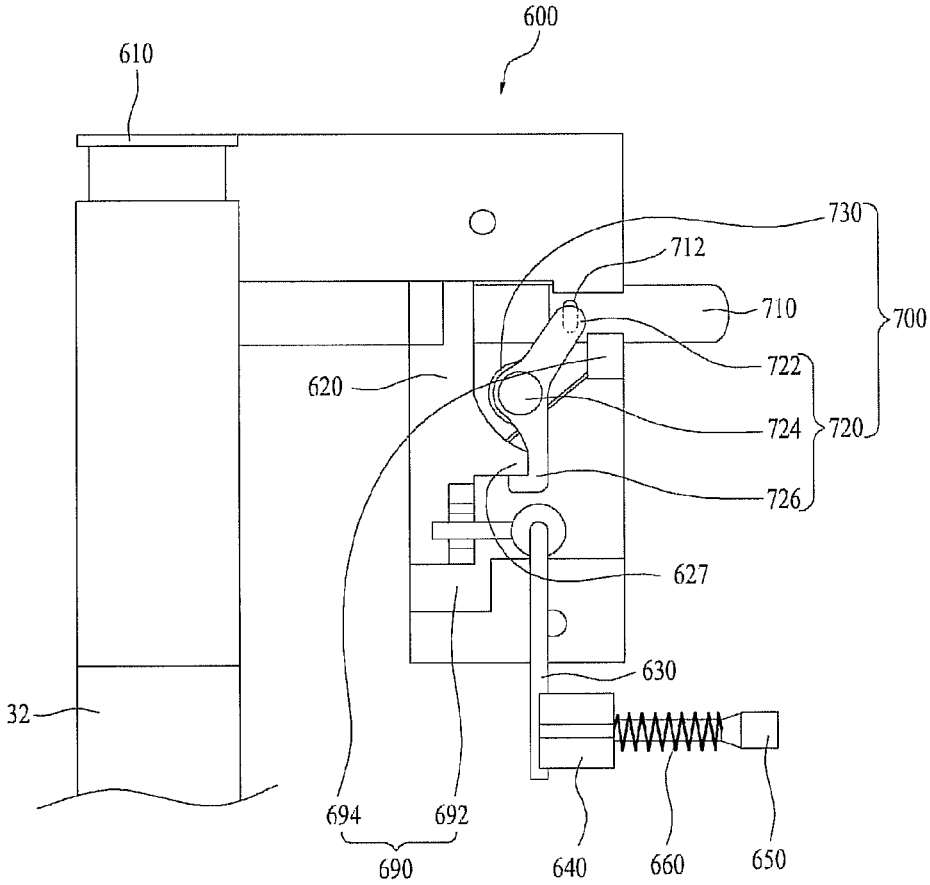
FIGS. 46 and 47 are side views illustrating operation of the latch switch device and the stopper device.

One end of the spring 660 may be supported by the inner surface of the third case 683, and the other end of the spring 660 may be supported by the surface of the slider 640 opposite to the link receiving recess 642. As illustrated in FIG. 46, the push lever 620 may include a guider 690 at the inner surface of the extension of the upper end of the handle 32 to allow the handle 32 to be attached to the lateral surface of the door 30. A left portion of the guider 690 may form a vertically oriented first guide portion 692 having stepped portions at upper and lower ends thereof to guide vertical movement of the push lever 620 while defining upper and lower limits of the vertical movement.

Additionally, a stopper device 700 may be provided. The stopper device 700 may be pushed by the front surface of the refrigerator body 10 when the door 30 is closed, thereby operating the latch switch device 600.

As shown in FIGS. 44 and 46, the stopper device 700 may include a push bar 710 configured to be pushed by the front surface of the refrigerator body 10 when the door 30 is closed, a stopper 720 pivotally linked to the push bar 710 to release the latch switch device 600 from a locked state, and a spring 730 to return the stopper 720 to a locked position thereof.

The push bar 710 may be supported by a second guide portion 694 formed in a right portion of the guider 690. The second guide portion 694 may guide horizontal movement of the push bar 710, allowing the push bar 710 to horizontally slide. The second guide portion 694 may be formed at a lower right corner of the extension of the handle 32 to guide sliding of the push bar 710.

The push bar 710 may protrude from a right end of the extension of the handle 32. The stopper 720 may be connected to the push bar 710 so as to be rotated corresponding to rectilinear movement of the push bar 710. The stopper 720 may contact the push lever 620 of the latch switch device 600 when the push bar 710 is not pushed, i.e. in a state in which the push bar 710 protrudes rearward rather than being moved toward the handle 32, thereby preventing downward movement of the push lever 620.

The spring 730 may be mounted to return the stopper 720 to a locked position thereof. The spring 730 may be, for example, a torsion spring mounted on a pivoting shaft 724 of the stopper 720.

One end of the stopper 720 may be connected to the push bar 710 so as to be rotated via movement of the push bar 710. The other end of the stopper 720 may include a bent portion 726 engaged with a holding protrusion 627 formed at one side of the latch switch device 600 so as to keep the latch switch device 600 in a locked state, thereby preventing inadvertent operation of the latch switch device 600.

The push bar 710 may include a vertically elongated slot 712 that receives a protrusion formed at a connecting portion 722 of the stopper 720 therein. When the push bar 710 performs rectilinear movement, the protrusion formed at the connecting portion 722 of the stopper 720 may be inserted into the elongated slot 712 and moved vertically, thereby enabling rotation of the stopper 720.

The bent portion 726 of the stopper 720 may first extend downward from the pivoting shaft 724 and then be bent leftward.

The push lever 620 may include a laterally protruding holding protrusion 627 so as to be caught by the bent portion 726 of the stopper 720. The holding protrusion 627 is configured so as not to interfere with the stopper 720 except for being caught by the bent portion 726 of the stopper 720 during vertical movement thereof.

Hereinafter, operations of the latch switch device 600 and the stopper device 700, in accordance with embodiments, will be described with reference to FIGS. 46 and 47.

As illustrated in FIG. 46, if the door 30 comes into close contact with the front surface of the refrigerator body 10, the push bar 710 of the stopper device 700 cannot be pushed. Thus, the stopper 720 is kept in an initial position to limit operation of the latch switch device 600. In this case, the holding protrusion 627 of the push lever 620 is engaged with the bent portion 726 of the stopper 720, thereby limiting downward movement of the push lever 620. Accordingly, even if the user attempts to push the button 610, the button 610 cannot be pushed because the push lever 620 coupled to the button 610 cannot be moved downward and the link 630 cannot rotate. As a result, the link 630 does not push the slider 640 and the release pin 650 is kept in its initial position. In such a state, the spring 626 applies upward elastic force to the push lever 620 coupled to the button 610. As the upper surface of the push lever 620 comes into contact with the stepped portion formed at the upper end of the first guide portion 692, upward separation of the button 610 coupled to the push lever 620 may be prevented.

The spring 660 configured to support the release pin 650 may also push the slider 640 toward the link 630 while coming into contact with the inner surface of the third case 683. Thereby, the link 630 may be kept in a rotated initial position by the spring 626 below the push lever 620 and the spring 660 between the inner surface of the third case 683 and the slider 640. Accordingly, in a state in which the door 30 opens the refrigerator body 10, the button 610 is not operated, thus having no effect on operations of the first latch device 520. Assuming that the storage container 100 and the door 30 are connected to each other, consequently, the connection may be stably maintained.

Figure 47:
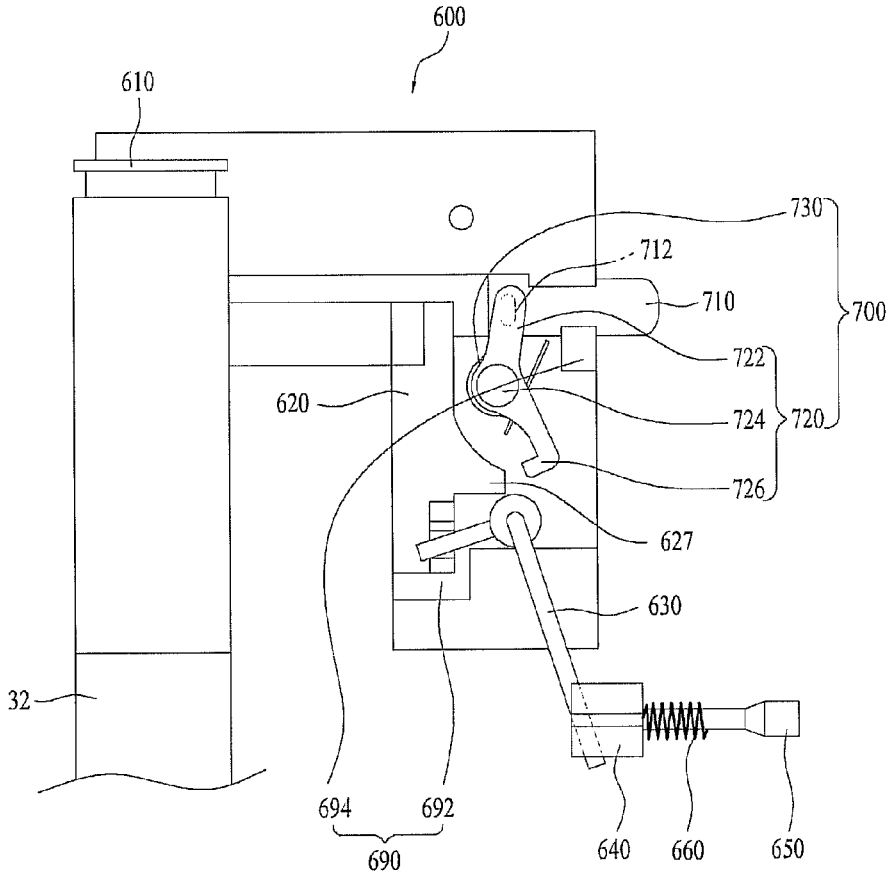

Next, if the door 30 of the refrigerator closes the refrigerator body 10, as illustrated in FIG. 47, the front surface of the refrigerator body 10 pushes the push bar 710, causing the push bar 710 to be moved inward. Thereby, as the stopper 720 is rotated as illustrated, the holding protrusion 627 of the push lever 620 may be moved downward without being caught by the bent portion 726. If the user pushes the button 610 in such a state, as illustrated in FIG. 46, the push lever 620 is moved downward, causing one end of the link 630 to be rotated by a predetermined angle. As the other end of the link 630 pushes the slider 640 by a predetermined distance, the spring 660 is compressed against the inner surface of the third case 683, and the release pin 650 coupled to the slider 640 further protrudes from the rear surface of the door 30, thereby pushing the press piece 522 of the first latch device 520. If the press piece 522 is pushed, as described above, the first latch device 520 is released from a locked state and the fixing pin 552 of the fixing member 550 may be separated from the first latch device 520.

Thus, as the user pushes the button 610 in a closed state of the door 30 to release the first latch device 520 from a locked state and opens the door 30, the first latch device 520 is separated from the fixing member 550. As a result, the storage container 100 is separated from the door 30 while being coupled to the refrigerating compartment 20, whereby only the door 30 is opened.

If push force applied to the button 610 is removed, the spring 626 below the button 610 pushes the push lever 620 and the button 610 upward, returning the push lever 620 and the button 610 to original positions thereof.

Figure 48A:
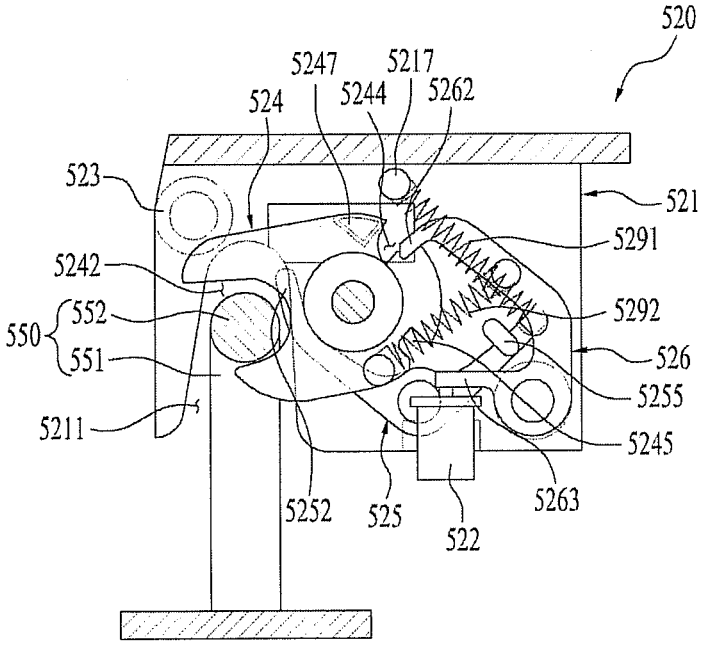
FIGS. 48A and 48B are plan views respectively illustrating coupling between the fixing member and the first latch device and coupling between the fixing member and the second latch device, in accordance with embodiments as broadly described herein.
Figure 48B:
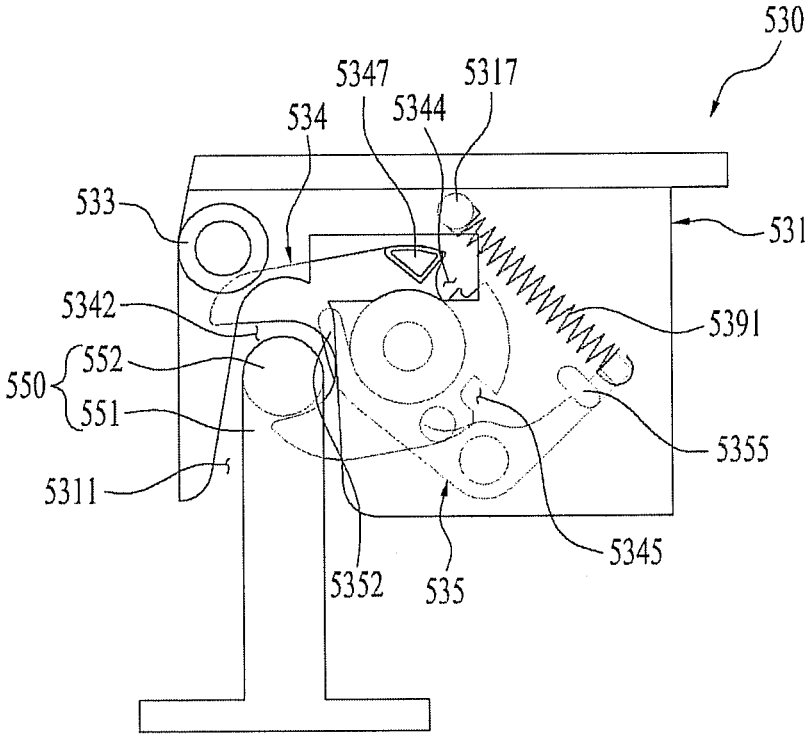

FIG. 48A is a plan sectional view of the first latch device 520 illustrated in FIG. 22, and FIG. 48B is a plan sectional view of the second latch device 530 illustrated in FIG. 27. The first latch device 520 of FIG. 24 and the second latch device 530 of FIG. 27 are separated from each other, rather than connected to each other as illustrated in FIG. 33. Operation of the separated first and second latch devices 520 and 530 will be described.

In FIGS. 48A and 48B, the fixing members 550 are inserted into and supported by the first and second latch devices 520 and 530 to couple the storage container 100 and the door 30.

As illustrated in FIG. 48A, the fixing member 550 is inserted into the insertion guiding recess 5211 of the housing 521. In such a state, the fixing pin 552 of the fixing member 550 is located in the holding recess 5242 and is surrounded by a sidewall of the holding recess 5242. That is, the holding recess 5242 serves as a stopper for the fixing pin 552, thereby preventing the fixing member 550 from being separated from the first latch device 520. In this case, the holding pin 5247 of the holding member 524 is located at the right side of the movement guide recess 5244 so as not to be caught by the holding guide recess, thus releasing the storage container 100 from the refrigerator body 10.

To ensure that the holding member 524 firmly supports the fixing member 550, rotation of the holding member 524 may be prevented. To this end, the insert piece 5262 provided at the movement guider 526 is inserted into the first insertion recess 5244 of the holding member 524, preventing rotation of the holding member 524.

Meanwhile, the first extension 5252 of the rotation limiter 525 is pushed by the fixing pin 552 of the fixing member 550, thereby being moved rearward from the insertion guide recess 5211 and completely rotating the rotation limiter 525.

FIG. 48B illustrates a state in which the fixing member 550 is inserted into the insertion guide recess 5311 of the housing 531 of the second latch device 530. In such a state, the fixing pin 552 of the fixing member 550 is located in the holding recess 5342 and is surrounded by a sidewall of the holding recess 5342. That is, the holding recess 5342 serves as a stopper for the fixing pin 552, thereby preventing the fixing member 550 from being separated from the second latch device 530. In this case, the holding pin 5347 of the holding member 534 is located at the right side of the movement guide recess 5344 so as not to be caught by the holding guide recess 122, thus releasing the storage container 100 from the refrigerator body 10.

Meanwhile, the first extension 5352 of the rotation limiter 535 is pushed by the fixing pin 552 of the fixing member 550, thereby being moved rearward from the insertion guide recess 5311 and completely rotating the rotation limiter 535.

Figure 49:
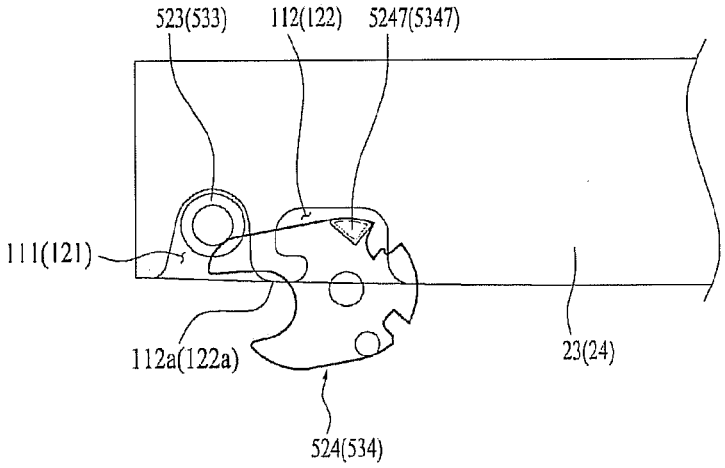
FIG. 49 is a plan view of a position of a holding member shown in FIGS. 48A-48B.

Positions of the holding members 524 and 534 of the first and second latch devices 520 and 530 in FIG. 49 are the same as those of the holding members 524 and 534 shown in FIGS. 48A and 48B. In the arrangement shown in FIG. 49, the door 30 continuously closes the storage compartment 20 of the refrigerator body 10. In this case, the holding pins 5247 and 5347 of the holding members 524 and 534 are located at the right side of the holding guide recesses 112 and 122 to prevent the holding pins 5247 and 5347 from being caught by the holding guide recesses 112 and 122. Meanwhile, the stoppers 523 and 533 are located in the stopper recesses 111 and 121 which surround the rear and lateral sides of the stoppers 523 and 533.

If the user pulls the door 30 in a state in which the door 30 and the storage container 100 are coupled to each other, the door 30 and the storage container 100 are simultaneously rotated forward, thereby opening the storage compartment 20. Since the holding pins 5247 and 5347 are located at the right side of the holding guide recesses 112 and 122 and the holding guide recesses 112 and 122 are open forward, the holding pins 5247 and 5347 may be freely moved without being caught by the holding guide recesses 112 and 122 even if the holding pins 5247 and 5347 are moved forward along with the door 30 and the storage container 100.

Figure 50A:
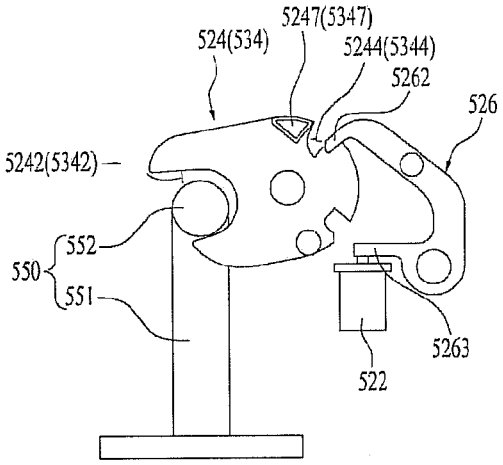
FIGS. 50A and 50B are plan sectional views illustrating a relationship between the fixing member and the first or second latch device and a relationship between the fixing member and the first or second guide support device shown in FIGS. 48A-48B.

As illustrated in FIG. 50A, the holding members 524 and 534 of the first and second latch devices 520 and 530 catch the fixing members 550. The holding recesses 5242 and 5342 of the holding members 524 and 534 surround the fixing pins 552 of the fixing members 550, preventing separation of the fixing members 550, so that the door 30 and the storage container 100 may be coupled to each other. The movement guider 526 is moved when pushed by the press piece 522. The press piece 522 is provided only at the first latch device 520 and therefore, in this embodiment only the first latch device 520 includes the movement guider 526. The insert piece 5262 of the movement guider 526 is inserted into the first insertion recess 5244, preventing rotation of the holding member 524.

The contact piece 5263 provided at the movement guider 526 continuously comes into contact with the press piece 522. Thus, when the press piece 522 is moved forward, the contact piece 5263 is rotatable, and thus capable of rotating the holding member 524.

Figure 50B:
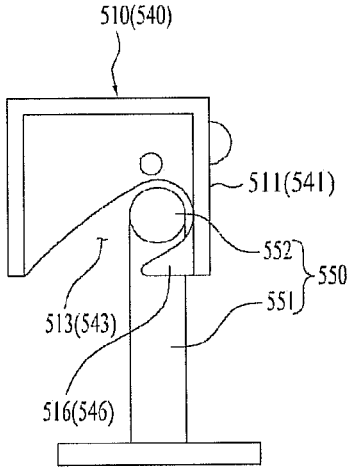

As illustrated in FIG. 50B, the fixing members 550 are also inserted into the first and second guide support devices 510 and 540. The insertion guide recesses 513 and 543 provided at the first and second guide support devices 510 and 540 are diagonally formed to guide movement of the fixing pins 552 of the fixing members 550.

If the fixing pins 552 reach rearmost positions of the insert guide recesses 513 and 514, front ends of the fixing pins 552 are caught by holding protrusions 516 and 546 of the housings 551 and 541, preventing the fixing pins 552 from being separated forward rather than being separated diagonally.

Figure 51A:
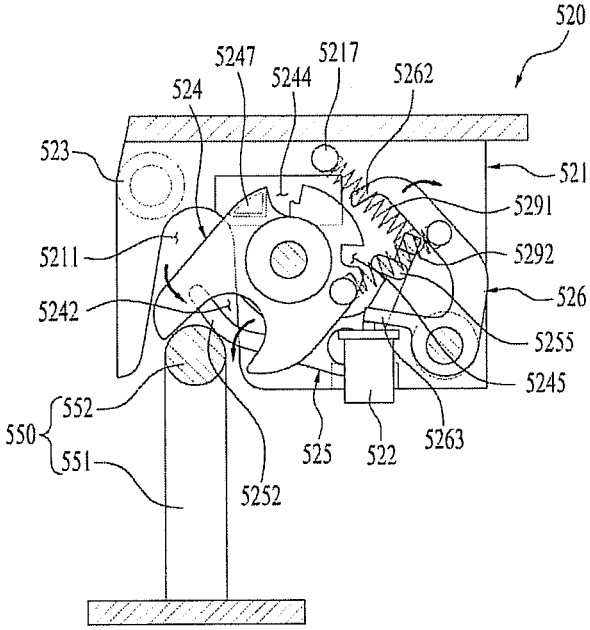
FIGS. 51A and 51B are plan views illustrating separation between the first latch device and the fixing member, in accordance with embodiments as broadly described herein.
Figure 51B:
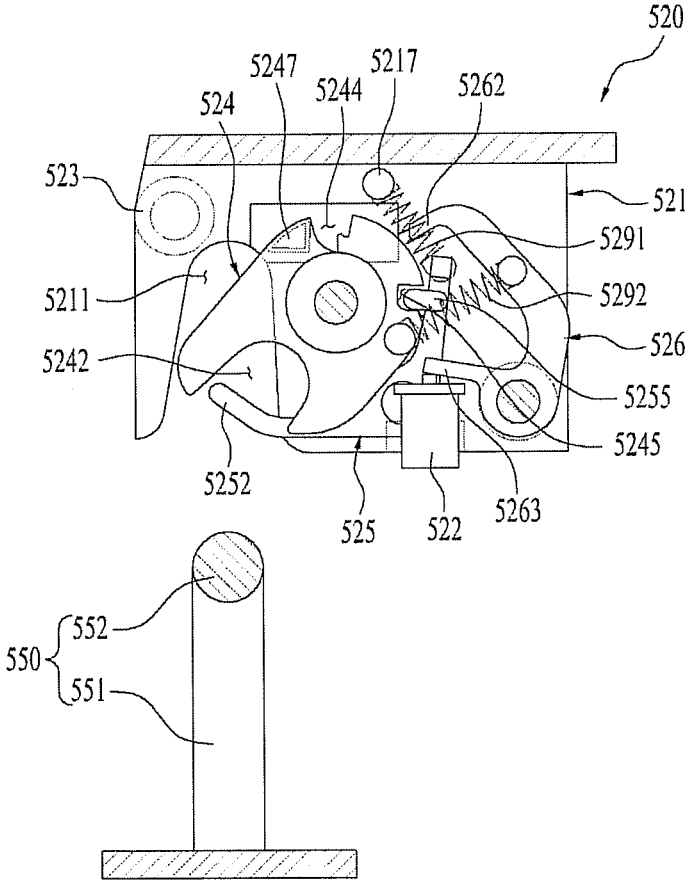

FIG. 51A illustrates a separation of the fixing member 550 from the first latch device 520, and FIG. 51B illustrates complete separation of the fixing member 550 from the first latch device 520.

If the user pushes the button 610 provided at the handle 32, the release pin 650 is moved rearward via operation of the internal link structure. As illustrated in FIGS. 51A and 51B, the press piece 522 is moved into the housing 521 by the release pin 650, pressing on the extension 5263 of the movement guider 526. If the press piece 522 is pressed, the movement guider 526 is rotated, for example, clockwise as shown in this example. This separates the insert piece 5263 from the first insertion recess 5244 of the holding member 524. Since the holding member 524 is connected to the movement guider 526 via the second elastic member 5292, if the movement guider 526 is rotated clockwise, the holding member 524 is pulled by the movement guider 526 and rotated counterclockwise. Through rotation of the holding member 524, the holding recess 5242, which has been oriented to face laterally, is oriented to face forward, allowing the holding pin 552 to be released from the holding recess 5242 and be moved forward.

If the holding member 524 is rotated counterclockwise, the holding pin 5247 is moved leftward of the movement guide recess 5244 and the holding pin 5247 is moved leftward of the holding guide recess 112 and is surrounded by the stepped portion 112*a* of the expanded recess of the holding guide recess 112. Meanwhile, the first extension 5252 of the rotation limiter 525 comes into contact with the fixing pin 552 of the fixing member 550. The rotation limiter 525 is connected to the first elastic member 5291, which is connected to the second extension 5292 and provides elastic force to pull the second extension 5292 so that the rotation limiter 525 tends to be rotated counterclockwise. Accordingly, if the fixing member 550 is released from the holding member 524, as the rotation limiter 525 is rotated counterclockwise, the first extension 5252 pushes the fixing pin 552 forward.

If the user pulls the door 30 forward in such a state, the fixing member 550 is separated forward from the insertion guide recess 5211. Then, after the fixing member 550 is completely separated from the latch device 520, the rotation limiter 525 is further rotated counterclockwise, causing the insert piece 5255 provided at the rotation limiter 525 to be inserted into the second insertion recess 5245 provided at the holding member 524, thus preventing further rotation of the holding member 524.

In this way, the storage container 100 is separated from the door 30 and is located in the refrigerator body 10. If the user opens the door 30, the front surface of the storage container 100 is exposed, which allows the user to put storage items into or remove the storage items from the storage container 100.

As compared to the first latch device 520, the second latch device 530 does not necessarily include a component corresponding to the movement guider 526, but may exhibit similar coupling/separating operation of the holding member and the fixing member. Thus, separation between the second latch device 530 and the fixing member 550 may be replaced by the above description with respect to separation between the first latch device 520 and the fixing member 550.

Figure 52:
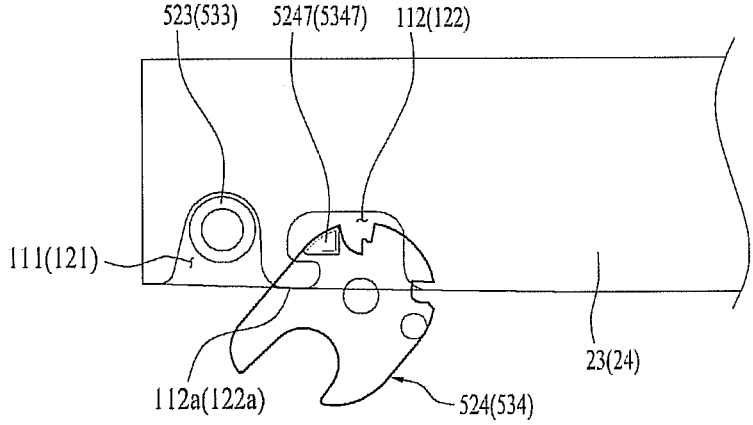
FIG. 52 is a plan view illustrating a position of the holding member shown in FIGS. 51A-51B.

Positions of the holding members 524 and 534 of the first and second latch devices 520 and 530 illustrated in FIG. 52 are the same as those of the holding members 524 and 534 of FIGS. 51A and 51B. In this embodiment, the door 30 is opened and the storage container 100 is located at the entrance of the storage compartment 20.

In this case, the holding pins 5247 and 5347 of the holding members 524 and 534 are located in the expanded recesses located at the left side of the holding guide recesses 112 and 122 and are also located close to the stepped portions 112*a* and 122*a* formed at front rims of the expanded recesses. This arrangement limits forward movement of the holding pins 5247 and 5347. The stoppers 523 and 533 are located in the stopper recesses 111 and 121 which surround the rear and lateral sides of the stoppers 523 and 533. If the user pulls the door 30 in a state in which the door 30 and the storage container 100 are coupled to each other, only the door 30 is rotated forward, thereby opening the storage container 100.

The holding pins 5247 and 5347 are located in the expanded recesses provided at the left side of the holding guide recesses 112 and 122. Since the front side of the expanded recesses is closed by the stepped portions 112*a* and 122*a*, the holding pins 5247 and 5347 are caught by the stepped portions 112*a* and 122*a* even if the door 30 is opened forward, which prevents forward movement of the holding pins 5247 and 5347.

Figure 53A:
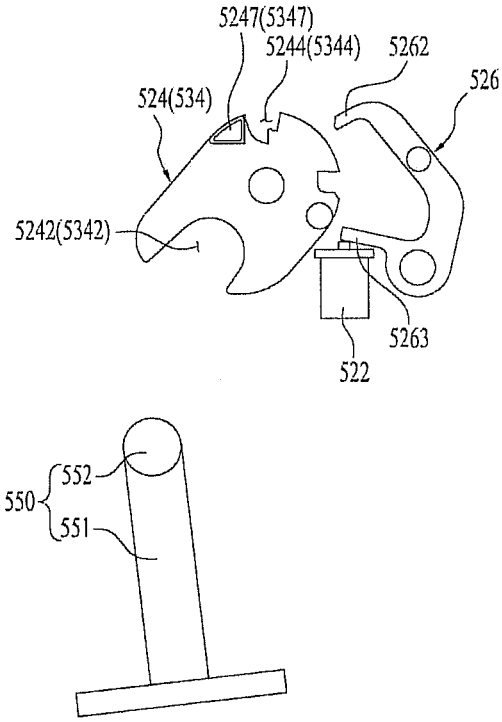
FIGS. 53A and 53B are plan sectional views illustrating a relationship between the fixing member and the first or second latch device and a relationship between the fixing member and the first or second guide support device shown in FIGS. 51A-51B.

As illustrated in FIG. 53A, the holding members 524 and 534 of the first and second latch devices 520 and 530 are separated from the fixing members 550. The holding recesses 5242 and 5342 of the holding members 524 and 534 are oriented to face forward. Thus, the holding recesses 5242 and 5342 no longer surround the fixing pins 552 of the fixing members 550, allowing the fixing members 550 to be separated forward and the door 30 to be separated from the storage container 100.

The movement guider 526 is moved when pressed by the press piece 522. Since the press piece 522 is provided only at the first latch device 520 in this embodiment, it is noted that only at the first latch device 520 makes use of the movement guider 526. The insert piece 5262 of the movement guider 526 is separated from the first insertion recess 5244, guiding rotation of the holding member 524. The contact piece 5263 provided at the movement guider 526 continuously comes into contact with the press piece 522. Thus, the contact piece 5263 may be rotated as the press piece 522 is moved forward, thereby being capable of causing rotation of the holding member 524.

Figure 53B:
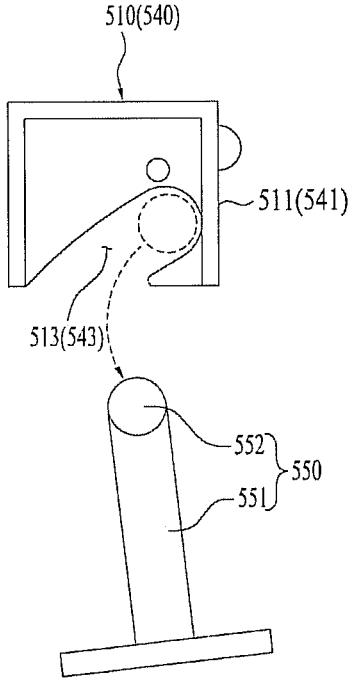

As illustrated in FIG. 53B, the fixing members 550 are separated from the first and second guide devices 510 and 540. The insertion guide recesses 513 and 543 provided at the first and second guide support devices 510 and 540 are diagonally formed to guide separation of the fixing pins 552 of the fixing members 550. Since the fixing members 550 arranged adjacent to the first and second guide support devices 510 and 540 are rotated along the curvilinear trace, the fixing members 550 may be moved forward under guidance of the diagonally formed insertion guide recesses 513 and 543, and the first and second guide support devices 510 and 540 may be separated from the fixing members 550.

Although a separation sequence between the storage container 100 and the door 30 has been described above, it will be appreciated that recoupling between the storage container 100 and the door 30 may be performed in a reverse order.

As described above, coupling and separation between the first latch device 520 and the fixing member 550 is substantially similar to coupling and separation between the second latch device 530 and the fixing member 550 and thus, a description with respect to the second latch device 530 may be replaced by the above description with respect to the first latch device 520.

That is, as illustrated in FIG. 51B, if the user pushes the door 30 in a state in which the fixing member 550 and the first latch device 520 are separated from each other, the fixing member 550 is inserted into the first latch device 520 as illustrated in FIG. 51A. The fixing member 550 is inserted into the insertion guide recess 5211, pushing the first extension 5252 of the rotation limiter 525 rearward. As the rotation limiter 525 rotates (clockwise), the insert piece 5255 of the rotation limiter 525 is separated from the second insertion recess 5245 of the holding member 524, rotating the holding member 524 (clockwise). The fixing pin 552 of the fixing member 550 is introduced into the holding recess 5242, pushing the holding recess 5242 rearward and causing the holding member 524 to be rotated (clockwise). If the holding member 524 is rotated (clockwise), the movement guider 526 connected to the holding member 524 via the second elastic member 5292 is pulled and rotated (counterclockwise). Accordingly, the insert piece 5262 of the movement guider 526 is located close to the first insertion recess 5244.

After the fixing member 550 is completely introduced, the holding recess 5242 of the holding member 524 is oriented to face laterally, so as to surround the fixing pin 552, and the insert piece 5262 of the movement guider 526 is inserted into the first insertion recess 5244, thereby limiting rotation of the holding member 524, with the fixing member 550 completely caught by the holding member 524 to prevent forward separation of the fixing member 550.

FIGS. 48 and 53 relate to operations of the first latch device 520 illustrated in FIG. 22 and the second latch device 530 illustrated in FIG. 25. In the case of the first and second latch devices 520 and 530 connected to each other as illustrated in FIG. 33, operation of the first and second latch devices 510 and 520 is substantially the same as that of the first latch device 520 of FIG. 24. Thus, a description with respect to the first and second latch devices 520 and 530 illustrated in FIG. 33 may be replaced by the above description of FIGS. 48 and 53 with respect to the first latch device 520 illustrated in FIG. 24.

Figure 54:
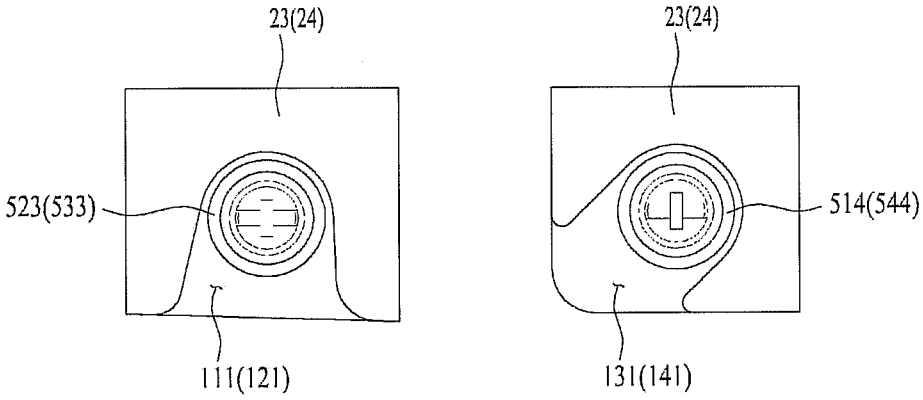
FIG. 54 is a view illustrating the case in which a stopper is inserted into a stopper recess, in accordance with embodiments as broadly described herein.

As illustrated in FIG. 54, in a state in which the storage container 100 is located in the storage compartment 20, the stoppers 523 and 524 of the first and second latch devices 520 and 530 are located respectively in the stopper recesses 111 and 121 formed in an entrance 24 of the storage compartment 20 or in the upper surface of the shelf 23. Also, the stoppers 514 and 544 provided at the first and second guide support devices 510 and 540 are located respectively in the stopper recesses 131 and 141 provided at the entrance 24 of the storage compartment 20 or in the upper surface of the shelf 23.

The stopper recesses 111 and 121, into which the stoppers 523 and 533 of the first and second latch devices 520 and 530 are inserted, and the stopper recesses 131 and 141, into which the stoppers 514 and 544 provided at the first and second guide support devices 510 and 540 are inserted, have different shapes. This is because when the storage container 100 coupled to the door 30 is rotated, the storage container 100 exhibits a slightly curvilinear pivotal rotating trace at a region close to the hinge 13 of the door 30, but exhibits a substantially rectilinear rotating race at a region distant from the hinge 13. Therefore, the stopper recesses 111 and 121, into which the stoppers 523 and 533 of the first and second latch devices 520 and 530 are inserted, have open front ends facing forward and tapered with increasing distance from the open front ends.

However, the stopper recesses 131 and 141, into which the stoppers 514 and 544 provided at the first and second guide support devices 510 and 540 are inserted, are diagonally formed to correspond to the curvilinear trace and entrances thereof are also oriented to face diagonally.

The stoppers 523 and 524 of the first and second latch devices 520 and 530 and the stoppers 514 and 544 of the first and second guide support devices 510 and 540 may have a substantially circular cross section. Also, the stopper recesses 111, 121, 131 and 141 have a curvilinear rear shape to correspond to the stoppers 523 and 524 provided at the first and second latch devices 520 and 530 and the stoppers 514 and 544 provided at the first and second guide support devices 510 and 540.

Of course, it will be appreciated that the rear shape of the stopper recesses 111, 121, 131 and 141 may be changed according to the shapes of the stoppers 523 and 524 of the first and second latch devices 520 and 530 and the stoppers 514 and 544 of the first and second guide support devices 510 and 540.

Figure 55:
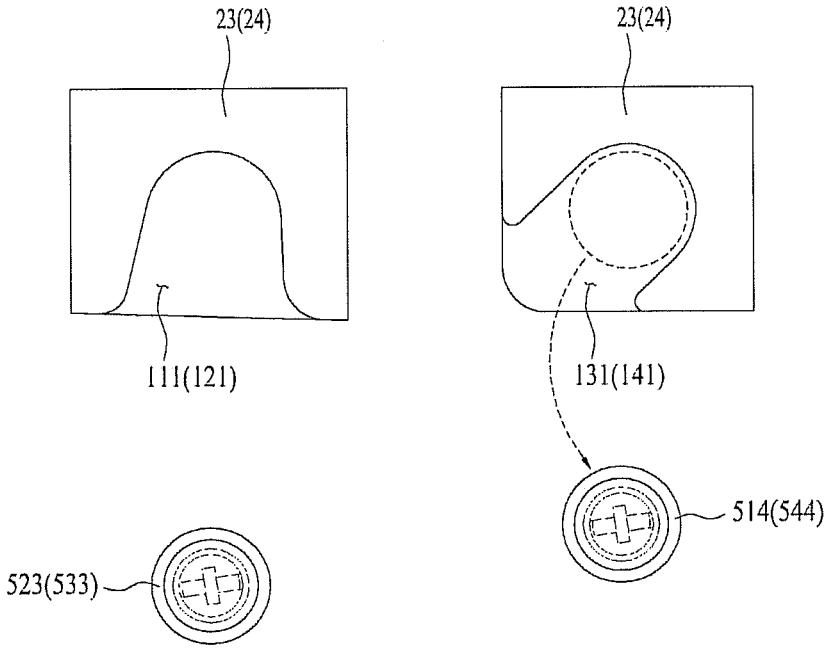
FIG. 55 is a view illustrating the case in which the stopper is separated from the stopper recess, in accordance with embodiments as broadly described herein.

Through the above described configuration, in a state in which the door 30 and the storage container 100 are coupled to each other, if the door 30 is closed as illustrated in FIG. 55, the storage container 100 is located at the entrance of the storage compartment when the door 30 is pushed. In this case, the stoppers 523 and 524 of the first and second latch devices 520 and 530 and the stoppers 514 and 544 of the first and second guide support devices 510 and 540 are inserted respectively into and caught by the stopper recesses 111, 121, 131 and 141 as illustrated in FIG. 55. The stoppers 523 and 524 of the first and second latch devices 520 and 530 and the stoppers 514 and 544 of the first and second guide support devices 510 and 540 may be prevented from being further pushed into the storage compartment 20, thus preventing the storage container 100 from being introduced into the storage compartment 20 beyond a predetermined depth.

Figure 56:
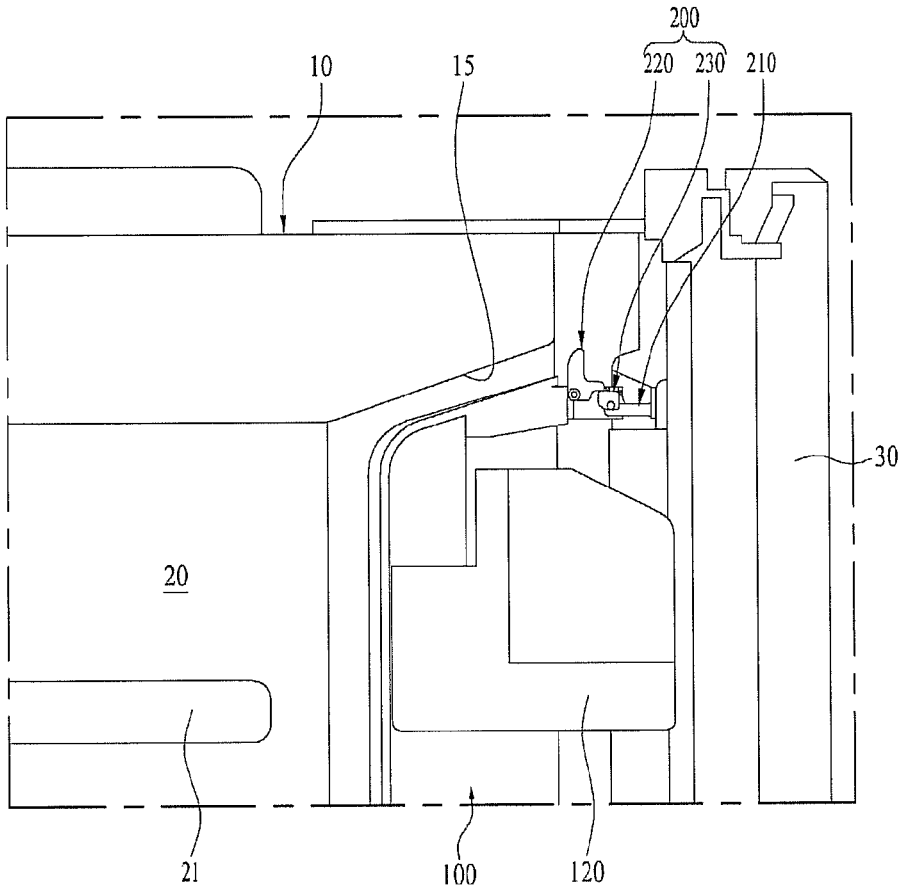
FIG. 56 is a side sectional view illustrating a state in which the door and the storage container are connected to each other via coupling between the fixing device provided at the door and the storage container support device provided at the storage container.

As illustrated in FIG. 56, if the door 30 is pulled forward in a state in which the door 30 and the storage container 100 are coupled to each other via the first and second latch devices 520 and 530, the pivoting member 220 of the connection support device 200, which comes into contact with the upper inclined surface 15 of the storage compartment 20, is separated from the inclined surface 15. Accordingly, since the pivoting member 220 no longer presses the connecting member 230, the connecting member 230 is caught by the fixing device 210.

In this manner, the storage container 100, at which the connection support device 200 is provided, is connected to the door as the connection support device 200 is caught by the fixing device 210 of the door 30, thereby being continuously placed at the rear surface of the door 30. In this way, the connection support device 200 and the first and second latch devices 520 and 530 may stably maintain coupling or connection between the door 30 and the storage container 100. As a result, if the door 30 is pivotally rotated, the storage container 100 may be moved along with the door 30 without a risk of being separated from the door 30.

Since the storage compartment 20 is opened if the door 30 is opened in a state in which coupling or connection between the storage container 100 and the door 30 is maintained, the user can put storage items into or remove the storage items from the storage compartment 20.

Figure 57:
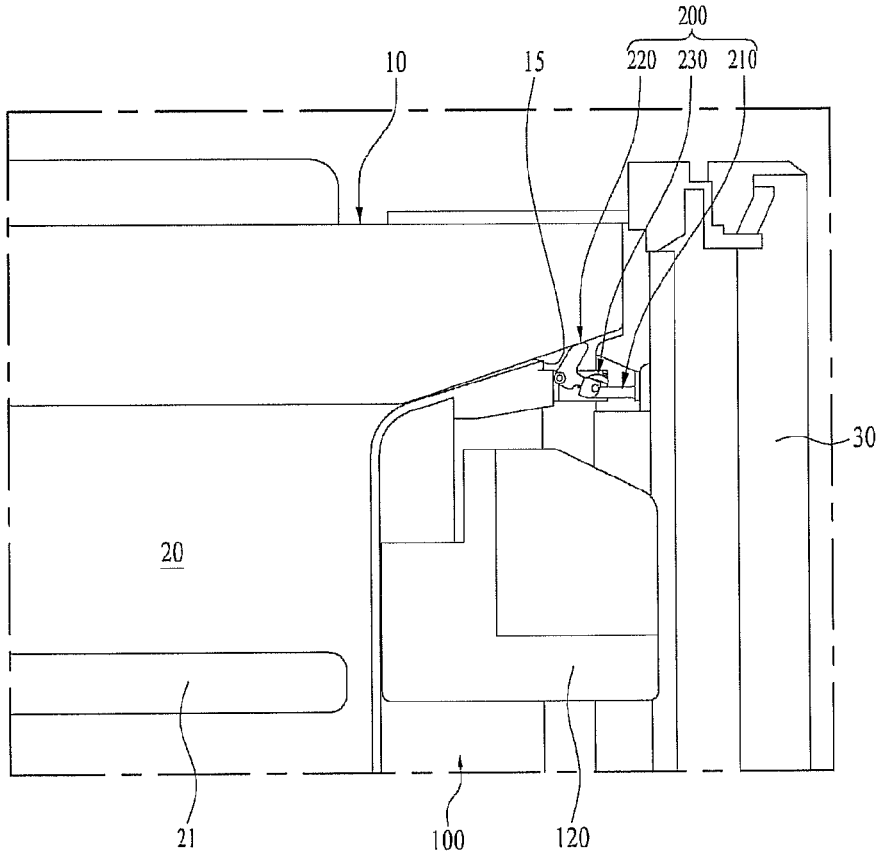
FIG. 57 is a side sectional view illustrating a state in which the door and the storage container are separated from each other via separation between the fixing device provided at the door and the storage container support device provided at the storage container.

Meanwhile, as illustrated in FIG. 57, if the door 30 closes the storage compartment 20 in a state in which the door 30 and the storage container 100 are coupled to each other or separated from each other via the first and second latch devices 520 and 530, the pivoting member 220 of the connection support device 200 comes into contact with the upper inclined surface 15 of the storage compartment 20.

As the pivoting member 200 is rotated forward or downward so as to press the connecting member 230, the connecting member 230 is rotated rearward or upward.

In this way, connection between the connecting member 230 and the fixing device 210 is released.

In particular, if the connection support device 200 is disconnected from the fixing device 210 in a state in which the first and second latch devices 520 and 530 are separated from the door 30 and are connected to the refrigerator body 10, the storage container 100 is completely disconnected from the door 30. Thus, if the door 30 is rotated, only the door 30 is moved, while the storage container 100 remains in the storage compartment 20. This causes the front surface of the storage container 100 to be exposed. Therefore, the user can access to the front surface of the storage container 100 so as to put storage items into or remove the storage items from the storage container 100.

As described above, the storage container support device may include the connection support device 200, the first and second latch devices 520 and 530, and the first and second guide support devices 510 and 540.

Additionally, as described above, during the first operation of the storage container support device, the door 30 and the storage container 100 are connected to each other so as to be rotated together as shown in FIGS. 2 and 3B. In this case, the storage compartment 20 is opened, providing access to the user.

Meanwhile, during the second operation of the storage container support device, the storage container 100 is separated from the door 10 and is connected to the refrigerator body 10. If the door 30 is opened, the front surface of the storage container 100 is exposed to provide access to the user, as shown in FIGS. 2 and 3C.

The first and second latch devices 520 and 530 may be continuously connected to the fixing members 550 of the door 30 during the first operation of the storage container support device.

Also, the fixing members 550 may be inserted into and supported by the first and second guide support devices 510 and 540 during the first operation of the storage container support device.

In a state in which the door 30 opens the storage compartment 20 during the first operation of the storage container support device, the connection support device 200 may be connected to the fixing device 210 provided at the door 30.

Meanwhile, the storage container 100 is separated from the door 30 and is connected to the refrigerator body 10 during the second operation of the storage container support device.

In this case, the storage container 100 is continuously located at the entrance of the storage compartment 20 defined in the refrigerator body 10 even if the door 30 is rotated, thereby being continuously positioned in the storage compartment 20.

During the second operation of the storage container support device, the first and second latch devices 520 and 530 may be separated from the fixing members 550 of the door 30 and caught by the holding guide recesses 112 and 122 formed at the entrance of the storage compartment 20.

Also, during the second operation of the storage container support device, although the fixing members 550 may be inserted into the first and second guide support devices 510 and 540, the fixing members 500 are not necessarily kept in the inserted positions, but are separated from the first and second guide support devices 510 and 540 when the door 30 is opened.

In a state in which the door 30 opens the storage compartment during the second operation of the storage container support device, the connection support device 200 is not connected to the fixing device 210 provided at the door 30.

A refrigerator is provided in which a storage container may be selectively detachably coupled and supported between a refrigerator body and a door, instead of providing the door with a separate storage container door.

In a refrigerator as embodied and broadly described herein, only a main door is provided without an auxiliary door. This may reduce loss of cold air as well as power consumption as compared to the case of using two gaskets and two heaters.

Further, a storage container detachably coupled to and supported by a rear surface of the single door or a refrigerator body, as embodied and broadly described herein may improve convenience in use.

In a refrigerator in accordance with embodiments as broadly described herein, when a user attempts to put storage items into or remove the storage items from the storage container in a state in which the storage container is coupled to a storage compartment defined in the refrigerator body, the storage container may serve hermetically seal a front opening of the storage compartment, which may prevent loss of cold air.

A latch device as embodied and broadly described herein may be configured to be operated by a button, and may be operated to realize coupling or separation between the door and the storage container. That is, if a user pulls the door without pushing the button in order to access to the storage compartment, the latch device may couple the storage container to the door, thereby allowing both the storage container and the door to be moved together so as to open the storage compartment.

On the contrary, if the user pulls the door in a state of pushing the button in order to access to the storage compartment, the latch device may separate the storage container from the door, thereby allowing the storage to be coupled to an entrance of the storage compartment so as to be opened.

A latch device as embodied and broadly described herein may include a holding member, a movement guider to move the holding member, and a pivotal rotation limiter to limit pivotal rotation of the holding member when the holding member is separated from a fixing member provided at the door. With this configuration, the storage container may be more accurately and rapidly coupled to the door or the refrigerator body via operation of the latch device.

In a refrigerator as embodied and broadly described herein, a connection support device may connect the storage container and the door to each other or release the connection, providing more stable coupling between the storage container and the door may be accomplished.

Furthermore, since the storage container may be stably supported by the refrigerator body rather than being mounted to the door when the user puts storage items into or remove the storage items from the storage container, shaking of the storage items due to rotation of the door may be prevented.

The storage container may be provided independently of the storage compartment regardless of a mounted position thereof. Accordingly, the storage container may serve as an auxiliary storage compartment to allow the user to easily remove items therefrom when opening the door, which increases convenience in use of the refrigerator.

Any reference in this specification to "one embodiment," "an embodiment," "example embodiment," etc., means that a particular feature, structure, or characteristic described in connection with the embodiment is included in at least one embodiment of the invention. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Any reference in this specification to "one embodiment," "an embodiment," "example embodiment," etc., means that a particular feature, structure, or characteristic described in connection with the embodiment is included in at least one embodiment of the invention. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

What is claimed is:

1. A latch provided on a first member and configured to selectively engage and disengage a hook provided on a second member and to selectively disengage and engage a plurality of recesses formed in a third member, the latch comprising:

a housing;

a holding device rotatably installed in the housing and configured to selectively engage a hook;

a rotation limiter installed in the housing to limit rotation of the holding device;

a movement guide to guide movement of the holding device;

guide recesses formed at a top and at a bottom of the housing to guide movement of the hook into and out of the housing for engagement and disengagement of the hook and the holding device; and an actuator operably coupled to the holding device via the movement guide to selectively press and rotate the holding device to respectively release and engage the hook, wherein the third member is a cabinet, the second member is a door rotatably coupled to the cabinet, and the first member is a storage container that is selectively coupled to the door in the first mode, and to the cabinet in the second mode wherein the latch engages the first member with the second member while the latch disengages the first member from the third member, and wherein the latch engages the first member with the third member while the latch disengages the first member from the second member.

2. The latch of claim 1, further comprising a stopper that extends downward from the bottom of the housing and is received in a stopper recess formed in the third member to limit a position of the first member relative to the third member.

3. The latch of claim 2, further comprising a pin that extends downward from a bottom of the holding device and through the bottom of the housing and is received in a pin recess formed in the third member to couple the first member to the third member.

4. The latch of claim 3, further comprising a movement guide recess formed in the bottom of the housing to guide movement of the pin as the pin moves together with the holding device.

5. The latch of claim 3, wherein the holding device is engaged with the hook to couple the first member to the second member in a first mode, and the holding device is disengaged from the hook with the stopper received in the stopper recess and the pin received in the pin recess to couple the first member to the third member in a second mode.

6. The latch of claim 1, further comprising:

a first shaft that extends into the housing through a first insertion hole formed in the bottom of the housing to rotatably support the holding device;

a second shaft that extends into the housing through a second insertion hole formed in the bottom of the housing to rotatably support the rotation limiter; and a third shaft that extends into the housing through a third insertion hole formed in the bottom of the housing to rotatably support the movement guide.

7. The latch of claim 6, further comprising:

upper and lower first bosses respectively installed at upper and lower sides of the holding device surrounding the first shaft so as to maintain a predetermined distance between the upper and lower sides of the holding device and corresponding interior sides of the housing;

upper and lower second bosses respectively installed at upper and lower sides of the rotation limiter so as to maintain a predetermined distance between the upper and lower sides of the rotation limiter and corresponding interior sides of the housing; and upper and lower third bosses respectively installed at upper and lower sides of the movement guide so as to maintain a predetermined distance between the upper and lower sides of the movement guide and corresponding interior sides of the housing.

8. The latch of claim 1, wherein the holding device comprises:

a first body;

a holding recess formed in a peripheral portion of the first body and configured to selectively engage and disengage the hook;

first and second insertion recesses formed in peripheral portions of the first body, opposite the holding recess;

a first shaft hole that extends through the first body to receive a first shaft therethrough that rotatably couples the holding device in the housing of the latch;

a pin that extends downward from a bottom of the first body; and a first holding protrusion that extends upward from a top of the first body.

9. The latch of claim 8, wherein the rotation limiter comprises:

a second body having a first extension extending outward in a first direction from a central portion thereof and a second extension extending outward in a second direction from the central portion thereof;

a second shaft hole that extends through the second body to receive a second shaft therethrough that rotatably couples the rotation limiter in the housing of the latch;

a second holding protrusion formed at a distal end of the second extension;

an insertion protrusion extending upward from an upper surface of the second extension and selectively received in the second insertion recess formed in the first body of the holding device to selectively limit rotation of the holding device.

10. The latch of claim 9, wherein the movement guide comprises:

a third body;

a third shaft hole extending through the third body to receive a third shaft therethrough that rotatably couples the movement guide in the housing of the latch;

a contact arm extending outward from the body in a first direction so as to selectively contact the actuator;

an insertion arm extending outward from the body in a second direction so as to be selectively received in the first insertion recess formed in the first body of the holding device; and a third holding protrusion extending upward from the third body.

11. The latch of claim 10, further comprising:

a first elastic member having a first end thereof coupled to the first holding protrusion of the holding device and a second end thereof coupled to the third holding protrusion of the movement guide; and a second elastic member having a first end thereof coupled to the second holding protrusion of the rotation limiter and a second end thereof coupled to the third holding protrusion of the movement guide.

12. A latch provided on a container positioned between a cabinet and a door and configured to selectively engage and disengage the door and to selectively disengage and engage the cabinet such that the container is coupled to the door and de-coupled from the cabinet in a first mode and the container is coupled to the cabinet and de-coupled from the door in a second mode, the latch comprising:

a housing;

a holding device rotatably installed in the housing;

a hook provided in the door, wherein the holding device is configured to selectively engage the hook;

a rotation limiter installed in the housing to limit rotation of the holding device;

a movement guide to guide movement of the holding device;

guide recesses formed at a top and at a bottom of the housing to guide movement of the hook into and out of the housing for engagement and disengagement of the hook and the holding device; and an actuator operably coupled to the holding device via the movement guide to selectively press and rotate the holding device to respectively release and engage the hook, wherein the latch engages the container and the door while disengaging the container and the cabinet, and the latch engages the container and the cabinet while disengaging the container and the door.

13. The latch of claim 12, wherein the holding device comprises:

a first body;

a holding recess formed in a peripheral portion of the first body and configured to selectively engage and disengage the hook;

first and second insertion recesses formed in peripheral portions of the first body, opposite the holding recess;

a first shaft hole that extends through the first body to receive a first shaft therethrough that rotatably couples the holding device in the housing of the latch;

a pin that extends downward from a bottom of the first body; and a first holding protrusion that extends upward from a top of the first body.

14. The latch of claim 13, wherein the rotation limiter comprises:

a second body having a first extension extending outward in a first direction from a central portion thereof and a second extension extending outward in a second direction from the central portion thereof;

a second shaft hole that extends through the second body to receive a second shaft therethrough that rotatably couples the rotation limiter in the housing of the latch;

a second holding protrusion formed at a distal end of the second extension;

an insertion protrusion extending upward from an upper surface of the second extension and selectively received in the second insertion recess formed in the first body of the holding device to selectively limit rotation of the holding device.

15. The latch of claim 14, wherein the movement guide comprises:

a third body;

a third shaft hole extending through the third body to receive a third shaft therethrough that rotatably couples the movement guide in the housing of the latch;

a contact arm extending outward from the body in a first direction so as to selectively contact the actuator;

an insertion aim extending outward from the body in a second direction so as to be selectively received in the first insertion recess formed in the first body of the holding device; and a third holding protrusion extending upward from the third body.

* * * * *